US006948328B2

(12) United States Patent
Kidwell

(10) Patent No.: US 6,948,328 B2
(45) Date of Patent: Sep. 27, 2005

(54) CENTRIFUGAL HEAT TRANSFER ENGINE AND HEAT TRANSFER SYSTEMS EMBODYING THE SAME

(75) Inventor: John E. Kidwell, Tulsa, OK (US)

(73) Assignee: Metrologic Instruments, Inc., Blackwood, NJ (US)

( * ) Notice: Subject to any disclaimer, the term of this patent is extended or adjusted under 35 U.S.C. 154(b) by 64 days.

(21) Appl. No.: 10/370,035

(22) Filed: Feb. 18, 2003

(65) Prior Publication Data

US 2004/0040324 A1 Mar. 4, 2004

Related U.S. Application Data

(63) Continuation of application No. 09/922,214, filed on Aug. 3, 2001, now abandoned, and a continuation of application No. 09/317,055, filed on May 24, 1999, now Pat. No. 6,334,323, and a continuation of application No. 08/725,648, filed on Oct. 1, 1996, now Pat. No. 5,906,108, and a continuation of application No. 08/656,595, filed on May 31, 1996, now abandoned, and a continuation of application No. 08/391,318, filed on Feb. 21, 1995, now abandoned, and a continuation of application No. 08/175,485, filed on Dec. 30, 1993, now abandoned, and a continuation of application No. 07/893,927, filed on Jun. 12, 1992, now abandoned.

(51) Int. Cl.[7] ..... F25B 3/00; F28D 15/00

(52) U.S. Cl. ..... 62/209; 62/499; 165/104.25

(58) Field of Search ..... 62/209, 228.4, 62/499; 165/104.25, 104.31, 184

(56) References Cited

U.S. PATENT DOCUMENTS

| | | | |
|---|---|---|---|
| 503,611 | A | 8/1893 | Marcus |
| 1,063,636 | A | 6/1913 | Barbezat |
| 1,145,226 | A | 7/1915 | Bertsch |
| 1,204,061 | A | 11/1916 | Plekenpol |
| 1,223,919 | A | 4/1917 | Wilson |
| 1,315,282 | A | 9/1919 | Carpenter |
| 1,352,107 | A | 9/1920 | Wagenhorst |
| 1,446,727 | A | 2/1923 | Smith |
| 1,537,937 | A | 5/1925 | De Remer |
| 1,589,373 | A | 6/1926 | De Remer |

(Continued)

FOREIGN PATENT DOCUMENTS

| | | | |
|---|---|---|---|
| DE | 541575 | 1/1932 | |
| FR | 2 333 208 | 6/1977 | ..... F25B/29/00 |
| GB | 182528 | 6/1922 | |

OTHER PUBLICATIONS

Supplementary European Search Report for EP 97 94 5340, 2001.

International Search Report for PCT/US97/17482, 1998.

*Primary Examiner*—Marc Norman

(74) *Attorney, Agent, or Firm*—Thomas J. Perkowski, Esq., P.C.

(57) ABSTRACT

A rotor structure rotatably supported within a stator structure, having primary and secondary heat exchanging chambers in thermal isolation from each other. The rotor structure has primary and secondary heat transferring portions within which a closed fluid flow circuit is embodied. The closed fluid flow circuit within the rotor has a spiraled fluid-return passageway extending along its rotary shaft, and is charged with a refrigerant which is automatically circulated between the primary and secondary heat transferring portions of the rotor when the rotor is rotated within an optimized angular velocity range under the control of a temperature-responsive system controller. A technically feasible heat transfer engine can be built upon the rotor structure, while avoiding the need for conventional external compressors, and allowing the use of environmentally safe refrigerants. Various embodiments of the heat transfer engine are disclosed, in addition to methods of manufacture and fields and applications of use.

20 Claims, 61 Drawing Sheets

U.S. PATENT DOCUMENTS

| | | | | |
|---|---|---|---|---|
| 1,635,523 | A | | 7/1927 | Wilson |
| 1,889,817 | A | | 12/1932 | Audiffren et al. |
| 1,969,999 | A | | 8/1934 | Cuthbert |
| 2,111,750 | A | | 3/1938 | Carlson |
| 2,156,628 | A | | 5/1939 | Hintze |
| 2,229,500 | A | | 1/1941 | Goldsmith |
| 2,324,434 | A | | 7/1943 | Shore |
| 2,331,878 | A | | 10/1943 | Wentworth |
| 2,440,593 | A | | 4/1948 | Miller |
| 2,522,781 | A | | 9/1950 | Exner |
| 2,609,672 | A | | 9/1952 | Wales |
| 2,643,817 | A | | 6/1953 | Makaroff et al. |
| 2,670,894 | A | | 3/1954 | Warrick et al. |
| 2,805,558 | A | | 9/1957 | Knight |
| 2,811,841 | A | | 11/1957 | Grimshaw |
| 2,813,698 | A | | 11/1957 | Lincoln |
| 2,969,021 | A | | 1/1961 | Menon |
| 2,969,743 | A | | 1/1961 | Menon |
| 3,001,384 | A | | 9/1961 | Hanson et al. |
| 3,025,684 | A | | 3/1962 | McLain et al. |
| 3,026,021 | A | | 3/1962 | Emanuel |
| 3,098,602 | A | | 7/1963 | Torluemke |
| 3,189,262 | A | | 6/1965 | Hanson et al. |
| 3,397,739 | A | | 8/1968 | Miller et al. |
| 3,948,061 | A | | 4/1976 | Kidwell ..... 62/499 |
| 5,493,868 | A | | 2/1996 | Kikuiru et al. |
| 5,906,108 | A | | 5/1999 | Kidwell |
| 6,321,547 | B1 | * | 11/2001 | Kidwell ..... 62/209 |
| 2002/0092316 | A1 | * | 7/2002 | Kidwell ..... 62/499 |
| 2003/0145621 | A1 | * | 8/2003 | Kidwell ..... 62/499 |
| 2003/0217566 | A1 | * | 11/2003 | Kidwell ..... 62/499 |

* cited by examiner

Top View

END VIEW

END VIEW

Cooling Mode

Heating Mode

CENTRIFUGAL HEAT TRANSFER ENGINE AND HEAT TRANSFER SYSTEMS EMBODYING THE SAME

RELATED CASES

This is a Continuation of application Ser. No. 09/922,214 filed Aug. 3, 2001, now abandoned, which is a Continuation of Application Ser. No. 09/317,055 filed May 24, 1999, now U.S. Pat. No. 6,334,323, which is a Continuation of Application Ser. No. 08/725,648 filed Oct. 1, 1996, now U.S. Pat. No. 5,906,108, which is a Continuation of Application Ser. No. 08/656,595 filed May 31, 1996, now abandoned; which is a Continuation of Application Ser. No. 08/391,318 filed Feb. 21, 1995, now abandoned; which is a Continuation of Application Ser. No. 08/175,485 filed Dec. 30, 1993, now abandoned; which is a Continuation of Application Ser. No. 07/893,927 filed Jun. 12, 1992, now abandoned; each of said Applications being assigned to and commonly owned by Kelix Heat Transfer Systems, LLC of Tulsa, Okla. and incorporated herein by reference in its entirety.

BACKGROUND OF INVENTION

1. Field of the Invention

The present invention relates to a method of and apparatus for transferring heat within diverse user environments, using centrifugal forces to realize the evaporator and condenser functions required in a vapor-compression type heat transfer cycle.

2. Brief Description of the State of the Prior Art

For more than a century, man has used various techniques for transferring heat between spaced apart locations for both heating and cooling purposes. One major heat transfer technique is based on the reversible adiabatic heat transfer cycle. In essence, this cycle is based on the well known principle, in which energy, in the form of heat, can be carried from one location at a first temperature, to another location at a second temperature. This process can be achieved by using the heat energy to change the state of matter of a carrier fluid, such as a refrigerant, from one state to another state in order to absorb the heat energy at the first location, and to release the absorbed heat energy at the second location by transforming the state of the carrier fluid back to its original state. By using the reversible heat transfer cycle, it is possible to construct various types of machines for both heating and/or cooling functions.

Most conventional air conditioning systems in commercial operation use the reversible heat transfer cycle, described above. In general, air conditioning systems transfer heat from one environment (i.e. an indoor room) to another environment (i.e. the outdoors) by cyclically transforming the state of a refrigerant (i.e. working fluid) while it is being circulated throughout the system. Typically, the state transformation of the refrigerant is carried out in accordance with a vapor-compression refrigeration cycle, which is an instance of the more generally known "reversible adiabatic heat transfer cycle".

According to the vapor-compression refrigeration cycle, the refrigerant in its saturated vapor state enters a compressor and undergoes a reversible adiabatic compression. The refrigerant then enters a condenser, wherein heat is liberated to its environment causing the refrigerant to transform into its saturated liquid state while being maintained at a substantially constant pressure. Leaving the condenser in its saturated liquid state, the refrigerant passes through a throttling (i.e. metering) device, wherein the refrigerant undergoes adiabatic throttling. Thereafter, the refrigerant enters the evaporator and absorbs heat from its environment, causing the refrigerant to transform into its vapor state while being maintained at a substantially constant pressure. Consequently, as a liquid or gas, such as air, is passed over the evaporator during the evaporation process, the air is cooled. In practice, the vapor-compression refrigeration cycle deviates from the ideal cycle described above due primarily to the pressure drops associated with refrigeration flow and heat transfer to or from the ambient surroundings.

A number of working fluids (i.e. refrigerants) can be used with the vapor-compression refrigeration cycle described above. Ammonia and sulfur dioxide were important refrigerants in the early days of vapor-compression refrigeration. In the contemporary period, azeotropic refrigerants, such as R-500 and R-502, are more commonly used. Halocarbon refrigerants originate from hydrocarbons and include ethane, propane, butane, methane, and others. While it is a common practice to blend together three or more halogenated hydrocarbon refrigerants such as R-22, R125, and R-290, near-azeotropic blend refrigerants suffer from temperature drift. Also, near azeotropic blend refrigerants are prone to fractionation, or chemical separation. Hydrocarbon based fluids containing hydrogen and carbon are generally flammable and therefore are poorly suited for use as refrigerants. While halogenated hydrocarbons are nonflammable, they do contain chlorine, fluorine, and bromine, and thus are hazardous to human health.

Presently, the main refrigerants in use are the halogenated hydrocarbons, e.g. dichlorodifluoromethane (CCL2F2), commonly known as R-12 refrigerant. Generally, there are three groups of useful hydrocarbon refrigerants: chlorofluorocarbons, (CFCs), hydrochlorofluorocarbons, (HCFCs), which are created by substituting some or all of the hydrogen with halogen in the base molecule. Hydrofluorocarbons, (HFCs), contain hydrogen, fluorine, and carbon. However, as a result of the Montreal Protocol, CFCs and HCFCs are being phased out over the coming decades in order to limit the production and release of CFC's and other ozone depleting chemicals. The damage to ozone molecules ($O_3$) comprising the Earth's radiation-filtering ozone layer occurs when a chlorine atom attaches itself to the $O_3$ molecule. Two oxygen atoms break away leaving two molecules. One molecule is oxygen ($O_2$) and the other is chlorine monoxide molecule (CO). The chlorine monoxide is believed by scientists to displace the ozone normally occupying that space, and thus effectively depleting the ozone layer.

While great effort is being expended in developing new refrigerants for use with machines using the vapor-compression refrigeration cycle, such refrigerants are often unsuitable for conventional vapor-compression refrigeration units because of their incompatibility with existing lubricating additives, and the levels of toxicity which they often present. Consequently, existing vapor-compression refrigeration units are burdened with a number of disadvantages. Firstly, they require the use of a mechanical compressor which has a number of moving parts that can break down. Secondly, the working fluid must also contain oil to internally lubricate the compressor. Mineral oil has been used in refrigeration systems for many years, and alternative refrigerants like hydrofluorocarbons (HFC) require synthetic lubricants such as alkylbenzene and polyester. This use of such lubricants diminishes system efficiency. Thirdly, existing vapor-compression systems require seals to prevent the escape of harmful refrigerant vapors. These seals can harden and leak with time. Lastly, new requirements for refrigerant recovery increase the cost of a vapor-compression unit.

In 1976, Applicant disclosed a radically new type of refrigeration system in U.S. Pat. No. 3,948,061, now expired. This alternative refrigeration system design eliminated the use of a compressor in the conventional sense, and thus many of the problems associated therewith. As disclosed, this prior art system comprises a rotatable structure having a hollow shaft with a straight passage therethrough, and about which a closed fluid circuit is supported. The closed fluid circuit is realized as an assemblage of two spiral tubular assemblies, each consisting of first and second spiraled tube sections. The first and second spiraled tube sections have a different number of turns. A capillary tube, placed between the condenser and evaporator sections, functions as a throttling or metering device. When the rotatable structure is rotated in a clockwise direction, one end of the tube assembly functions as a condenser, while the other end thereof functions as an evaporator. As disclosed, means are provided for directing separate streams of gas or liquid across the condenser and evaporator assemblies for effecting heat transfer operations with the ambient environment.

In principal, the refrigeration unit design disclosed in U.S. Pat. No. 3,948,061 provides numerous advantages over existing vapor-compression refrigeration units. However, hitherto successful realization of this design has been hindered by a number of problems. In particular, the use of the capillary tube and the hollow shaft passage create imbalances in the flow of refrigerant through the closed fluid flow circuit. When the rotor structure is rotated at particular speeds, there is a tendency for the refrigerant fluid to cease flowing therethrough, causing a disturbance in the refrigeration process. Also, when using this prior art centrifugal refrigeration design, it has been difficult to replicate the refrigeration effect with reliability, and thus commercial practice of this alternative refrigeration system and process has hitherto been unrealizable.

Thus, there exists a great need in the art for an improved centrifugal heat transfer engine, which avoids the shortcomings and drawbacks thereof, and allows for the widespread application of such an alternative heat transfer technology in diverse applications.

OBJECTS OF THE PRESENT INVENTION

Accordingly, it is a primary object of the present invention to provide an improved method of and apparatus for transferring heat within diverse user environments using centrifugal forces to realize the evaporator and condenser functions required in a vapor-compression type heat transfer cycle, while avoiding the shortcomings and drawbacks of prior art apparatus and methodologies.

A further object of the present invention is to provide such apparatus in the form of a centrifugal heat transfer engine which, by eliminating the use of mechanical compressors, reduces the introduction of heat into the system by the internal moving parts of conventional motor driven compressors, and energy losses caused by refrigeration lubricants used to lubricate the moving parts thereof.

A further object of the present invention is to provide a centrifugal heat transfer engine that contains the refrigerant within a closed system in order to avoid leakage, yet being operable with a wide range of refrigerants.

A further object of the present invention is to provide a centrifugal heat transfer engine having a rotor structure with a closed, fluid circulating system that contributes to a dynamic balance of refrigerant flow.

A further object of the present invention is to provide a centrifugal heat transfer engine having a rotor structure embodying a fluid circulation system which, when rotated direction in a first direction, has a first portion that functions as a condenser and a second portion that functions as an evaporator to provide a refrigeration unit, and when the direction of the rotor structure is reversed, the first portion functions as an evaporator and the second portion functions as a condenser to provide a heating unit.

A further object of the present invention is to provide a centrifugal heat transfer engine that either condenses or evaporates a chemical refrigerant as it is passed through a plurality of helical passageways which are part of its rotor structure.

A further object of the present invention is to provide a centrifugal heat transfer engine which provides a simple apparatus for carrying out a refrigeration cycle without the necessity for compressors or other internal moving parts that introduce unnecessary heat into the refrigerant.

A further object of the present invention is to provide a centrifugal heat transfer engine which does not require refrigerant contamination with an internal lubricant, and thus permits the refrigerant to function at optimum heat transferring quality.

A further object of the present invention is to provide a centrifugal heat transfer engine having a temperature responsive torque-controlling system in order to maintain the angular velocity of the rotor structure within prespecified operating range, and thus maintain the flow of refrigerant through the fluid circulating system of the rotor structure.

A further object of the present invention is to provide such a centrifugal heat transfer engine with a rotatable structure containing the self-circulating fluid circuit having a bidirectional throttling device placed between the condenser section and the evaporator section of the fluid circuit.

A further object of the present invention is to provide such a bidirectional throttling device for controlling the flow rate of liquid refrigerant into the evaporation length of the evaporator section of the rotor structure, and the amount of pressure drop between the liquid pressurization length and the evaporation length during a range of axial velocities (RPM) of the rotor structure.

A further object of the present invention is to provide such a centrifugal heat transfer engine, in which the optimum axial velocity is arrived at and controlled by a torque controlling system responsive to temperature changes detected in the ambient air or liquid being treated using an array of temperature sensors.

A further object of the present invention is to provide such a centrifugal heat transfer engine with a spiral passage along the shaft of the rotor structure in order to cause vapor-compression as it draws the heavy refrigerant vapor from the evaporator to the condenser in both clockwise and counter-clockwise directions of rotation.

A further object of the present invention is to provide such a centrifugal heat transfer engine with a rotor structure having heat transfer fins in order to enhance heat transfer between the circulating refrigerant and the ambient environment during the operation of the engine.

A further object of the present invention is to provide such a centrifugal heat transfer engine, in which the closed refrigerant flow circuit within the rotor structure is realized as spiraled tubing assembly having spiraled tubular condenser section and a tubular evaporator section which are both held in position by structural supports anchored to the shaft and connected to spiraled tubes.

A further object of the present invention is to provide such a centrifugal heat transfer engine, in which the rotor structure is constructed as a solid assembly and the closed refrigerant flow circuit, including its spiral return passageway along the axis of rotation, is formed therein.

Another object of the present invention is to provide a novel heat transfer engine which can be used to transfer heat within a building, home, automobile, tractor-trailer, aircraft, freight train, maritime vessel, or the like, in order to maintain one or more temperature control functions.

These and other objects of the present invention will become apparent hereinafter and in the Claims to Invention.

SUMMARY OF THE INVENTION

In general, the present invention provides a novel method and apparatus for transferring heat within diverse user environments, using centrifugal forces to realize the evaporator and condenser functions required in a vapor-compression type heat transfer cycle.

According to a first aspect of the present invention, the apparatus of the present invention is provided in the form of a reversible heat transfer engine. The heat transfer engine comprises a stator, port connectors, a heat exchanging rotor, torque generator, temperature selector, a plurality of temperature sensors, a fluid flow rate controller, and a system controller.

The stator housing has primary and secondary heat transfer chambers, and a thermal isolation barrier disposed therebetween. The primary and secondary heat transfer chambers each have inlet and outlet ports and a continuous passageway therebetween. A first port connector is provided for interconnecting a primary heat exchanging circuit to the heat ports of the primary heat transfer chamber, so as to permit a primary heat exchanging medium to flow through the primary heat exchanging circuit and the primary heat exchanging chamber during the operation of the heat transfer engine. A second port connector is provided for interconnecting a secondary heat exchanging circuit to the inlet and outlet ports of said secondary heat transfer chamber, so as to permit a secondary heat exchanging medium to flow through the secondary heat exchanging circuit and the secondary heat transfer chamber during the operation of the reversible heat transfer engine, while the primary and secondary heat exchanging circuits are in substantial thermal isolation of each other.

The heat exchanging rotor is rotatably supported within the stator housing about an axis of rotation and having a substantially symmetrical moment of inertia about the axis of rotation. The heat exchanging rotor has a primary heat exchanging end portion disposed within the primary heat transfer chamber, a secondary heat exchanging end portion disposed within the secondary heat transfer chamber, and an intermediate portion disposed between the primary and secondary heat exchanging end portions. The heat exchanging rotor contains a closed fluid circuit symmetrically arranged about the axis of rotation and has a return portion extending along the direction of the axis of rotation.

The primary heat exchanging end portion of the rotor is disposed in thermal communication with the primary heat exchanging circuit, and the secondary heat exchanging end portion of the rotor is disposed in thermal communication with the secondary heat exchanging circuit. The intermediate portion of the rotor is physically adjacent to the thermal isolation barrier so as to present a substantially high thermal resistance to heat transfer between the primary and secondary heat exchanging chambers during operation of the heat transfer engine.

A predetermined amount of a heat carrying medium is contained within the closed fluid circuit of the heat exchanging rotor. The heat carrying medium is characterized by a predetermined heat of evaporation at which the heat carrying medium transforms from liquid phase to vapor phase, and a predetermined heat of condensation at which the heat carrying medium transforms from vapor phase to liquid phase. The direction of phase change of the heat carrying liquid is reversible.

The function of the torque generator is to impart torque to the heat exchanging rotor and cause the heat exchanging rotor to rotate about the axis of rotation. The function of the temperature selector is to select a temperature to be maintained along the primary heat exchanging circuit. The function of the temperature sensor is to measure the temperature of the primary heat exchanging medium flowing through the inlet and outlet ports of the primary heat exchanging chamber, and for measuring the temperature of the secondary heat exchanging medium flowing through the inlet and outlet ports of the primary heat exchanging chamber. The function of the fluid flow rate controller is to control the flow rate of the primary heat exchanging medium flowing through the primary heat exchanging chamber and the flow rate of the secondary heat exchanging medium flowing through the secondary heat exchanging chamber, in response to the sensed temperature of the heat exchanging medium at either the inlet or outlet port in either the primary or secondary heat exchanging chambers and to satisfy the temperature selector setting.

The function of the torque controller is to control the torque generating means in response to the sensed temperature of the heat exchanging medium at either the inlet or outlet port in either the primary or secondary heat exchanging chambers and the selected operating temperature setting.

BRIEF DESCRIPTION OF THE DRAWINGS

For a more complete understanding of the Objects of the Present Invention, the following Detailed Description of the Illustrative Embodiments should be read in conjunction with the accompanying Drawings, wherein.

DETAILED DESCRIPTION OF THE ILLUSTRATIVE EMBODIMENTS OF THE PRESENT INVENTION

Figure 1:
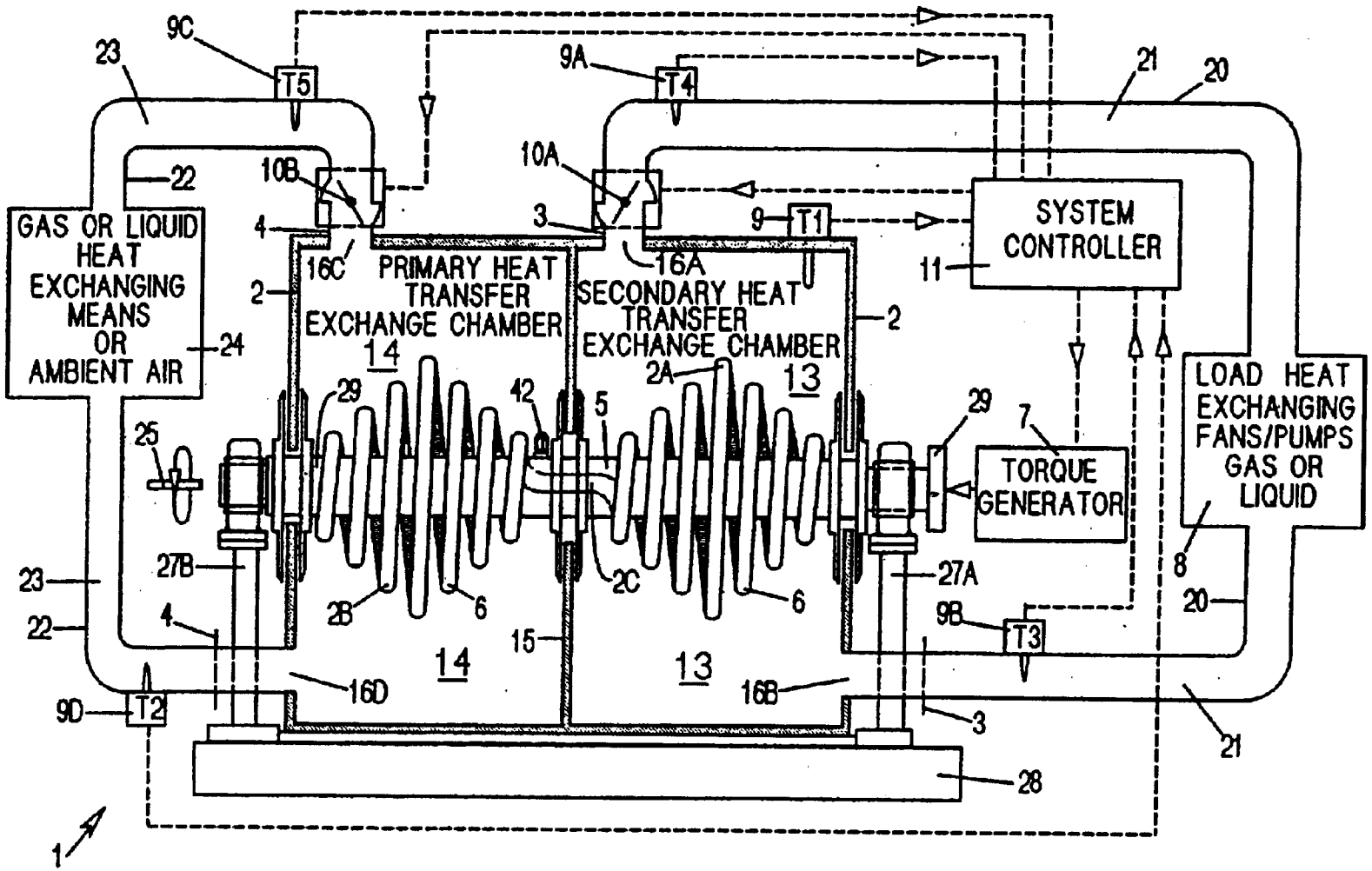
FIG. 1 is a schematic representation of the first illustrative embodiment of the heat transfer engine of the present invention, showing the fluid-carrying rotor structure thereof being rotated about its shaft by a torque generator controlled by a system controller responsive to the temperatures measured from a plurality of locations about the system.

Referring to the Figures of the accompanying Drawings, the Illustrative Embodiments of the Present Invention will be described in great detail below. Throughout the drawings, like structures will be represented by like reference numerals.

First Illustrative Embodiment of the Heat Transfer Engine Hereof

In FIG. 1, a first illustrative embodiment of the centrifugal heat transfer engine is shown. As shown, this embodiment of the heat transfer engine comprises a rotatable structure (i.e. "rotor") realized as a spiral coiled tubing assembly, that is rotatably supported by a stationary structure ("stator"). Thus, hereinafter this embodiment of the heat transfer engine shall be referred to as the coiled centrifugal heat transfer engine.

As shown in FIG. 1, reversible centrifugal heat transfer engine 1 comprises a number of major system components, namely: a stator housing 2; primary port connection assembly 3; secondary port connection assembly 4; heat-exchanging rotor 5; a heat carrying medium 6; torque generator 7; temperature selection unit 9; temperature sensors 9A through 9D; primary and secondary fluid flow rate controllers 10A and 10B; and temperature-responsive system controller 11. Each of these system components will be described in detail below.

As shown, the stator housing comprises primary and secondary heat transfer chambers 13 and 14, and a thermal isolation barrier 15 disposed therebetween. By definition, the primary heat transfer chamber shall indicate hereinafter and in the claims the environment within which the temperature of a fluid (i.e. gas or liquid) contained therein is to be maintained by way of operation of the heat transfer engine hereof. Primary heat transfer chamber 13 has inlet and outlet ports 16A and 16B, and secondary heat transfer chamber 14 has inlet and outlet ports 16C and 16D. Primary port connection assembly 3 is provided for interconnecting a primary heat exchanging circuit 20 (e.g. ductwork) to the inlet and outlet ports of the primary heat transfer chamber, so as to permit a primary heat exchanging medium 21, such as air or water, to flow through the primary heat exchanging circuit and the primary heat exchanging chamber during the operation of the heat transfer engine, while the primary and secondary heat exchanging circuits are in substantial thermal isolation of each other. Similarly, secondary port connection assembly 4 is provided for interconnecting a secondary heat exchanging circuit 22 to the inlet and outlet ports of the secondary heat transfer chamber, so as to permit a secondary heat exchanging medium 23 to flow through the secondary heat exchanging circuit and the secondary heat transfer chamber during the operation of the heat transfer engine, while the primary and secondary heat exchanging circuits are in substantial thermal isolation of each other.

Figure 2A:
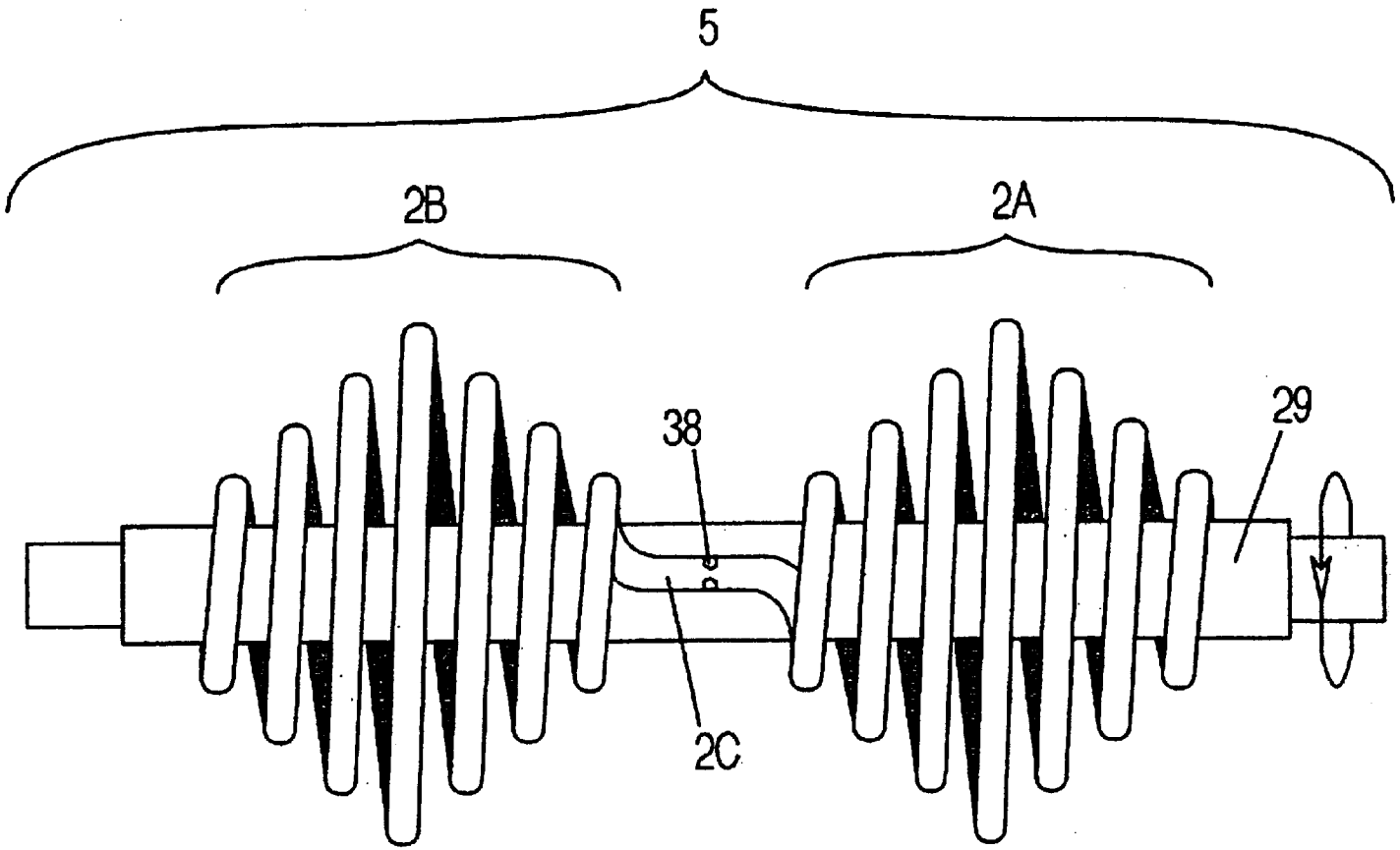
FIG. 2A is an elevated side view of the fluid-carrying rotor structure of the first illustrative embodiment of FIG. 1, shown removed from the stator portion thereof, and with indications depicting which fluid carrying tube sections carry out the condenser and evaporator functions respectively, when the rotor structure is rotated in the direction shown.
Figure 2B:
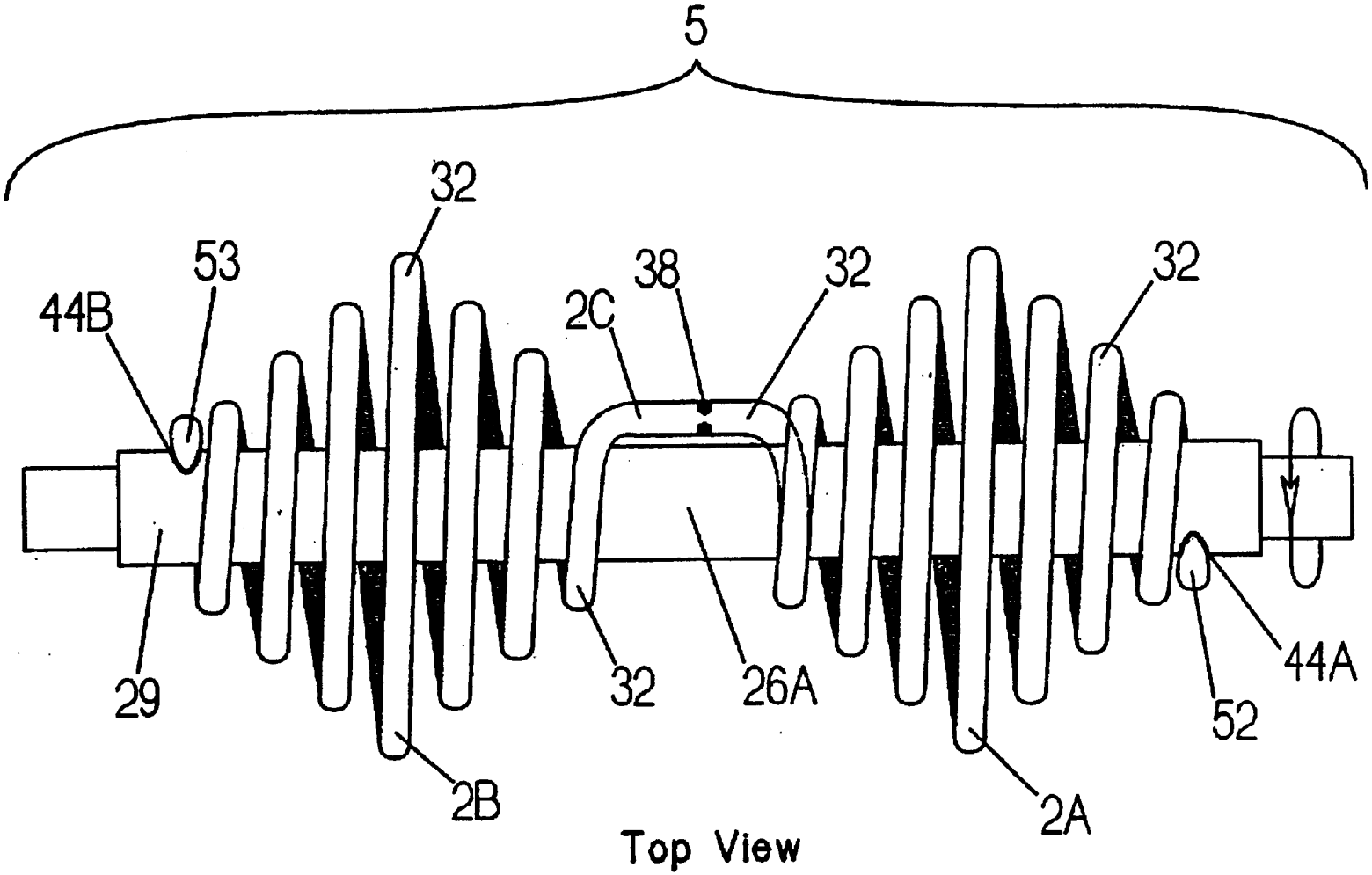
FIG. 2B is a top view of the fluid-carrying rotor structure of the first illustrative embodiment of the FIG. 1, shown removed from the stator portion thereof, with indications depicting the location of the throttling device and rotor shaft coil penetrations.
Figure 3:
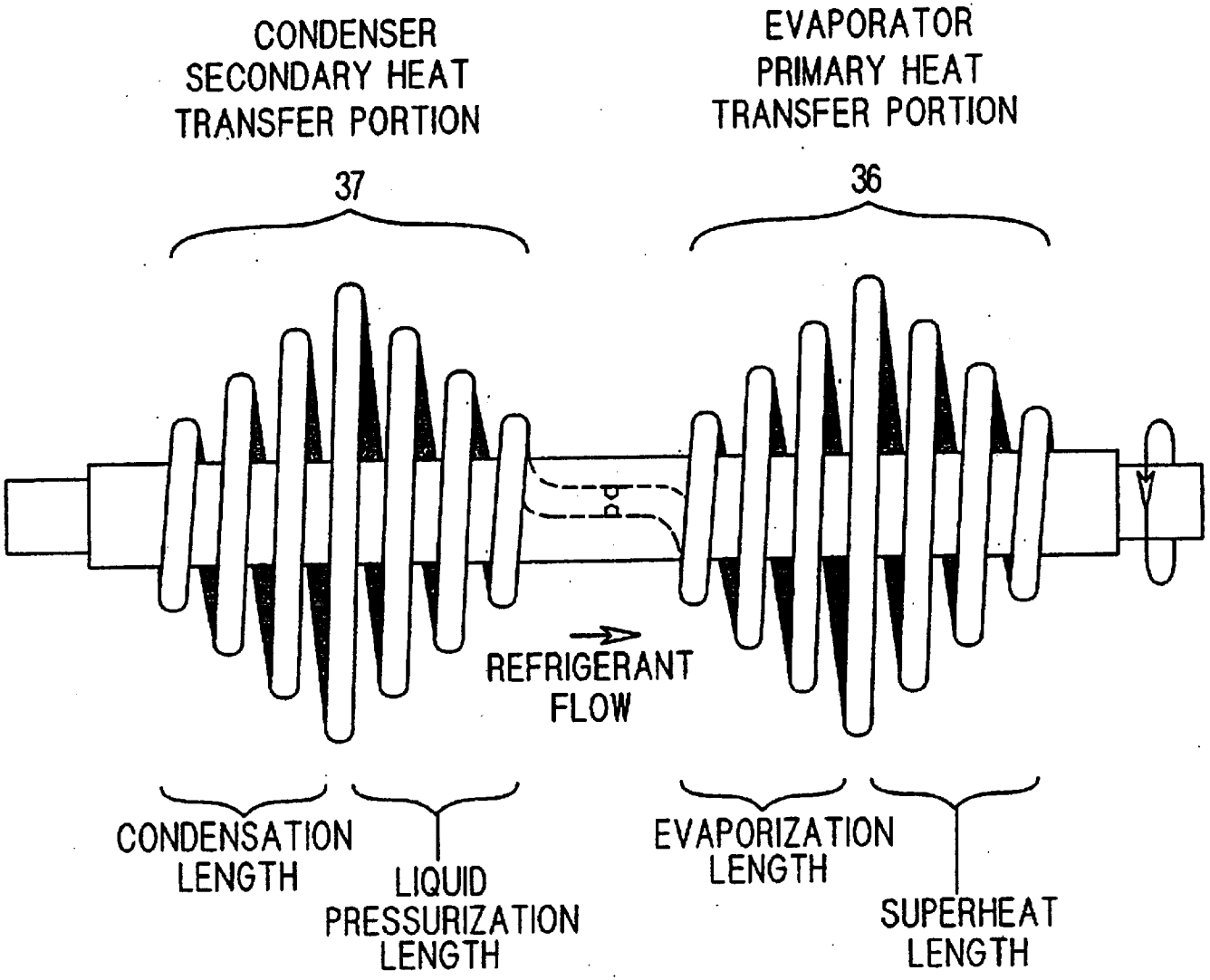
FIG. 3 is an elevated side view of the fluid-carrying rotor structure of the first illustrative embodiment of FIG. 1, shown removed from the stator portion thereof, with indications depicting which fluid carrying tube sections carry out the condenser and evaporator functions, respectively, when the rotor structure is rotated in the direction shown.

As illustrated in FIG. 1, heat exchanging rotor 5 is rotatably supported within the stator housing 2 about an axis of rotation 25 and has a substantially symmetrical moment of inertia about the axis of rotation. The heat exchanging rotor has a primary heat exchanging end portion 2A disposed within the primary heat transfer chamber 13, a secondary heat exchanging end portion 2B disposed within the secondary heat transfer chamber 14, and an intermediate portion 2C disposed between the primary and secondary heat exchanging end portions 2A and 2B. As shown in FIGS. 2A and 2B, the heat exchanging rotor 5 contains a closed fluid circuit 32 symmetrically arranged about the axis of rotation and has a return portion 26A extending along the direction of the axis of rotation. The primary heat exchanging end portion 2A of the rotor is disposed in thermal communication with the primary heat exchanging circuit 20, whereas the secondary heat exchanging end portion 2B of the rotor is disposed in thermal communication with the secondary heat exchanging circuit 22. The intermediate portion 2C thereof is physically adjacent to the thermal isolation barrier 15. The physical arrangement described above presents a substantially high thermal resistance to heat transfer between the primary and secondary heat exchanging chambers 13 and 14 during operation of the reversible heat transfer engine.

As shown in FIG. 1, stator structure 2 is realized as a pair of rotor support elements 27A and 27B mounted upon a support platform 28 in a spaced apart manner.

In the illustrative embodiment, a predetermined amount of a heat carrying medium 6, such as refrigerant, is contained within the closed fluid circuit 32 and 26A of the rotor. In general, the heat carrying medium is characterized by three basic thermodynamic properties: (i) its predetermined heat of evaporation at which the heat carrying medium transforms from liquid phase to vapor phase; and (ii) its predetermined heat of condensation at which the heat carrying medium transforms from vapor phase to liquid phase; and (iii) direction reversibility of phase change of the heat carrying liquid. Examples of suitable refrigerants for use with the heat transfer engine hereof include fluid refrigerants having a liquid or gaseous state during applicable operating temperature and pressure ranges. When selecting a refrigerant, the following consideration should be made: compatibility between the refrigerant and materials used to construct the closed fluid flow passageway; chemical stability of the refrigerant under conditions of use; applicable safety codes (e.g. non-flammable refrigerants made be required); toxicity; cost factors; and availability.

In accordance with the principles of the present invention, the refrigerant or other heat-exchanging medium contained within the closed fluid circulation circuit 32 is self-circulating, in that it flows cyclically throughout the closed fluid circulation circuit in response to rotation of the heat exchanging rotor. By virtue of the geometry of the closed fluid circulation circuit about the rotational axis of the rotor, a complex distribution of centrifugal forces act upon and cause the contained refrigerant to circulate within the closed fluid circulation circuit in a cyclical manner, without the use of external pumps or other external fluid pressure generating devices. Conceivably, there exist a family of geometries for the closed fluid circulation circuit which, when embodied within the rotor, will generate a sufficient distribution of centrifugal forces to cause self-circulation of the contained fluid in response to rotation of the rotor. However, the double spiral-coil geometry with the spiral return path along the rotor central axis has been discovered to be the preferred geometry of the present invention. Thus, in each of the three major embodiments of the rotor structure of the present invention, the double spiral coil geometry is shown embodied in a rotor structure of one form or another.

The function of the torque generator 7 is to impart torque to the heat exchanging rotor 5 in order to rotate the same about its axis of rotation at a predetermined angular velocity. In general, the torque generator may be realized in a variety of ways using known technology. Electric, hydraulic and pneumatic motors are just a few types of torque generators that may be coupled to the rotor shaft 29 and be used to controllably impart torque thereto under the control of system controller 11.

The function of the temperature selecting unit 9 is to select (i.e. set) a temperature which is to be maintained along at least a portion of the primary heat exchanging circuit 20. In the illustrative embodiment, the temperature selecting unit 9 is realized by electronic circuitry having memory for storing a selected temperature value, and means for producing an electrical signal representative thereof. The temperature sensors 9A, 9B, 9C, and 9D located at inlet and outlet ports 16A, 16B, 16C and 16D may be realized using any state of the art temperature sensing technology. The function of such devices is to measure the temperature of the primary heat exchanging medium 21 flowing through the inlet and outlet ports of the primary heat exchanging chamber 13, and the secondary heat exchanging medium 23 flowing through the inlet and outlet ports of the secondary heat exchanging chamber 14, and produce electrical signals representative thereof for use by the system controller 11 as will be described in greater detail hereinafter.

The function of the primary and secondary fluid flow rate controllers 10A and 10B is to control the rate of flow of primary and secondary heat exchanging fluid within the primary and secondary heat exchanging circuits, respectively. In other words, the function of the primary fluid flow rate controller 10A is to control the rate of heat flow between the primary heat exchanging portion of the rotor and the primary heat exchanging circuit passing through the primary heat exchanging chamber of the stator housing. Similarly, the function of the secondary fluid flow rate controller 10B is to control the rate of heat flow between the secondary heat exchanging portion of the rotor and the secondary heat exchanging circuit passing through the secondary heat exchanging chamber of the stator housing. In the illustrative embodiments, the fluid flow rate controllers are controlled by the temperature responsive system controller 11 of the engine.

Primary and secondary fluid flow rate controller 10A and 10B may be realized in a variety of ways depending on the nature of the heat exchanging medium being circulated through primary and secondary heat exchanging chambers 13 and 14 as the rotor is rotatably supported within the stator. For example, when the primary heat exchanging medium is air ported from the environment in which the air temperature is to be maintained, then primary fluid flow controller 10A may be realized by an air flow control valve (e.g. damper), whose aperture dimensions are electromechanically controlled by electrical control signals produced by the system controller. When the primary heat exchanging medium is water ported from a primary heat exchanging circuit in which the water temperature is to be maintained, then primary fluid flow controller may be realized by an water control flow valve, whose aperture dimensions are electromechanically controlled by electrical control signals produced by the system controller. In either case, the function of the primary fluid flow rate controller is to control the flow rate of the primary heat exchanging medium flowing through the primary heat exchanging chamber in response to the sensed temperature of the heat exchanging medium at either the inlet or outlet port in either the primary or secondary heat exchanging chambers, and the temperature selected by temperature selection unit. Greater details with regard to this aspect of the control process will be described hereafter.

The secondary fluid flow rate controller 10B may be realized in a manner similar to the primary fluid flow rate controller 10A. In fact, it is possible to construct a heat transfer engine in which the primary and secondary heat exchange fluids are different in physical state (e.g. the primary heat exchange fluid can be air, while the secondary heat exchange fluid is water, and vice versa). In each possible case, the function of the secondary fluid flow rate controller is to control the flow rate of the secondary heat exchanging medium flowing through the secondary heat exchanging chamber, in response to the sensed temperature of the heat exchanging medium at either the inlet or outlet port in either the primary or secondary heat exchanging chambers and the temperature selected by temperature selection unit.

The system controller 11 of the present invention has several other functions, namely: to read the temperature of the ambient operating environment measured by way of temperature sensors 9, 9A, 9B, 9C, and 9D; and in response thereto, generate suitable control signals which directly control the operation of torque generator 7; and indirectly control the angular velocity of the heat exchanging rotor, relative to the stator; and control the fluid flow rate of the primary and secondary heat exchanging fluids 21 and 23 flowing through the primary and secondary heat exchanging chambers 13 and 14, respectively. The need to control the angular velocity of the heat exchanging rotor, and the flow rates of the primary and secondary heat exchanging fluids will be described in detail hereinafter with reference to the thermodynamic refrigeration process of the present invention.

In general, the reversible heat transfer engine of the present invention has two modes of operation, namely: a heating mode which is realized when the heat exchanging rotor is rotated in a first predetermined direction of rotation; and a cooling mode which is realized when the rotor is rotated in a second predetermined direction of rotation. Also, while it would be desired that the enclosure (i.e. stator) of the system be thermally insulated for optimal heat transfer operation and efficiency, this is not an essential requirement for system operation.

Referring to FIGS. 2A through 7, the structure and functions of the heat exchanging rotor of the first illustrative embodiment will now be described in greater detail below. As shown, heat exchanging rotor 5 of the first illustrative embodiment is realized as a length of tubing 32 symmetrically coiled around support shaft 29 extending along the axis of rotation of the rotor. As shown, the tubing assembly 36 and 37 has a double spiral-coil geometry, and the support shaft contains a spiral return passage 33 formed therethrough with an inlet opening 34 and an outlet opening 35. The spiral-coiled tubing assembly has a first spiral tubing portion 36, a second spiral tubing portion and bi-directional metering device 38 disposed therebetween. As shown, the ends of the first and second spiral tubing portions 36 and 37 are attached to both the inlet 52 and outlet 53 openings of the spiral return passage 33 along the rotor shaft and creates the closed fluid circulation circuit within the heat transfer structure. The function of the bi-directional metering device 38 is to control (1) the rate of flow of liquid refrigerant into the second spiral tubing portion 36 and (2) the amount of pressure drop between the secondary and primary tubing portions during a preselected range of rotor angular velocities (RPM). The optimum rotor angular velocity is arrived at and controlled by the system controller in response to temperature changes in the air or liquid being treated by the heat transfer engine of the present invention. The reason the throttling device 38 is bidirectional is to allow for refrigerant flow reversal when the direction of rotor rotation is reversed when switching from the cooling mode to the heating mode of the heat transfer engine.

By virtue of the geometry of the closed fluid circulation circuit 26 realized within the rotor, a complex distribution of centrifugal forces are generated and act upon the molecules of refrigerant contained within the closed circuit in response to rotation of the rotor relative to its stator. This, in turn, causes refrigerant to cyclically circulate within the closed circuit, without the use of external pumps or other external fluid pressure generating devices.

Figure 4A:
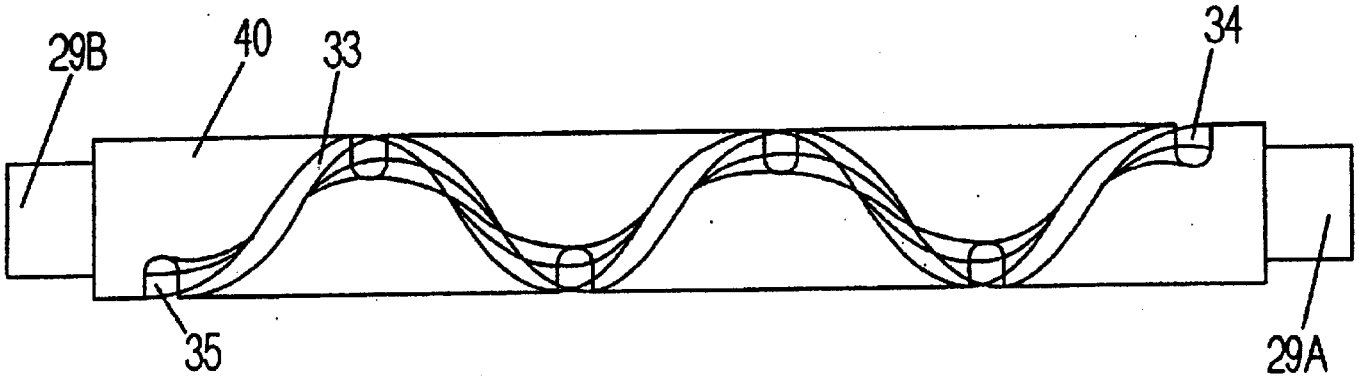
FIG. 4A is an elevated side view of the rotatable support shaft of the rotor structure of the first illustrative embodiment of FIGS. 1 and 2, showing the spiraled passageway extending therealong and shaft end bearing surfaces machined in the shaft core material.
Figure 4B:
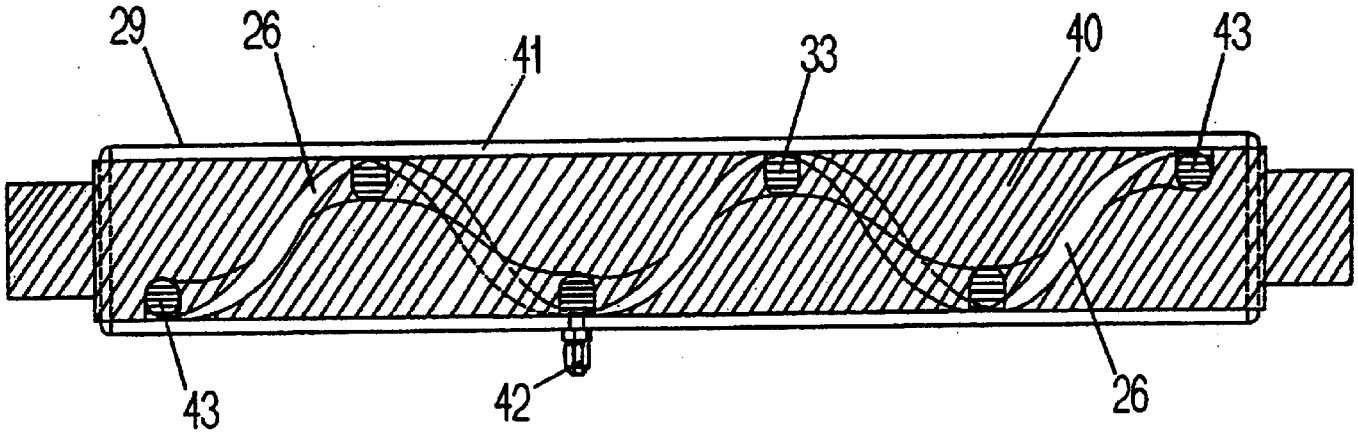
FIG. 4B is an elevated cross-sectional side view of the rotatable support shaft of FIG. 4A, shown inserted into its shaft cover sleeve and welded thereto with a bead of weld formed around the circumference thereof.
Figure 5:
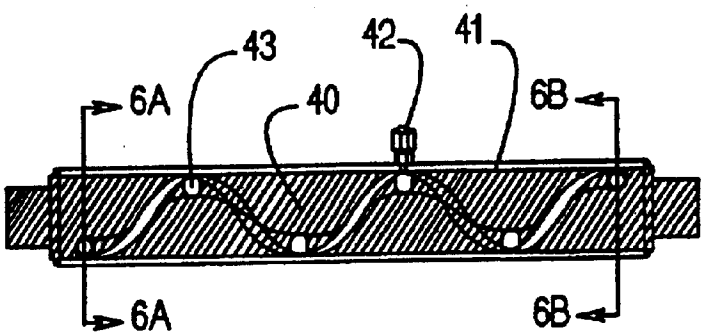
FIG. 5 is an elevated cross-sectional longitudinal view of the rotatable support shaft of the rotor structure of the first illustrative embodiment of FIG. 1.
Figure 6B:
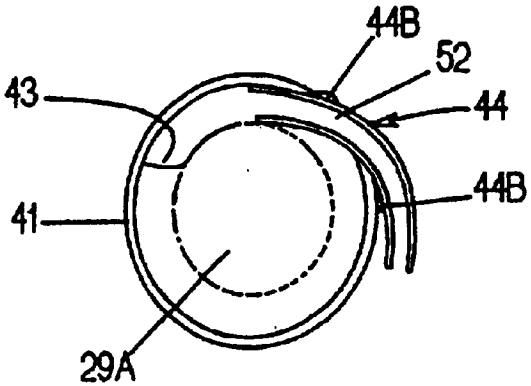
FIGS. 6A and 6B are cross-sectional views of the rotatable support shaft of the rotor structure of the first illustrative embodiment taken along lines 6A—6A and 6B—6B, respectively, of FIG. 5, showing the manner in which the end portions of the spiral coil structure are connected to the spiraled passage formed along the rotatable support shaft of the rotor structure of the first illustrative present invention.
Figure 6A:
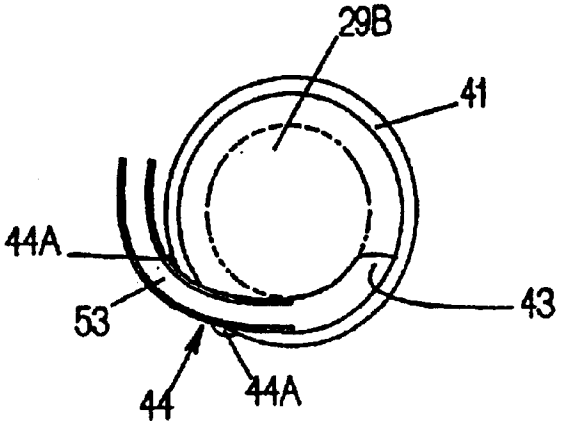

In FIGS. 4A and 4B, details relating to the construction of rotor shaft 29 of the first illustrative embodiment are shown. In particular, the rotor shaft 29 comprises a central shaft core 40 of solid construction enclosed within as cylindrical tube cover 41. Also, a charging port 42 is provided along the end of the central tube in order to provide access to refrigerant inside the closed (i.e. sealed) self-circulating fluid circulation circuit (i.e. system). As best shown in FIG. 4A, central shaft core 40 has a spiraled passage 33 formed about the outer surface thereof, and is enclosed within tube cover 41, thereby creating a spiral shaped passageway 33 from one end of the rotor shaft to the other end thereof. As shown in FIGS. 5, 6A and 6B, a pair of holes 44 are drilled through cylindrical tube cover 41 into the spiraled passageway 33 at the ends of the central shaft 29A and 29B. These holes allow the first and second end portions of double-coil tubing assembly to interconnect with the ends of the spiral rotor shaft, and thus form the closed fluid circulation circuit within the rotor structure.

Figure 7C:
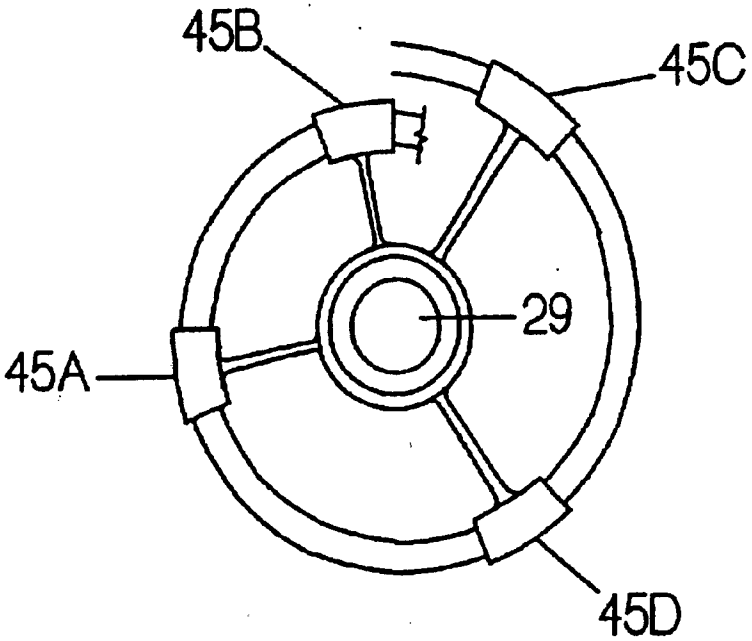
FIG. 7C is an elevated axial view of one spiral turn of the fluid-carrying spiraled tube portion of the rotor structure of the first illustrative embodiment of the present invention shown in FIG. 1.
Figure 7B:
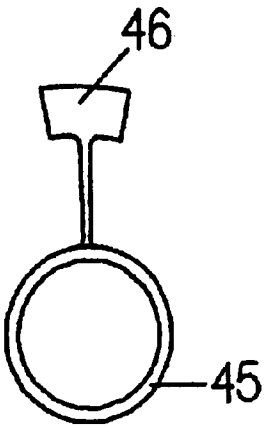
FIG. 7B is a second elevated side view of the support element shown in FIG. 7A.
Figure 7A:
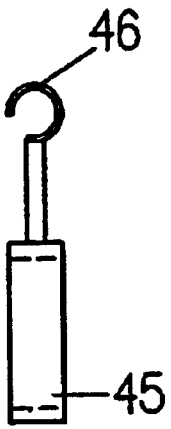
FIG. 7A is a first elevated side view of a support element used to support a section of the fluid-carrying spiraled tube portion of the rotor structure of the first illustrative embodiment of the present invention.

As shown in FIGS. 7A, 7B and 7C, the rotor of the first illustrative embodiment also includes a plurality of tubing support brackets 45A, 45B, 45C and 45D for support of the spiraled tubular sections thereof in position about its central shaft. As shown, each of these tubing support brackets comprises shaft attachment means 45 extending from the rotor shaft 29, and tubing support element 46 for supporting a selected portion of the tubing assembly spiraled about the rotor shaft. These tubing support brackets may be made from any suitable material such as metal, composite material, or other functionally equivalent material. In general, the tubing used to realize the rotor of the first illustrative embodiment may vary in inner diameter as the diameter of the tubing around the central shaft varies. Preferably, the exterior surface of the rotor tubing is framed, while the internal surface thereof is rifled as this construction will improve the heat transfer function of the rotor.

Having described the structure and function of the system components of the heat transfer engine of the first illustrative embodiment, it is appropriate at this juncture to describe in greater detail the operation of the system controller in each of the heat transfer modes of operation of the engine.

Figure 10A:
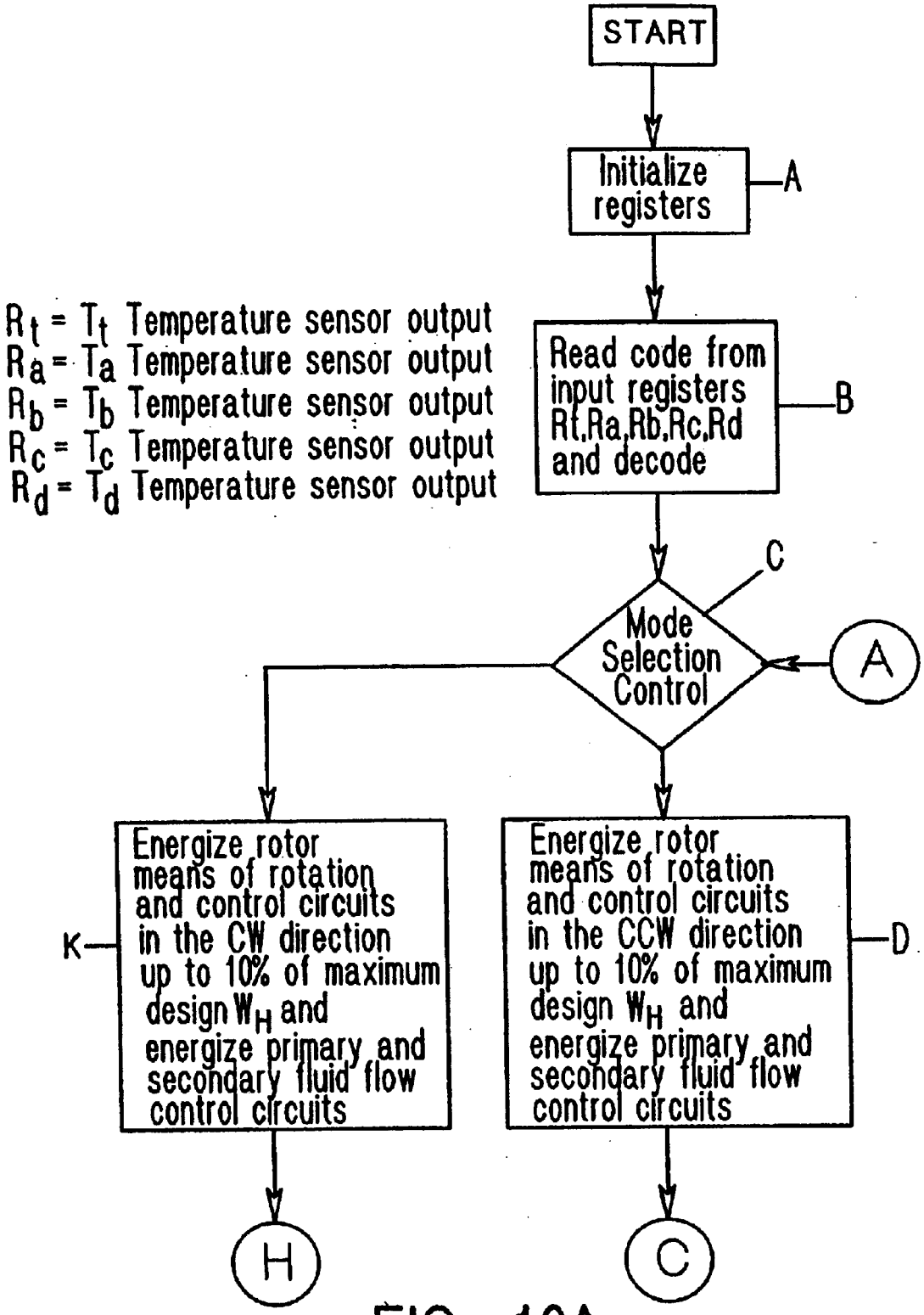
FIGS. 10A, 10B and 10C, collectively, show a flow chart illustrating the steps of the control process carried out by the temperature-responsive system controller of the heat transfer engine of the present invention, operated in either its cooling or heating mode.

In FIG. 10A, the heat transfer engine hereof is shown installed in an environment 50 through which the primary heat exchanging circuit 20 passes in order to control the temperature thereof while the engine is operated in its cooling mode. While the medium within this illustrative environment will typically be ambient air, it is understood that other mediums may be temperature maintained in different applications. Notably, in FIG. 10A, the closed fluid flow circuit of rotor is arranged according to the first conFiguration. To specify the direction of rotor shaft rotation in this mode of operation, it is helpful to embed a Cartesian Coordinate system in the stator, so that the +z axis and point of origin thereof are aligned with the +z axis and point of origin of the rotor. In the first rotor conFiguration, the direction of the rotor rotation is counter-clockwise about the +z axis of the stator reference system when the engine is operated in its cooling mode.

Figure 10B:
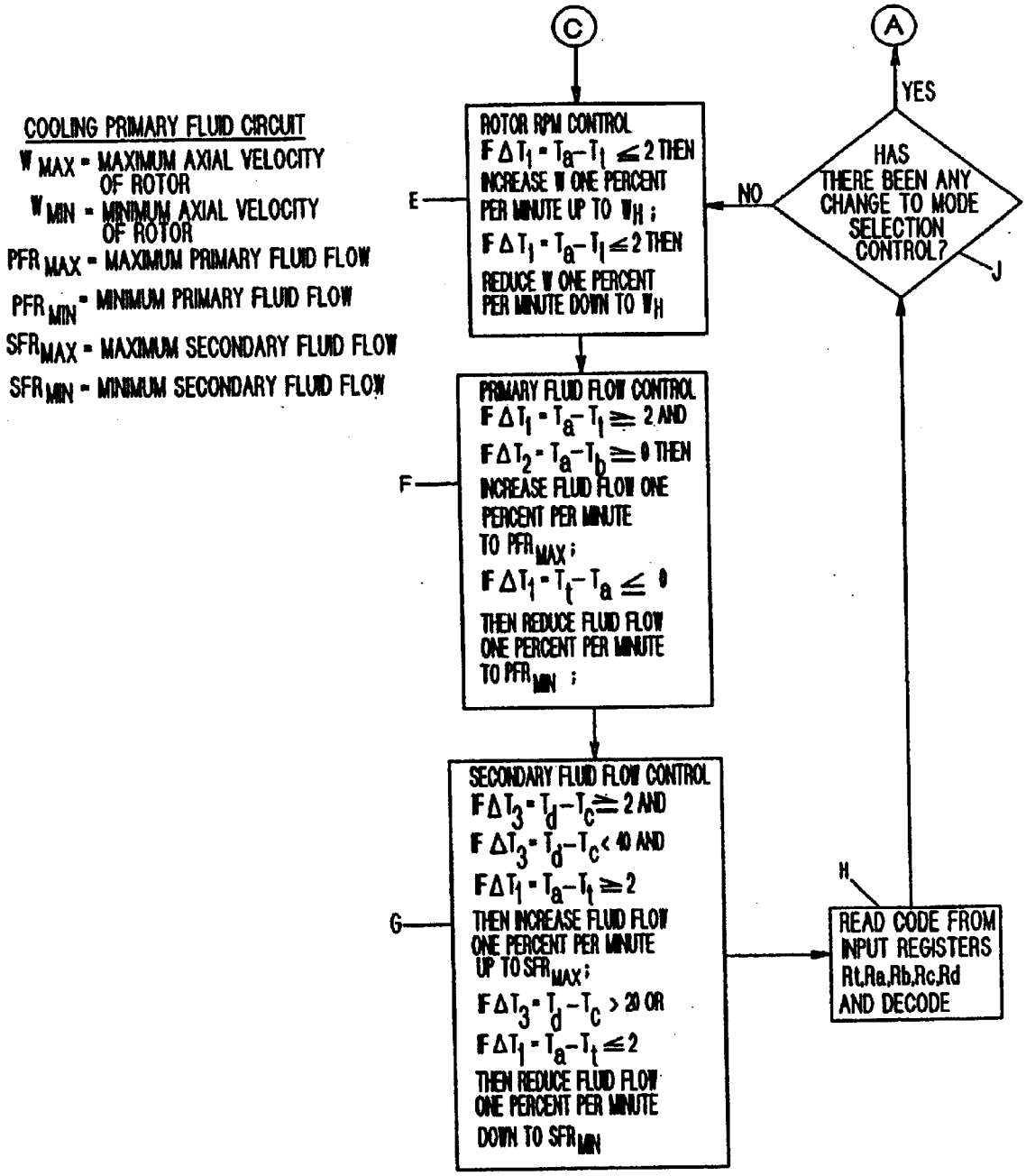

In FIG. 10B, the heat transfer engine hereof is shown installed in the same environment 50 shown in FIG. 10B, while the engine is operated in its heating mode. In FIG. 10B, the closed fluid flow circuit of rotor is arranged once again according to the first rotor conFiguration. To specify the direction of rotor shaft rotation in this mode of operation, it is helpful to embed a Cartesian Coordinate system in the stator, so that the +z axis and point of origin thereof are aligned with the +z axis and point of origin of the rotor. In the first rotor conFiguration, the direction of the rotor rotation is clockwise about the +z axis of the stator reference system when the engine is operated in its heating mode.

Figure 18:
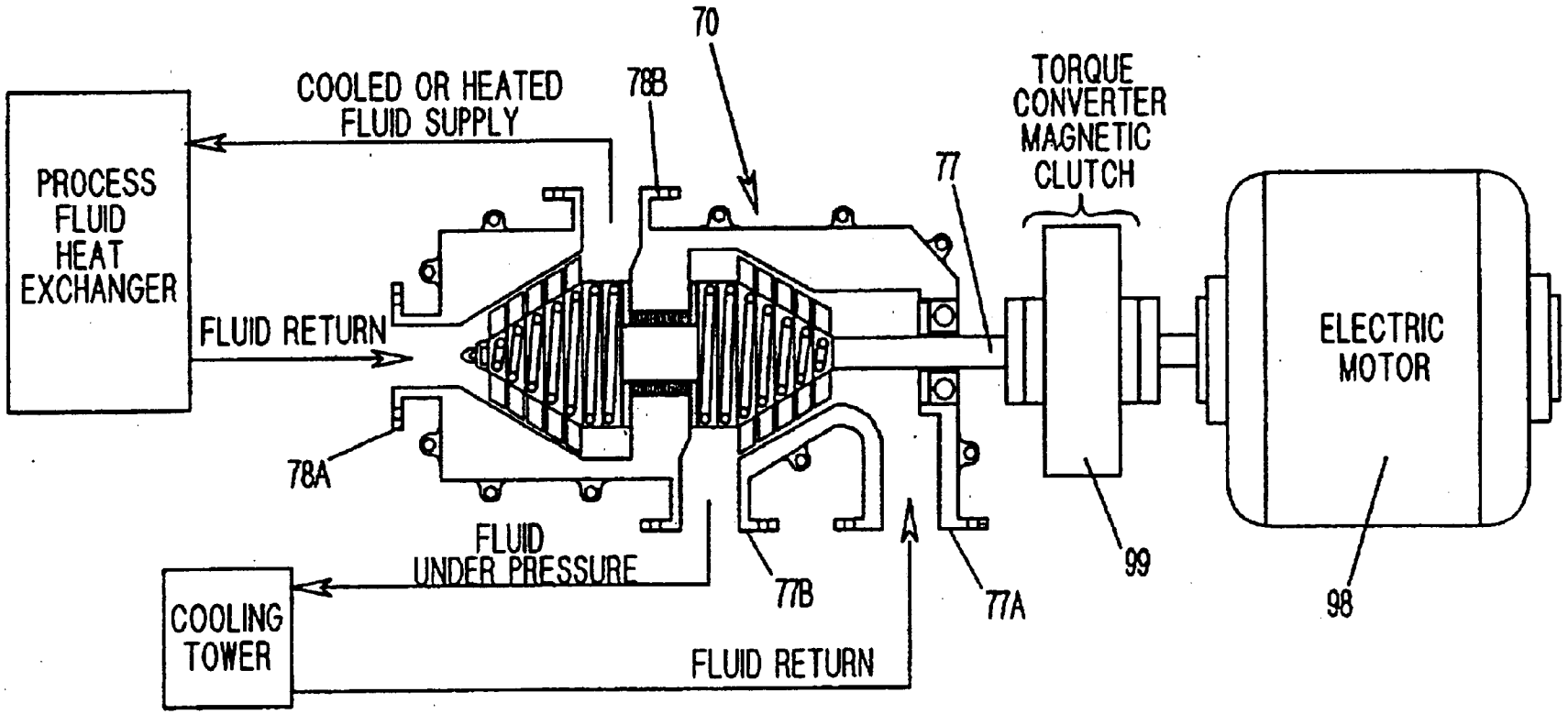
FIG. 18 is a schematic diagram of a heat transfer system, in which a turbine-based heat transfer engine of the present invention is arranged so that the rotor structure thereof is rotated by an electric motor in direct connection with the rotor, while water from a cooling tower is circulated through the primary heat exchanging circuit.
Figure 19:
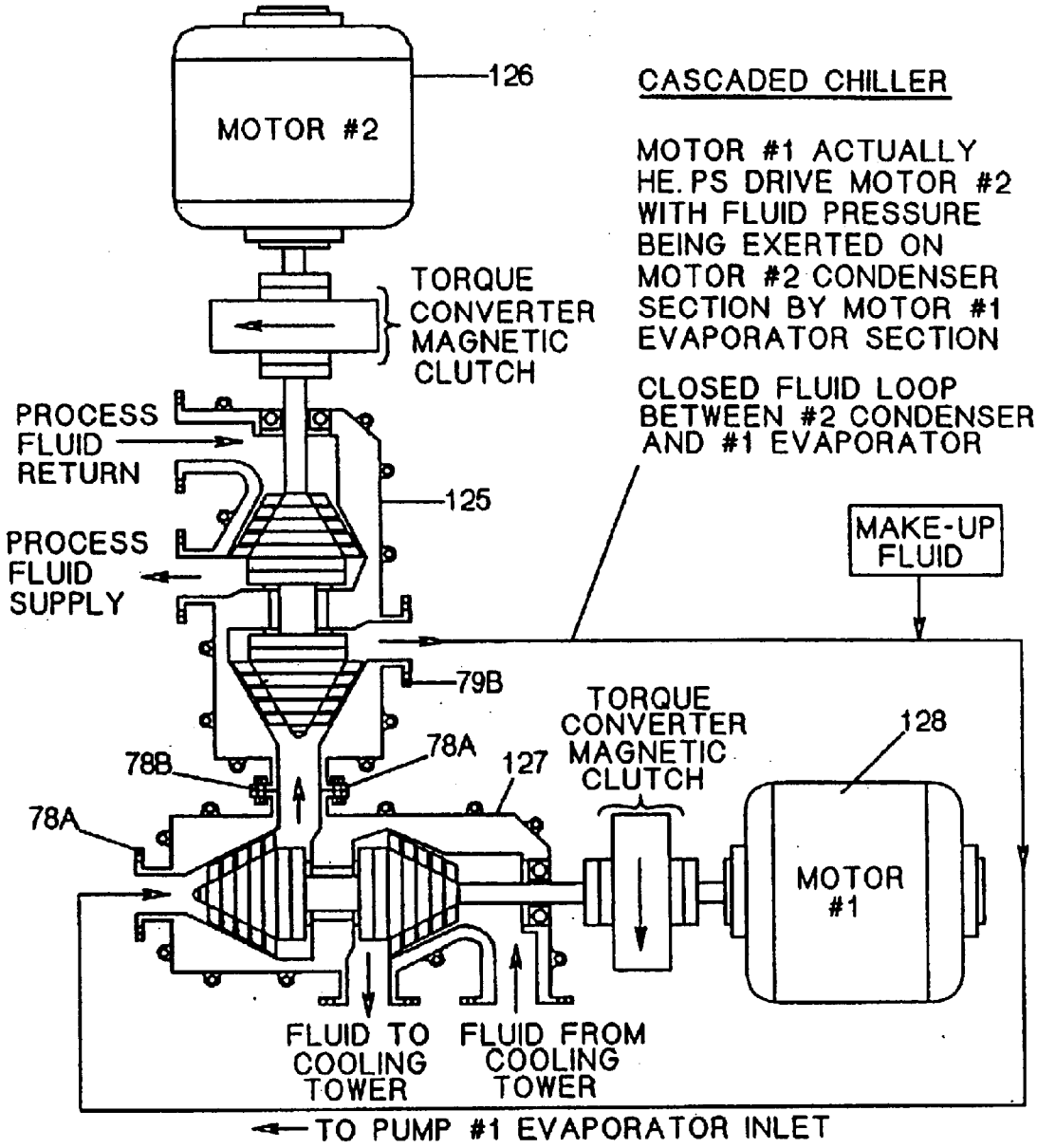
FIG. 19 is a schematic diagram of a heat transfer system, in which the primary heat exchanging chamber of a first turbine-based centrifugal heat transfer engine hereof is connected to the secondary heat exchanging chamber of a second turbine-like heat transfer engine hereof, whereas the primary heat transfer chamber of the secondary turbine-like heat transfer engine is in fluid communication with a cooling tower while the secondary heat exchanging chamber of the second turbine-like heat transfer engine is in fluid communication with fluid supply circuit.

In FIGS. 18 and 19, an alternative embodiment of the heat exchanging rotor is schematically illustrated. As shown, the rotor 52 is realized as a solid body having first and second end portions 2A and 2B of truncated cone-like geometry, connected by a central cylindrical portion 2C extending about an axis of rotation. As illustrated, a closed fluid flow circuit 26 having essentially the same geometry as rotor 5 of the first illustrative embodiment is embodied (or embedded) within the solid rotor body. As such, this embodiment shall be referred to as the embedded rotor embodiment of the present invention. As in the first illustrative embodiment, the closed fluid circuit of rotor 52 symmetrically extends about its rotor axis of rotation. Also bi-directional metering device 38 is realized within the central portion of the rotor body, as shown. Preferably, one end of the rotor has an access port 95 and 96, (e.g. a removable screw cap) for introducing refrigerant into or removing refrigerant from the closed fluid flow circuit. The fluid flow circuit may be realized in the solid body of the rotor in a variety of ways. One way is to produce a solid rotor body in two symmetrical half sections using injection molding techniques, so that respective portions of the closed fluid flow circuit are integrally formed therein. Thereafter, the molded body halves can be joined together using appropriate gaskets, seals and fastening techniques. Advanced composite materials, including ceramics, may be used to construct the rotor body. Alternatively, as shown in FIGS. 15A to 15K, the rotor may be realized by assembling a plurality of rotor discs, each embodying a portion of the closed fluid flow circuit. Details regarding this alternative embodiment will be described in greater detail hereinafter.

In order to properly construct the rotor, the direction of rotation of the spiral tubing along the closed fluid flow circuit is essential. To specify this tubing direction, it is helpful to specify the portion of the fluid flow circuit along the rotor shaft (i.e. the rotor axis) as the inner fluid flow path, and the portion of the fluid flow circuit extending outside of the rotor shaft as the outer fluid flow path. Notably, the outer fluid flow path is bisected by the bi-directional metering device into a first outer fluid flow path portion and a second outer fluid flow path portion. The end section of these outer fluid flow path portions away from the metering device connect with the end sections of the inner fluid flow path, to complete the closed fluid flow path within the heat exchanging rotor. In order to specify the direction of spiral of the above-defined fluid flow path portions, it is helpful to embed a Cartesian Coordinate system within the rotor such that the point of origin of the reference system is located at one end of the rotor shaft and the +z axis of the reference system extends along the axis of rotation (i.e shaft) of the rotor towards the other end of the shaft. With the reference system installed, there are two possible ways of configuring the closed fluid flow circuit of the rotor of the present invention.

According to the first possible conFiguration, looking from the point of origin of the reference system down the +z axis, the first outer fluid flow portion extends spirally about the +z axis in counter-clockwise (CCW) direction from the first end portion of the shaft to the metering device, and then continues to extend spirally about the +z axis in a counter-clockwise (CCW) from the metering device to the second end portion of the rotor shaft; and looking from the point of origin of the reference system down the +z axis, the inner fluid flow path extends spirally about the +z axis in a clockwise (CW) direction.

According to the second possible conFiguration, as shown in FIGS. 14A, 14B, 18, and 19, looking from the point of origin of the reference system down the +z axis, the first outer fluid flow portion extends spirally about the +z axis in a counter-clockwise (CCW) direction from the first end portion 26 of the shaft to the inlet of the fluid flow tube 84 as shown in FIG. 17A, and then continues to extend spirally about the +z axis in counter-clockwise (CCW) from the fluid flow tube device to the second end portion of the rotor shaft; looking from the point of origin of the reference system down the +z axis, the inner fluid flow path extends spirally about the +z axis in a counter-clockwise direction (CCW). Either of these two conFigurations will work in a functionally equivalent manner. However, as will be described in greater detail below, depending on the rotor conFiguration employed in any particular application, the direction of shaft rotation will be different for each heat transfer mode (e.g. cooling mode or heating mode) selected by the system user.

Principles of Throttling Device Design

It will be helpful to now describe some practical principles which can be used to design and construct the throttling (i.e. metering) device within the rotor structure hereof.

In general, the function of the throttling device of the present invention is to assist in the transformation of liquid refrigerant into vapor refrigerant without impacting the function of the rotor within the heat transfer engine hereof. In general, this system component (i.e. the metering device) is realized by providing a fluid flow passageway between the condensor functioning portion of the rotor and the evaporator functioning portion. This fluid flow passageway has an inner cross-sectional area that is smaller than the smallest inner cross-sectional area of the evaporator section of the rotor. In principle, there are many different ways to realize the reduced cross-sectional area in the fluid flow passageway between the primary and secondary heat exchanging sections of the rotor. Regardless of how this system component is realized, a properly designed metering device will operate in a bi-directional manner (i.e., in the cooling or heating mode of operation). The function of the metering device is to provide the necessary pressure drop between the condensor and evaporator functioning portions of the heat transfer engine hereof, and allow sufficient Superheat to be generated across the evaporator functioning portion of the rotor. In the case of the illustrative embodiments, the metering device should be designed to provide optimum fluid flow characteristics between the primary and secondary heat transfer portions of the rotor.

For example, in the first illustrative embodiment where the primary and secondary heat exchanging portions are made from hollow tubing of substantially equal diameter, the metering device can be easily realized by welding (or brazing) a section of hollow tubing between the primary and secondary heat exchanging portions, having an inner diameter smaller than the inner diameter of the primary and secondary heat exchanging portions. In order to provide optimum fluid flow characteristics across the metering device, the ends of the small reduced diameter tubing section can be flared so that the inner diameter of this small tubing section is matched to the inner diameter of the tubing from which the primary and secondary heat exchanging portions are made. In an alternative embodiment, it is conceivable that tubing of the primary and secondary heat exchanging portions can be continuously connected by welding or brazing process and that the metering device can be realized by crimping or stretching the tubing adjacent to the connection, to achieve the necessary reduction in fluid flow passageway.

In the second illustrative embodiment disclosed herein, the closed fluid passageway is realized within a solid-body rotor structure suitable for turbine type application where various types of fluid are used to input torque to the rotor during engine operation. In this particular embodiment, the metering device can be easily realized by welding (or brazing) a section of hollow tubing between the primary and secondary heat exchanging portions, having an inner diameter smaller than the inner diameter of the primary and secondary heat exchanging portions, as shown in FIG. 18.

In yet another alternative embodiment, a plurality of metering devices of the type described above can be used in parallel in order to achieve the necessary reduction in fluid flow passageway, and thus a sufficient pressure drop thereacross the primary and secondary heat exchanging portions of the rotor. In such an alternative embodiment, it is understood that the condenser functioning portion of the rotor would terminate in a first manifold-like structure, to which the individual metering devices would be attached at one end. Similarly, the evaporator portion of the rotor would terminate in a second manifold-like structure, to which the individual metering devices would be attached at their other end.

In any particular embodiment of the rotor of the present invention, it will be necessary to design and construct the metering device so that system performance parameters are satisfied. In the preferred embodiment, a reiterative design procedure is used to design and construct the metering device so that system performance specifications are satisfied by the operative engine construction. This design and construction procedure will be described below.

The first step of the design method involves determining the system design parameters which include, for example: the Thermal Transfer Capacity of the system measured in BTUs/hour; Thermal Load on the system measured in BTUs/hour; the physical dimensions of the rotor; and volume and type of refrigerant contained within the rotor (less than 80% of internal volume). The second step involves specifying the design parameters for the metering device which, as described above, include primarily the smallest cross-sectional area of the fluid passageway between the first and second heat exchanging portion of the rotor. According to the method of the present invention, it is not necessary to calculate the metering device design parameters using a thermodynamic or other type of mathematical model. Rather, according to the method of the present invention, an initial value for the metering device design parameters (i.e. the smallest cross-sectional area of the fluid passageway) is selected and used to construct a metering device for installation within the rotor structure of the system under design.

The next step of the design method involves attaching infra-red temperature sensors to the inlet and outlet ports of the evaporator-functioning portion of the rotor, and then connecting these temperature sensors to an electronic (i.e. computer-based) recording instrument well known in the temperature instrumentation art. Then, after (i) constructing the heat transfer engine according to the specified system design parameters, (ii) loading refrigerant into the rotor structure, and (iii) setting the primary design parameter (i.e., smallest cross-sectional area) in the metering device, the heat transfer engine is operated under the specified thermal loading conditions for which it was designed. When steady-state operation is attained, temperature measurements at the inlet and outlet ports of the rotor evaporator, $T_{ei}$ and $T_{eo}$, respectively, are taken and recorded using the above-described instrument. These measurements are then used to determine whether or not the metering device produces enough of a pressure drop between the condensor and evaporator so that sufficient Superheat is produced across the evaporator to drive the engine to the desired level of performance specified by the system design/performance parameters described above.

This condition is detected using the following design criteria. If $T_{eo}$ is not greater than $T_{ei}$ by 6 degrees, then there is not enough Superheat being generated at the evaporator, or the angular velocity of the rotor is too low. If this condition exists, then the rotor angular velocity is increased to Wmax and recheck $T_{ei}$ and $T_{ei}$. Then if $T_{eo}$ is not greater than $T_{ei}$ by 6 degrees, then the smallest cross-sectional area (e.g. diameter) through the metering device is too large and a reduction therein is needed. If this condition is detected, then the engine is stopped. The metering device is modified by reducing the cross-sectional area of the metering device by an incremental amount. The modified engine is then restarted and $T_{ei}$ and $T_{eo}$ remeasured to determine whether the amount of the Superheat produced across the evaporator is adequate. Thereafter, the reiterative design process of the present invention is repeated in the manner described above until the desired amount of Superheat is produced within the rotor of the production prototype under design. When this condition is achieved, the design parameters of the metering device are carefully measured and recorded, and the metering device at which this operating condition is achieved is used to design and construct "production models" of the heat transfer engine. Notably, only the design model of the heat transfer engine requires infra-red temperature sensors for Superheat monitoring purposes.

System Control Process of the Present Invention

Referring now to FIGS. 8A, 8B, and 10A to 10C, the temperature-response control process of the present invention will be described for both the cooling and heating modes of the centrifugal heat transfer engine.

Figure 8A:
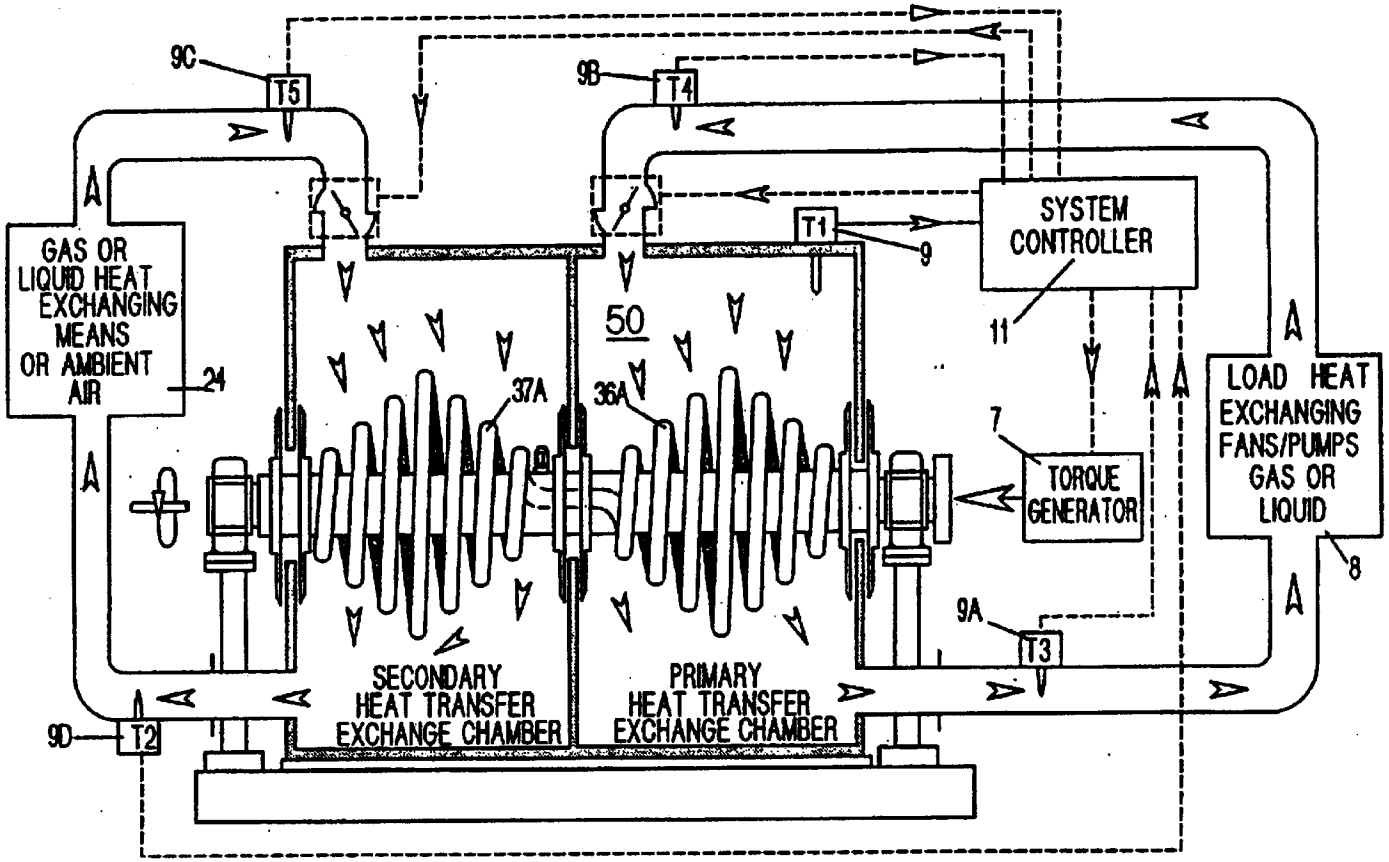
FIG. 8A is a schematic representation of the heat transfer engine of the first illustrative embodiment of the present invention installed within a heat transfer system, wherein the primary and secondary heat exchanging chambers of the stator are operably connected to the primary and secondary heat exchanging circuits of the system, respectively, so that the primary and secondary heat transferring portions of the rotor structure are in thermal communication with the same while the heat transfer engine is operated in its cooling mode.

When the rotor of the first conFiguration is rotatably supported within the stator housing and rotated in the counter-clockwise direction as shown in FIG. 8A, a complex distribution of centrifugal forces are automatically generated and act upon the molecules of refrigerant contained within the closed circuit. This causes the refrigerant to automatically circulate within the closed circuit in a cyclical manner from the first end portion of the rotor, to the second end portion thereof, and then back to the first end portion along the spiral fluid flow path of the support shaft. In this case, the engine is operated in its cooling mode, and the spiral tubing section 36A of the rotor within the primary heat exchanging chamber functions as an evaporator while the spiral tubing section 37A within the secondary heat exchanging chamber functions as a condenser. The overall function of the rotor in the cooling mode is to transfer heat from the primary heat exchanging chamber to the secondary heat exchanging chamber under the control of the system controller.

Figure 8B:
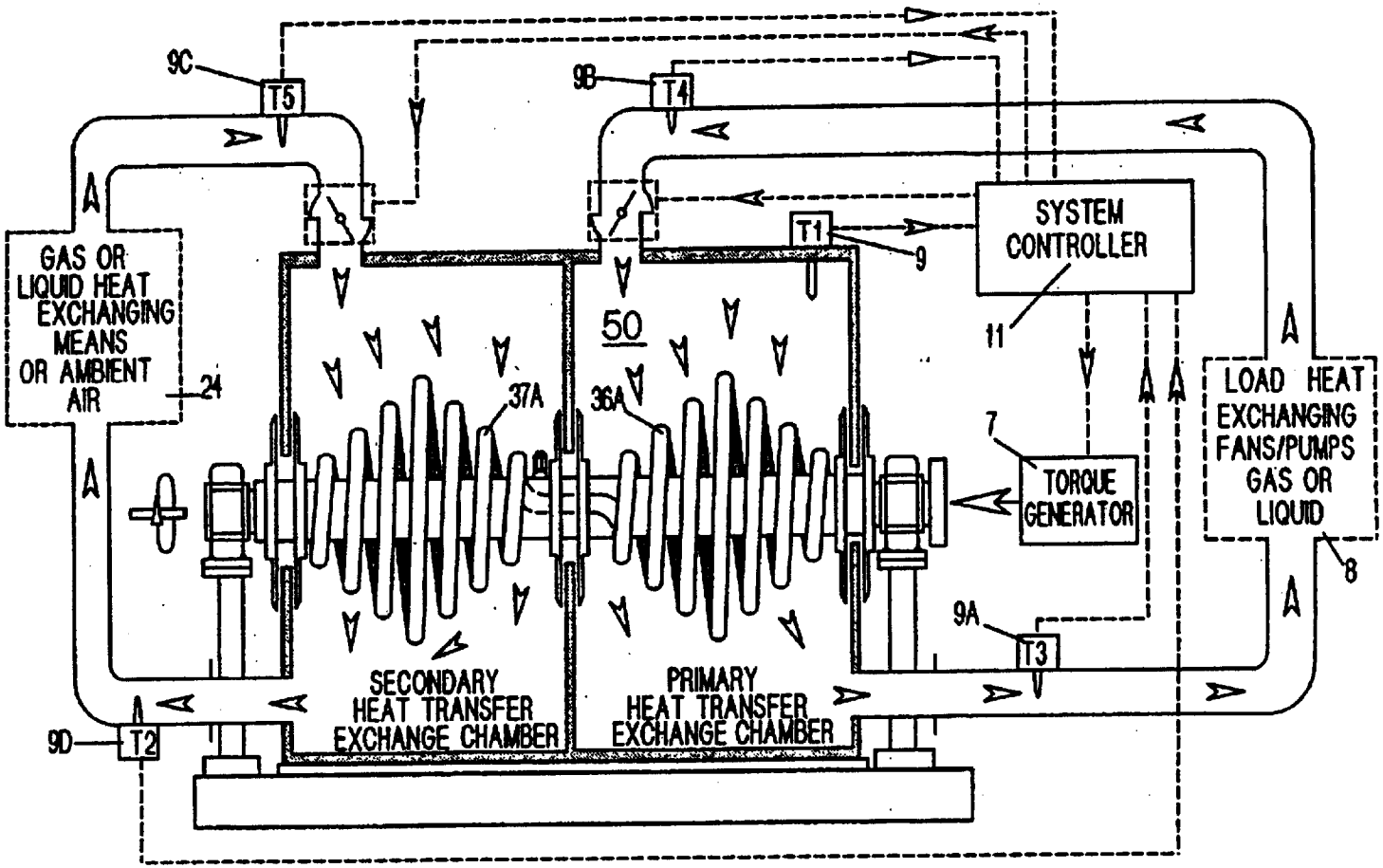
FIG. 8B is a schematic representation of the heat transfer engine of the first illustrative embodiment of the present invention installed within a heat transfer system, wherein the primary and secondary heat exchanging chambers of the stator are operably connected to the primary and secondary heat exchanging circuits of the system, respectively, so that the primary and secondary heat transferring portions of the rotor structure are in thermal communication with the same while the heat transfer engine is operated in its heating mode.

When the direction of the rotor is reversed as shown in FIG. 8B, the refrigerant contained within the closed fluid circuit automatically circulates therewithin in a cyclical manner from the second end portion of the rotor, to the first end portion thereof, and then back to the second end portion along the spiral fluid flow path of the support shaft. In this case, the engine is operated in its heating mode, and the spiral tubing section of the rotor within the primary heat exchanging chamber 36A functions as a condenser, while the spiral tubing section 37A within the secondary heat exchanging chamber functions as an evaporator. The overall function of the rotor in the heating mode is to transfer heat from the secondary heat exchanging chamber to the primary heat exchanging chamber under the control of the system controller.

In either of the above-described modes of operation, the fluid velocity of the refrigerant within the rotor is functionally dependent upon a number of factors including, but not limited to, the angular velocity of the rotor relative to the stator, the thermal loading upon the first and second end portions of the rotor, and internal losses due to surface friction of the refrigerant within the closed fluid circuits. It should also be emphasized that design factors such as the number of spiral coils, the heat transfer quality of materials used in their construction, the diameter of the spiral coils, the primary heat transfer surface area, the secondary heat transfer surface area, and the rotor angular velocity, and horsepower can be varied to alter the heat transfer capacity and efficiency of the centrifugal heat transfer engine.

In order to cool the ambient environment (or fluid) to the selected temperature set by thermostat 9, the heat exchanging rotor must transfer, at a sufficient flow rate, heat from the primary heat exchanging chamber to the secondary heat exchanging chamber, from which it can then be liberated to the secondary heat exchanging circuit and thus maintain the selected temperature in a controlled manner. Similarly, to heat the ambient environment (or fluid) to the selected temperature set by the thermostat, the heat exchanging rotor must transfer, at a sufficient flow rate, heat from the secondary heat exchanging chamber to the primary heat exchanging chamber, from which it can then be liberated to the primary heat exchanging circuit and maintain the selected temperature in a controlled manner.

As shown in FIGS. 8A and 8B, each of the ports in the primary or secondary heat exchanging chambers of the heat transfer engine has installed within its flowpath a temperature sensor 9A through 9D operably connected to the temperature-responsive system controller 11. The function of each of these port-located temperature sensors is to measure the temperature of the liquid flowing through its associated fluid inlet or outlet port as it passes over and/or through the end portions of the rotor. Within the environment or fluid being heated, cooled or otherwise conditioned, thermostat 9 or a like control device provides a means for setting a threshold or target temperature that is to be maintained within the primary heat exchanging chamber as the primary and secondary heat exchanging fluids are caused to circulate within the primary and secondary heat exchanging chambers, respectively.

The primary function of the system controller is to manage the load-reduction operating characteristics of the heat transfer engine. In the illustrative embodiments, this is achieved by controlling (1) the angular velocity of the rotor within prespecified limits during system operation, and (2) the flow rate of the primary and secondary heat exchange fluids circulating through the primary and secondary heat exchange chambers of the engine, respectively. As will be described below in connection with the control process of FIGS. 10A to 10C, rotor-velocity and fluid flow-rate control is achieved by maintaining particular port-temperature constraints (i.e. conditions) on a real-time basis during the operation of the system in its designated mode of operation. In the illustrative embodiment of the present invention, these temperature constraints are expressed as difference equations which establish constraints (i.e. relations) among particular sensed temperature parameters.

Figure 9:
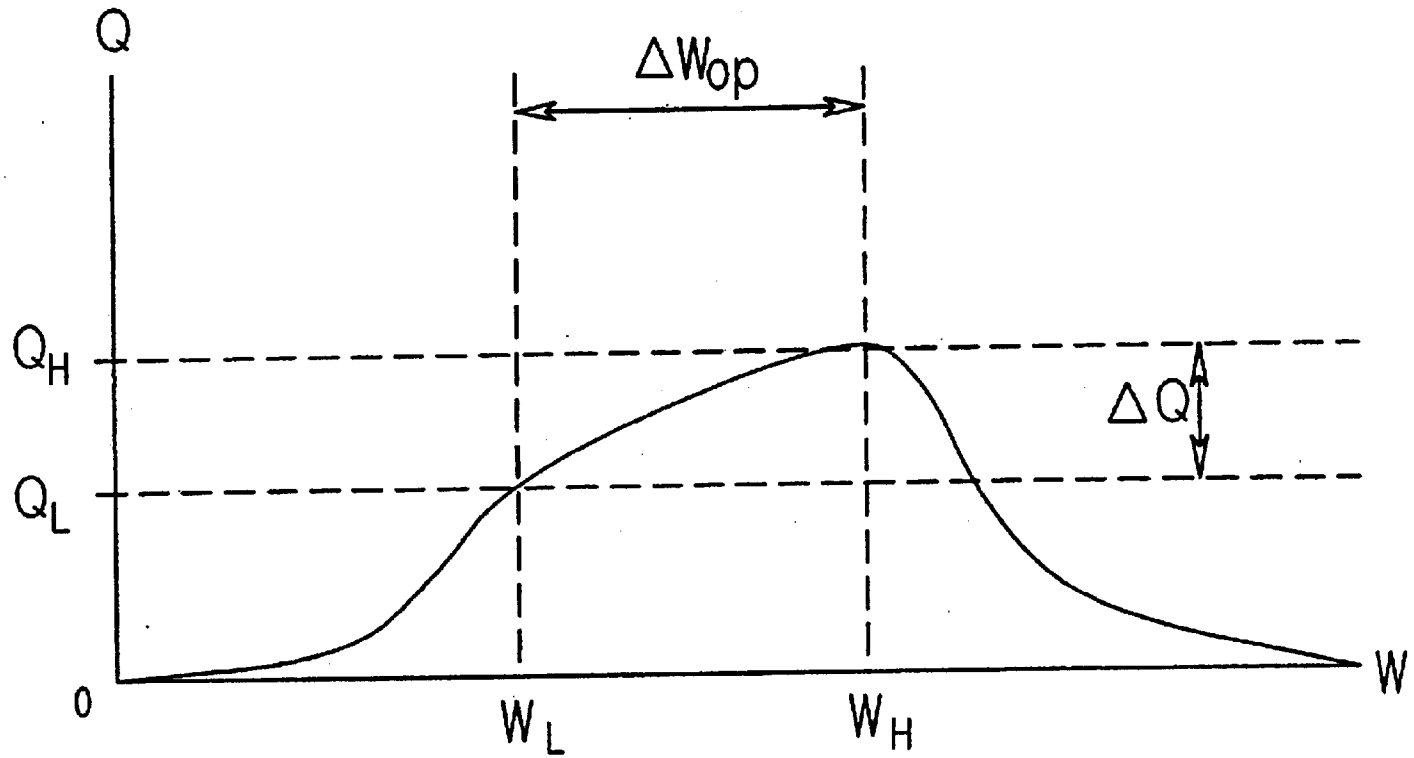
FIG. 9 is a graphical representation of the closed-loop operating characteristic of the heat transfer engine of the present invention (i.e. with the primary and secondary heat exchanging portions of the rotor in thermal communication with primary and secondary heat exchanging circuits of a heat transfer system), showing the ideal rate of heat exchange from the primary portion of the rotor to the secondary portion thereof, as a function of angular velocity of the rotor about its axis of rotation.

As illustrated, on the chart shown in FIG. 9; as the rotor RPM $\omega_L$ increases upward from zero to a point of intersection between $\omega_L$ and $Q_L$, the following conditions exist: (1) Load control begins; (2) the spiraled return passageway is clear of liquid refrigerant; (3) about two thirds of the primary heat transfer portion is occupied by liquid refrigerant; (4) the secondary heat transfer portion is about 85 percent of fully occupied by liquid refrigerant; (5) all flow control devices are within 10 percent of maximum flow. The system controller 11, gradually, continues to increase the RPM ω up to $\omega_H$. Control over the quantity of heat transferred Q is maintained between $Q_L$ (low load) and $Q_H$ (high load). The temperature control differential is ΔQ, ($\Delta Q=Q_H-Q_L$), and the range of temperature control selected on the temperature selector 9 is limited by the design capacity of the particular heat transfer engine at hand. As shown in FIG. 9, if the RPM ω exceeds $\omega_H$, the refrigeration effect begins to decrease for one of two reasons: (1) the load has diminished to a point where no heat is available to be transferred in functional quantities; and (2) the weight of the liquid refrigerant in the liquid pressurization length by centrifugal forces exceeds pressurizing forces exerted on the refrigerant by the liquid pressurization lengths spiraled structure. Optimum operating conditions for the heat transfer engine are between $\omega_L$ and $\omega_H$, and $Q_L$ and $Q_H$. The intersections indicated are dictated by thermal capacity, refrigerant type and volume, and application, and are located by operational calibration.

Figure 10C:
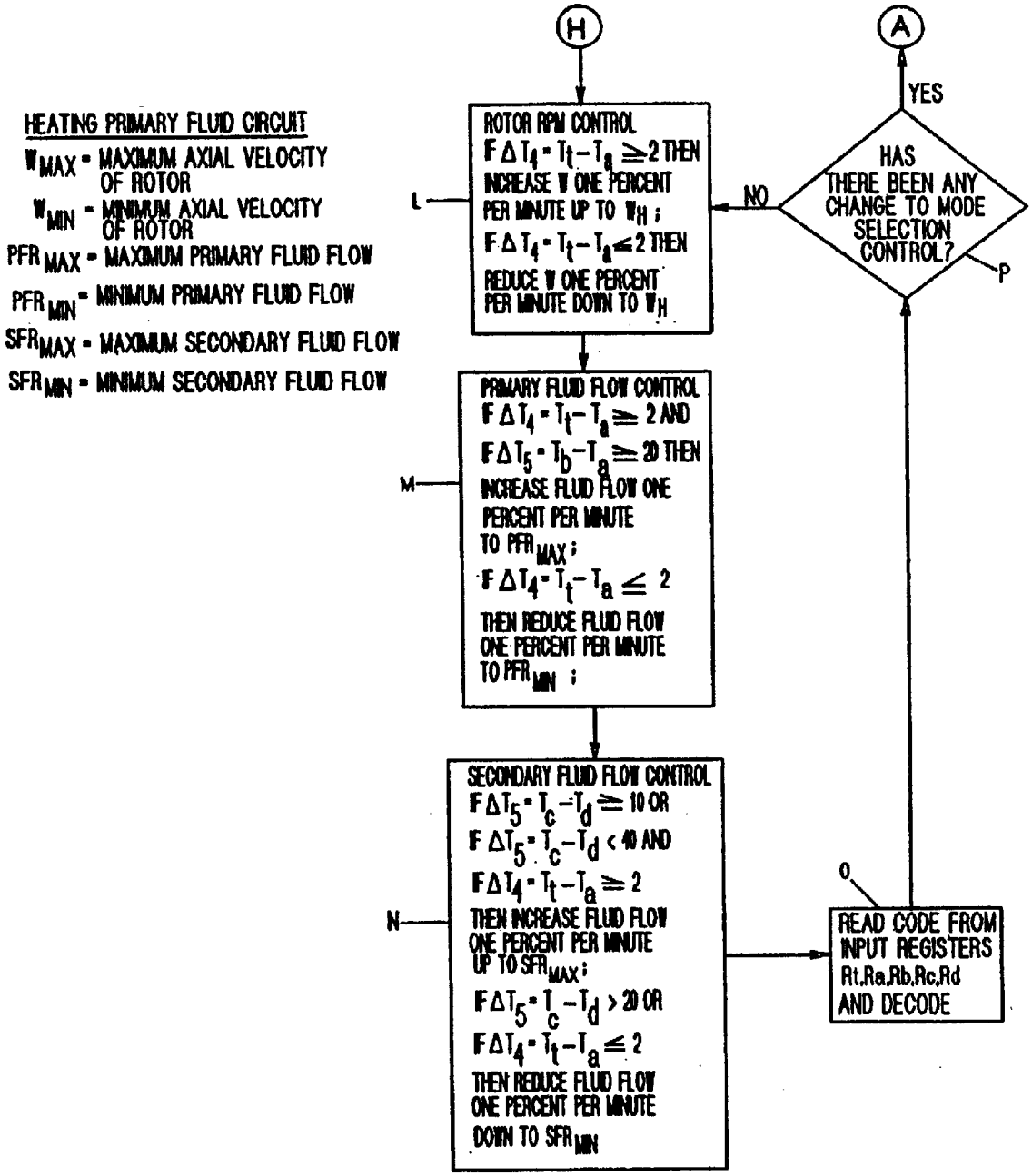

As illustrated in FIGS. 10A to 10C, these temperature constraints of the system control process are maintained by the system controller during cooling or heating modes, respectively. These temperature constraints depend on the ambient reference temperature T1 set by thermostat 9, and the temperatures sensed at each port of the first and secondary heat exchanging circuits of the system. The process by which the system controller controls the rotor velocity and fluid flow rates in the primary and secondary heat exchanging chambers will be described in detail below.

In FIGS. 10A to 10C, the system control program of the illustrative embodiment is shown in the form of a computer flow diagram. During the operation of the heat transfer engine, the system controller executes the control program in a cyclical manner in order to automatically control the rotor velocity and fluid flow rates within prespecified operating conditions, while achieving the desired degree of temperature control along the primary heat exchanging circuit. During execution of the control process, the plurality of data storage registers associated with the system controller 11 are periodically read by its microprocessor. Each of these data storage registers is periodically (e.g. 10 times per second) provided with a new digital word produced from its respective A/D converter associated with the temperature sensor (9A, 9B, 9C, 9D) measuring the sensed temperature value. Thus during the execution of the control program, the data storage registers associated with the system controller are updated with current temperature values measured at the input and output ports of the primary and secondary heat exchanging chambers of the system.

As indicated at Block A in FIG. 10A, the first step of the control process involves initializing all of the temperature data registers of the system. Then at Block B the microprocessor reads the code (i.e. data) from the temperature data registers and then at Block C the Mode Selection Control determines whether the cooling or heating mode has been selected by the user. If the cooling mode has been selected at Block C, then the system controller enters Block D and controls the torque generator (e.g. motor) so that the rotor is rotated in the CCW direction up to about 10% of the maximum design velocity $\omega_H$, while the primary and secondary fluid flow rate controllers are controlled to allow fluid flow rates up to about 10 percent (10%) of the maximum flow rate. At Block E, the angular velocity of the rotor is controlled by the microprocessor performing the following rotor-velocity control operations represented by the following rules: if $\Delta T_1=T_a-T_t\geqq 2°$ F., then increase rotor velocity ω at rate of one percent per minute up to $\omega_H$; and if $\Delta T_1=T_a-T_t\leqq 2°$ F., then reduce the rotor-velocity ω at a rate of one percent per minute down to $\omega_L$.

At Block F, the primary fluid flow rate is controlled by the microprocessor by performing the following primary fluid-flow rate control operations: if $\Delta T_1=T_a-T_t\geqq 2°$ F. and $\Delta T_1=T_a-T_t\geqq 10°$ F., then increase the fluid flow rate of the primary heat exchanging fluid by one percent per minute up to PFRmax; and if $\Delta T_1=T_a-T_t\leqq 0°$ F., then reduce the fluid flow rate of the primary heat exchanging fluid by one percent per minute down to PFRmin.

Notably, an increase in the rate of primary heat exchanging fluid through the primary heat exchanging chamber affects the refrigeration cycle by increasing the rate and amount of heat flowing from the primary heat transfer portion of the rotor to the secondary heat transfer portion thereof, as illustrated by the heat transfer loop in FIG. 8A. As the temperature of the primary heat transfer portion of the rotor increases due to an increase in the heat exchange fluid flow (PFR), more refrigerant is evaporated (i.e. boiled off) and more of the primary heat transfer portion is occupied by vapor. Consequently, more of the secondary heat transfer portion of the rotor is occupied by liquid refrigerant and the increased liquid pressurization length causes the Bubble Point within the closed fluid flow circuit to move further downstream along the throttling device length (closer to the evaporator functioning section).

At Block G, the secondary fluid flow rate is controlled by the microprocessor by performing the following secondary fluid-flow rate control operations: if $\Delta T_3=T_d-T_c\geqq 2°$ F. or, $\Delta T_3=T_d-T_c\geqq 40°$ F. and $\Delta T_1=T_a-T_t\geqq 2°$ F., then increase the fluid flow rate of the secondary heat exchanging fluid by one percent per minute up to SFRmax; and if $\Delta T_3=T_d-T_c\geqq 20°$ F. or $\Delta T_1=T_c-T_t\leqq 2°$ F., then reduce the fluid flow rate of the primary heat exchanging fluid by one percent per minute down to SFRmin.

After performing the operations at Blocks E, F and G, the microprocessor reads once again the temperature values in its temperature value storage registers, and then at Block J determines whether there has been any change in mode (e.g. switch from the cooling mode to the heating mode). If no change in mode has been detected at Block J, then the microprocessor reenters the control loop defined by Blocks E through H and performs the operations specified therein to control the angular velocity of the rotor ω and the flow rates of the primary and secondary fluid flow-rate controllers, PFR and SFR If at Block J in FIG. 10B the microprocessor determines whether the mode of the heat transfer engine has been changed (e.g. from the cooling mode to the heating mode) then the microprocessor returns to Block C in FIG. 10A and then proceeds to Block K. At Block K the microprocessor controls the torque generator (e.g. motor) so that the rotor is rotated in the CW direction up to about 10% of the maximum design velocity $\omega_H$, while the primary and secondary fluid flow rate controllers are controlled to allow fluid flow rates up to about 10 percent (10%) of the maximum flow rate. At Block L, the angular velocity of the rotor is controlled by the microprocessor performing the following rotor-velocity control operations: if $\Delta T_4=T_t-T_a\geqq 2°$ F., then increase rotor velocity ω at a rate of one percent per minute up to $\omega_H$; and if $\Delta T_4=T_a-T_t\geqq 20°$ F., then reduce the rotor-velocity ω at a rate of one percent per minute down to $\omega_t$.

At Block M, the primary fluid flow rate is controlled by the microprocessor by performing the following primary fluid-flow rate control operations: if $\Delta T_4=T_t-T_a \geqq 2°$ F. and $\Delta T_5=T_b-T_a \geqq 22°$ F., then increase the fluid flow rate of the primary heat exchanging fluid by one percent per minute up to PFRmax; and if $\Delta T_4=T_t-T_a \leqq 2°$ F., then reduce the fluid flow rate of the primary heat exchanging fluid by one percent per minute down to SFRmax.

Notably, an increase in the rate of secondary heat exchanging fluid through the secondary heat exchanging chamber affects the refrigeration cycle by increasing the rate and amount of heat flowing from the secondary heat transfer portion of the rotor to the primary heat transfer portion thereof, as illustrated by the heat transfer loop in FIG. 8B. As the temperature of the secondary heat transfer portion of the rotor increases because of a heat exchange fluid flow increase (SFR), more refrigerant is evaporated (i.e. boiled off) and more of the secondary heat transfer portion of the rotor is occupied by vapor. Consequently, more of the primary heat transfer portion of the rotor is occupied by liquid refrigerant and the increased Liquid Pressurization Length causes the Bubble Point to move further upstream along the throttling device length of the (closer to the secondary heat transfer portion of the rotor).

At Block N, the secondary fluid flow rate is controlled by the microprocessor by performing the following secondary fluid-flow rate control operations: if $\Delta T_5=T_c-T_d \geqq 10°$ F. or $\Delta T_5=T_c-T_d \leqq 40°$ F., and $\Delta T_4=T_t-T_c \geqq 2°$ F., then increase the fluid flow rate of the secondary heat exchanging fluid by one percent per minute up to SFRmax; and if $\Delta T_5=T_c-T_d \geqq 20°$ F., then reduce the fluid flow rate of the primary heat exchanging fluid by one percent per minute down to SFRmin.

After performing the operations at Blocks L, M and N, the microprocessor reads once again the temperature values in the temperature value storage register of the system controller, and at Block P determines whether there has been any change in mode (e.g. switch from heating mode to cooling mode). If no change in mode has been detected at Block P, then the microcontroller reenters the control loop defined by Blocks L through N and performs such operations in order to control the angular velocity of the rotor and the flow rates of the primary and secondary fluid flow-rate controllers. If at Block P in FIG. 10C the microprocessor determines that the mode of the heat transfer engine has been changed (e.g. from the heating mode to the cooling mode) then the microprocessor returns to Block C in FIG. 10A and then proceeds to Block D. Notably, the speed at which the microprocessor traverses through this control loops described above will typically be substantially greater than the rate at which the temperature values may change as indicated by the data values in the temperature storage registers. Thus the system controller can easily track the thermodynamics of the heat transfer engine of the present invention.

In the illustrative embodiment, the parameters (Wmax, Wmin, PFRmax, PRFmin, SFRmax, SFRmin) employed in the control process described above may be determined in a variety of ways.

In the illustrative embodiment, the parameters ($W_H$, $W_L$, PFRmax, PFRmin, SFRmax, and SFRmin) employed in the control process described above may be determined in a variety of ways. $W_H$ (rotor RPM) is primarily determined by the strength of materials used to construct the rotor, and, secondly, at an RPM where $Q_H$ is realized. $Q_H$ is found by acquiring the temperature of the fluid entering the primary heat transfer portion and the temperature of the fluid leaving the primary heat transfer portion. The lowest of the two temperature is subtracted from the highest temperature and the sum is the fluid temperature difference. The fluid temperature difference multiplied by the specific heat of the fluid being used equals the BTU per pound that particular fluid has absorbed or dissipated. $W_L$ is determined when the RPM is reduced to a point where no appreciable net refrigeration affect is taking place. PFRmax can be gallons per minute (GPM) for liquids or cubic feet per minute (CFM) for gasses. For example, water entering the primary heat transfer portion at a temperature of 60° F. and leaving the primary heat transfer portion at 50° F. has a temperature difference of 10° F. Water has a specific heat of 1 BTU per pound at temperatures between 32° F. and 212° F. Therefore, water recirculated at 100 gallons per minute, having a temperature difference of 10° F. is transferring 60,000 BTU per hour. Five tons of refrigeration and 60,000 BTUH heating. Air entering the primary heat transfer portion at a temperature of 60° F. and leaving the primary heat transfer at 50° F. has a temperature difference of 10° F. and contains 22 BTU per pound (dry air and associated moisture). Air at 60° F. and 50 percent relative humidity also contains approximately 22 BTU per pound (dry air and associated moisture). The Sensible Heat Ratio ($SHR=Q_s/Q_t$) is arrived at by dividing the quantity of sensible heat in the air ($Q_s$) by the total amount of heat in the air ($Q_t$). The sensible heat ratio of the 60° F. air in the above example is 0.46 and the sensible heat ratio of the 50° F. air is 0.73. The 60° F. air contains mostly latent heat, about 11.88 BTU latent heat and 10.12 BTU sensible heat. The 50° F. air contains most sensible heat, about 5.94 BTU latent heat and 16.06 BTU sensible heat. The net refrigeration affect is the difference between 11.88 BTU and 5.94 BTU, or 5.94 BTU per pound of recirculated air has been transferred from the air into the primary heat transfer portion. In that condition, the air contains 13.01 cubic feet of air per pound. The air contracts slightly during cooling, about 0.19 cubic foot per pound of dry air, and, if 2,000 cubic feet of air are recirculated per minute, the net refrigeration affect will be 544,788.24 BTU per hour, or 4.57 tons of refrigeration. In this example, PFRmax would be 2000 CFM and SFRmax will equal PFRmax because of the lack of heat being introduced into the self-circulating circuit from internal motor windings and the heat of compression caused by reciprocating compressors. The range between PFRmin and PFRmax, and SFRmin and SFRmax is determined by the physical aspects of a particular installation. Physical aspects can range from total environmental load reduction control system to a simple on-off control circuit.

Referring to FIGS. 11A to 11I, the refrigeration process of the present invention will now be described with the heat transfer engine of the present engine being operated in its cooling mode of operation. Notably, each of these drawings schematically depicts, from a cross-sectional perspective, both the first and second heat exchanging portions of the rotor. This presentation of the internal structure of the closed fluid passageway throughout the rotor provides a clear illustration of both the location and the state of the refrigerant along the closed fluid passageway thereof.

Figure 11A:
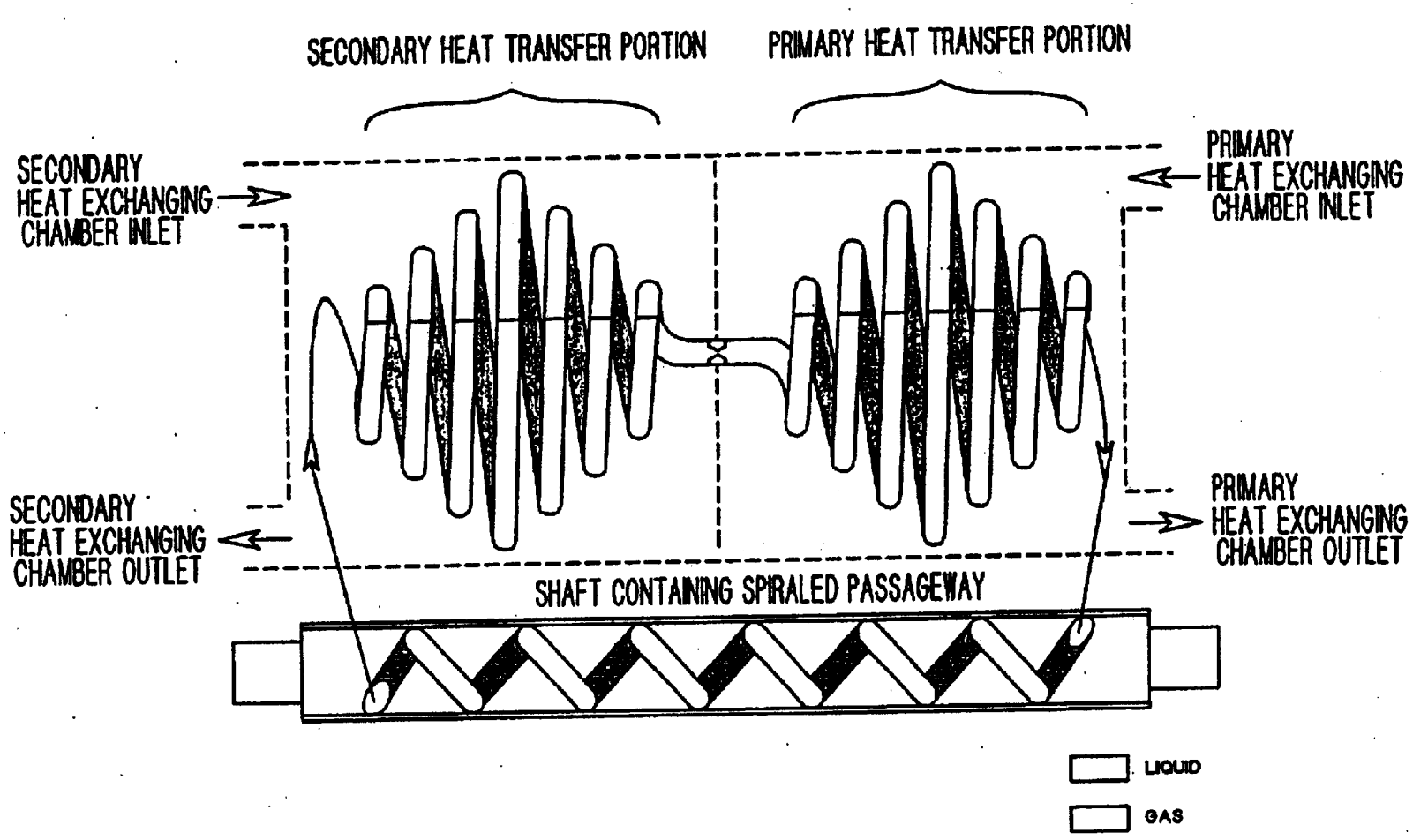
FIG. 11A is a schematic representation of the rotor structure of the heat transfer engine of FIG. 1, showing the physical location of the liquid and gaseous phases of refrigerant within the rotor structure thereof when the heat transfer engine is at rest prior to entering the cooling mode.

As shown in FIG. 11A, the rotor is shown at its rest position, which is indicated by the absence of any rotational arrow about the rotor shaft. At this stage of operation, the internal volume of the closed fluid circuit is occupied by about 65% of refrigerant in its liquid state. Notably, the entire spiral return passageway along the rotor shaft is occupied with liquid refrigerant, while the heat exchanging portions of the rotor are occupied with liquid refrigerant at a level set by gravity in the normal course. The portion of the fluid passageway above the liquid level in the rotor is occupied by refrigerant in a gaseous state. The closed fluid passageway is thoroughly cleaned and dehydrated prior to the addition of the selected refrigerant to prevent any contamination thereof.

Figure 11B:
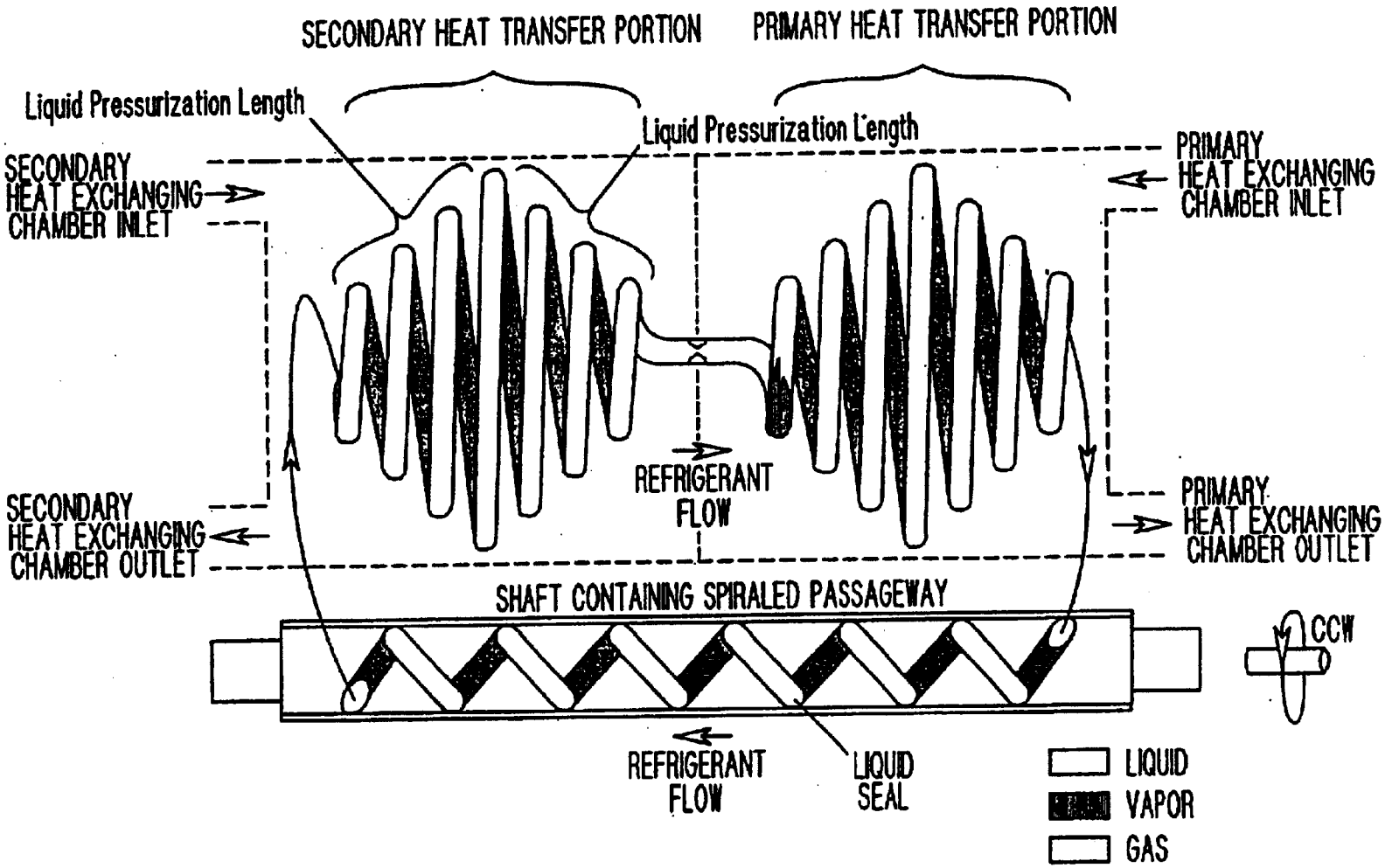
FIG. 11B is a schematic representation of the rotor structure of the heat transfer engine of FIG. 1, showing the physical location of the liquid, gaseous and vapor phases of refrigerant within the rotor structure thereof during the first few revolutions thereof during the first stages of start up operation in its cooling mode.

As shown in FIG. 11B, the rotor is rotated in a counter-clockwise (CCW) direction within the stator housing of the heat transfer engine. During steady state operation in the cooling mode, illustrated in FIGS. 11G to 11I, the primary heat transfer portion will perform a liquid refrigerant evaporating function, while the secondary heat transfer portion performs a refrigerant vapor condensing function. However, at the stage of operation indicated in FIG. 11B, the liquid refrigerant within the spiraled passageway of the shaft begins to flow into the secondary heat transfer (i.e. exchanging) portion of the rotor and occupies the entire volume thereof. As shown, a very small portion (i.e. about one coil turn) of the primary heat transfer portion is occupied by refrigerant vapor as it passes through the throttling (i.e. metering device, while the remainder of the primary heat transfer portion of the rotor and a portion of the spiraled passageway of the shaft once occupied by liquid refrigerant is occupied with gas. Notably, the boundary between the length of liquid refrigerant and length of gas (or refrigerant vapor) in the rotor is, by definition, the "Liquid Seal" and resides along the primary heat transfer portion of the rotor shaft at this early stage of start-up operation. In general, the Liquid Seal is located between the condensation and throttling processes supported within the rotor. The Liquid Seal has two primary functions within the rotor, namely: during start-up operations, to occlude the passage of refrigerant vapor, thereby forcing the vapor to condense in the secondary heat transfer portion (i.e. condenser); and, more precisely, during steady state operation the Liquid Seal resides at a point along the length of the secondary heat transfer portion where enough refrigerant vapor has condensed into a liquid by absorbing "Latent Heat", thereby occupying the total internal face area of the passageway. As used hereinafter, the term "Latent Heat" is defined herein as the heat absorbed by (into) the liquid refrigerant (homogeneous fluid) during the evaporation process, as well as the heat discharged from the gaseous refrigerant during the condensation process.

Liquid refrigerant contained in the first one half of the secondary heat transfer portion between the rotor shaft and the point of highest radius (from the center of rotation) is effectively moved and partially pressurized by centrifugal force, and the physical shape of the spiraled passageway, outwardly from the center of rotation into the second one half of the secondary heat transfer portion. Liquid refrigerant contained in the second one half of the secondary heat transfer portion between the point of highest radius (from the center of rotation) and the throttling device (i.e. metering) is effectively pressurized (against flow restriction caused by the throttling device and Liquid Seal) by the physical shape of the spiraled passageway and centrifugal force. This section of the secondary heat transfer portion of the rotor which varies in response to "Thermal Loading" is defined herein as the "Liquid Pressurization Length". The term "Thermal Load" or "Thermal Loading" as used here shall mean the demand of heat transfer imposed upon the heat transfer engine of the present invention in a particular mode of operation. Liquid refrigerant is pressurized due to (i) the distribution of centrifugal forces acting on the molecules of the liquid refrigerant therein as well as (ii) the pressure created by the liquid refrigerant being forcibly driven into the secondary heat transfer portion against the Liquid Seal and the metering device flow restriction.

As shown in FIG. 11B, during the start up stage of engine operation in a counter-clockwise (CCW) direction, the Liquid Seal moves towards the secondary heat transfer portion, and refrigerant flowing into the primary heat transfer portion is restricted by the throttling device and the refrigerant stacks up in the secondary heat transfer portion. Very little refrigerant flows into the primary heat transfer portion, and no refrigeration affect has yet taken place. The small amount of vapor in the primary heat transfer portion will gather some "Superheat" which will remain in the vapor and gaseous refrigerant within the primary heat transfer portion, as a result of the Liquid Seal. As will be used hereinafter, the term "Superheat" shall be defined as a sensible heat gain above the saturation temperature of the liquid refrigerant, at which a change in temperature of the refrigerant gas occurs (sensed) with no change in pressure.

Figure 11C:
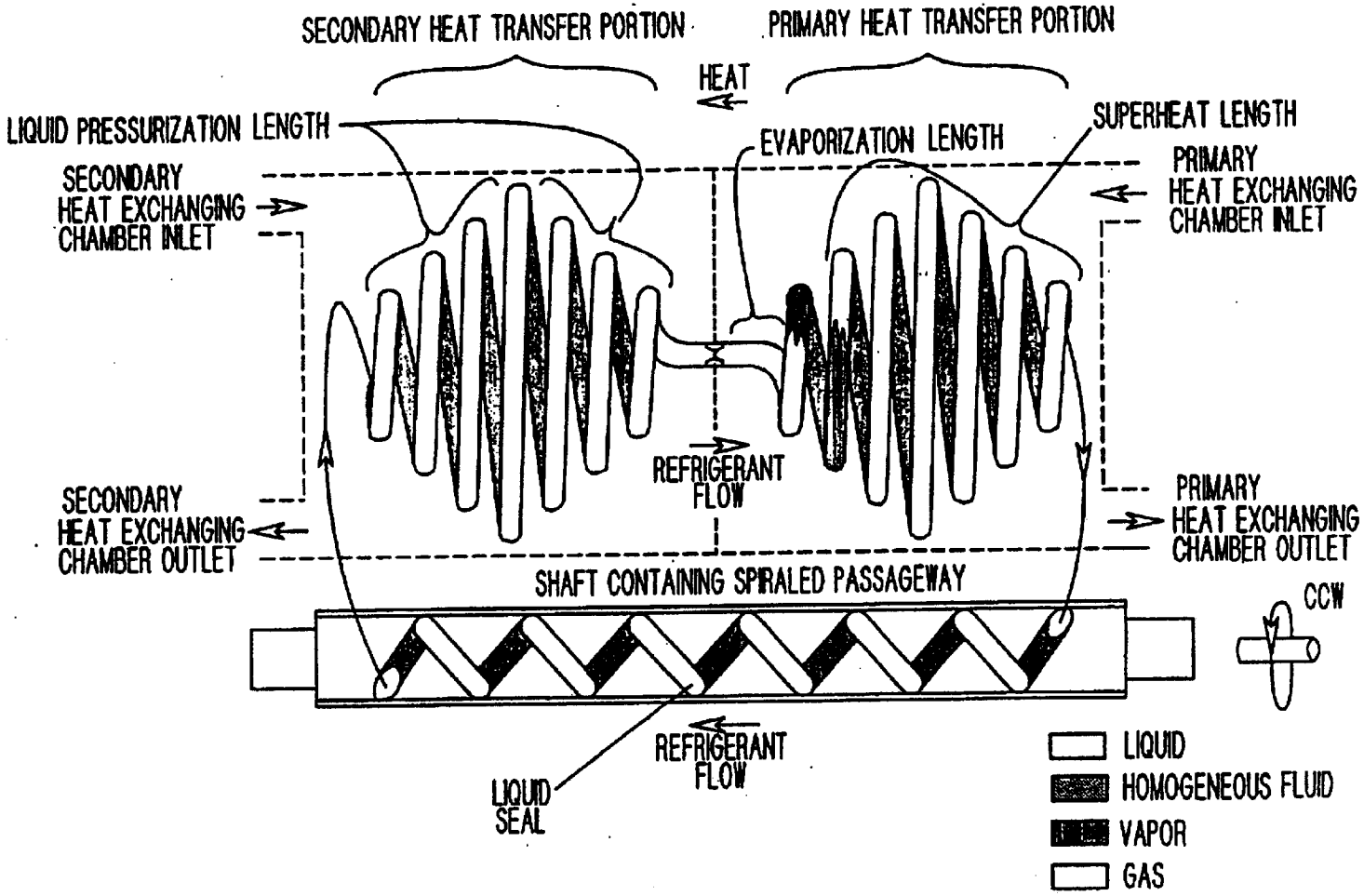
FIG. 11C is a schematic representation of the rotor structure of the heat transfer engine of FIG. 1, showing the physical location of the liquid, homogeneous fluid, vapor and gaseous phases of refrigerant within the rotor structure thereof during the second stage of start up operation in its cooling mode.

As shown in FIG. 11C, the rotor continues to increase in speed in the CCW direction. At this stage of operation, the Liquid Pressurization Length of the refrigerant begins to create enough pressure within the secondary heat transfer portion to overcome the pressure restriction caused by the throttling device and thus liquid begins to flow into the primary heat transfer portion of the rotor. As shown, the Liquid Seal has moved along the rotor shaft towards the secondary heat transfer portion.

At this stage of operation, refrigerant beyond the metering device and into about the first spiral coil of the primary heat transfer portion is in the form of a "homogeneous fluid" (i.e. a mixture of liquid and vapor state) while a portion of the first spiral coil and a portion of the second one contain refrigerant in its homogeneous state. As used hereinafter, the term "homogeneous fluid" shall mean a mixture of flash gas and low temperature, low pressure, liquid refrigerant experiencing a change-in-state (the process of evaporation) due to its absorption of heat. The length of refrigerant over which Evaporation occurs shall be defined as the Evaporation Length of the refrigerant, whereas the section of the refrigerant stream along the fluid flow passageway containing gas shall be defined as the Superheat Length, as shown. The homogeneous fluid entering the primary heat transfer portion "displaces" the gas therewithin, thereby pushing it downstream into the spiraled passageway of the rotor shaft. Throttling of liquid refrigerant into vapor absorbs heat from the primary heat transfer portion of the rotor, imparting "Superheat" to the gaseous refrigerant. A "cooler" vapor created by the process of throttling enters the primary heat transfer portion and begins to absorb more Superheat. Refrigerant gas and vapor are compressed between the homogeneous fluid in the primary heat transfer portion and the Liquid Seal in the spiraled passageway of the rotor shaft.

Notably, at this stage of operation shown in FIG. 11C, there is only enough pressure in the secondary heat transfer section to cause a minimal amount of liquid to flow into the primary heat transfer portion of the rotor, and thus throttling (i.e. partially evaporating) occurs slightly. Consequently, the refrigeration affect has begun slightly and the only heat being absorbed by the refrigerant is Superheat in the Superheat Length of the refrigerant stream. The vapor beginning to form just downstream in the primary heat transfer portion is "Flash" gas from the throttling process.

The stage of operation represented in FIG. 11C illustrates what shall be called the "Liquid Line". As shown, the Liquid Line shall be defined as the point where the homogeneous fluid ends and the vapor begins along the length of the primary heat transfer portion. Therefore, the liquid line illustrated in FIGS. 11C to 11F can occupy a short length of the primary heat transfer portion as a mixture of homogeneous fluid and a very dense vapor which extends downstream to the Superheat length. The exact location along the primary heat transfer portion will vary depending on the quantity of homogeneous fluid, which is in proportion to the amount of heat being absorbed and the Thermal Load (i.e. heat transfer demand) being imposed on the heat transfer engine in its mode of operation. The Liquid Line is not to be confused with the Liquid Seal.

Figure 11D:
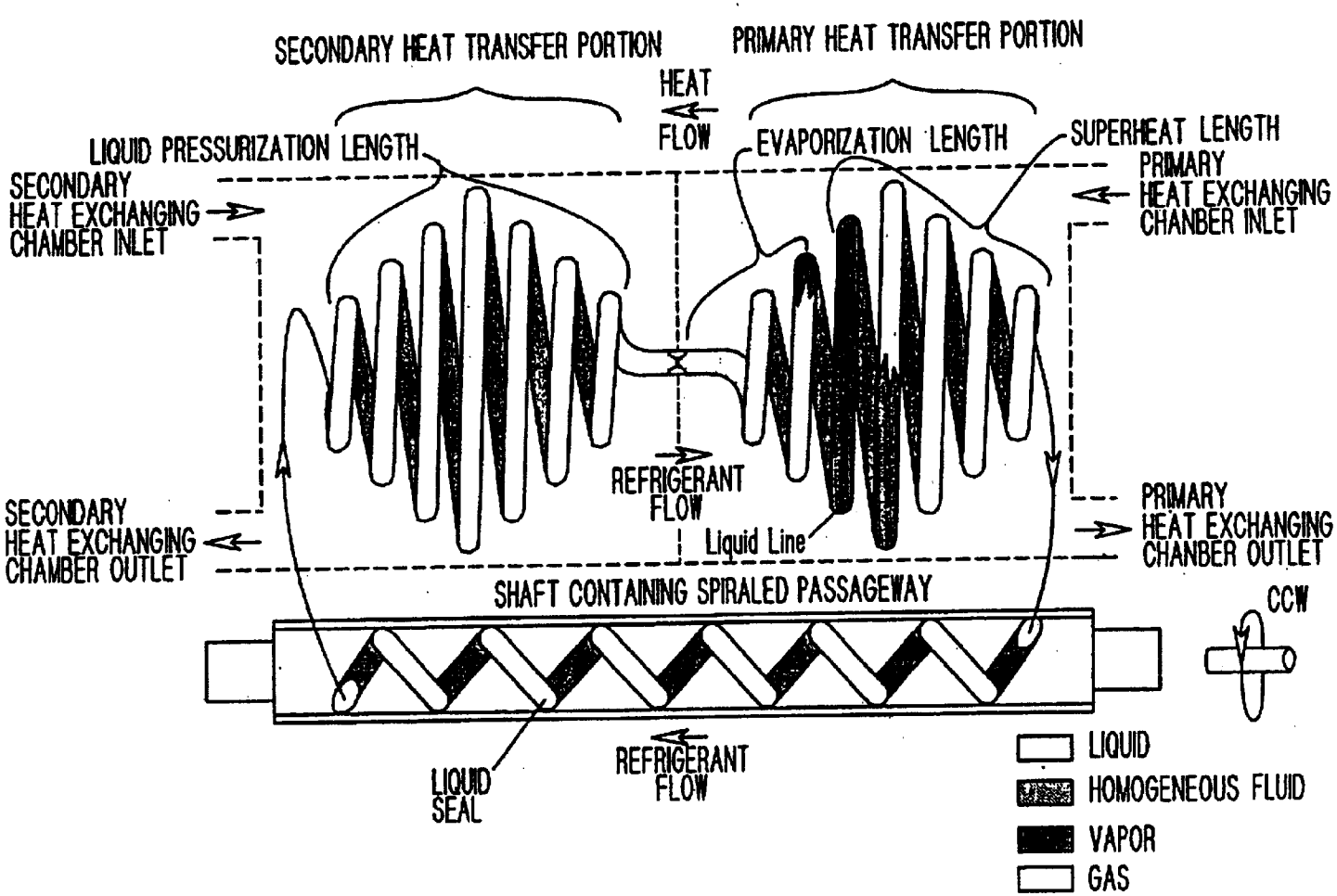
FIG. 11D is a schematic representation of the rotor structure of the heat transfer engine of FIG. 1, showing the physical location of the liquid, homogeneous fluid, vapor and gaseous phases of refrigerant within the rotor structure thereof when vapor compression begins within the centrifugal heat transfer engine during the third stage of start up operation in its cooling mode.

As the rotor continues to increase to its steady state speed in the CCW direction, as shown in FIG. 11D, the amount of refrigerant vapor in the primary heat transfer portion increases due to increased throttling and increased "Flash" gas entering the same. The effect of this is to increase the quantity of homogeneous fluid entering the primary heat transfer portion of the rotor. As shown in FIG. 11D, the Liquid Seal has moved even further along the rotor shaft towards the secondary heat transfer portion. Also, less liquid refrigerant occupies the spiraled passageway of the rotor shaft, while more homogeneous fluid occupies the primary heat transfer portion of the rotor (i.e. in the form of Superheat). Also as indicated, the direction of heat flow is from the primary heat transfer portion to the secondary heat transfer portion. However at this stage of operation, this heat flow is trapped behind the Liquid Seal in the spiraled passageway of the shaft.

Figure 11E:
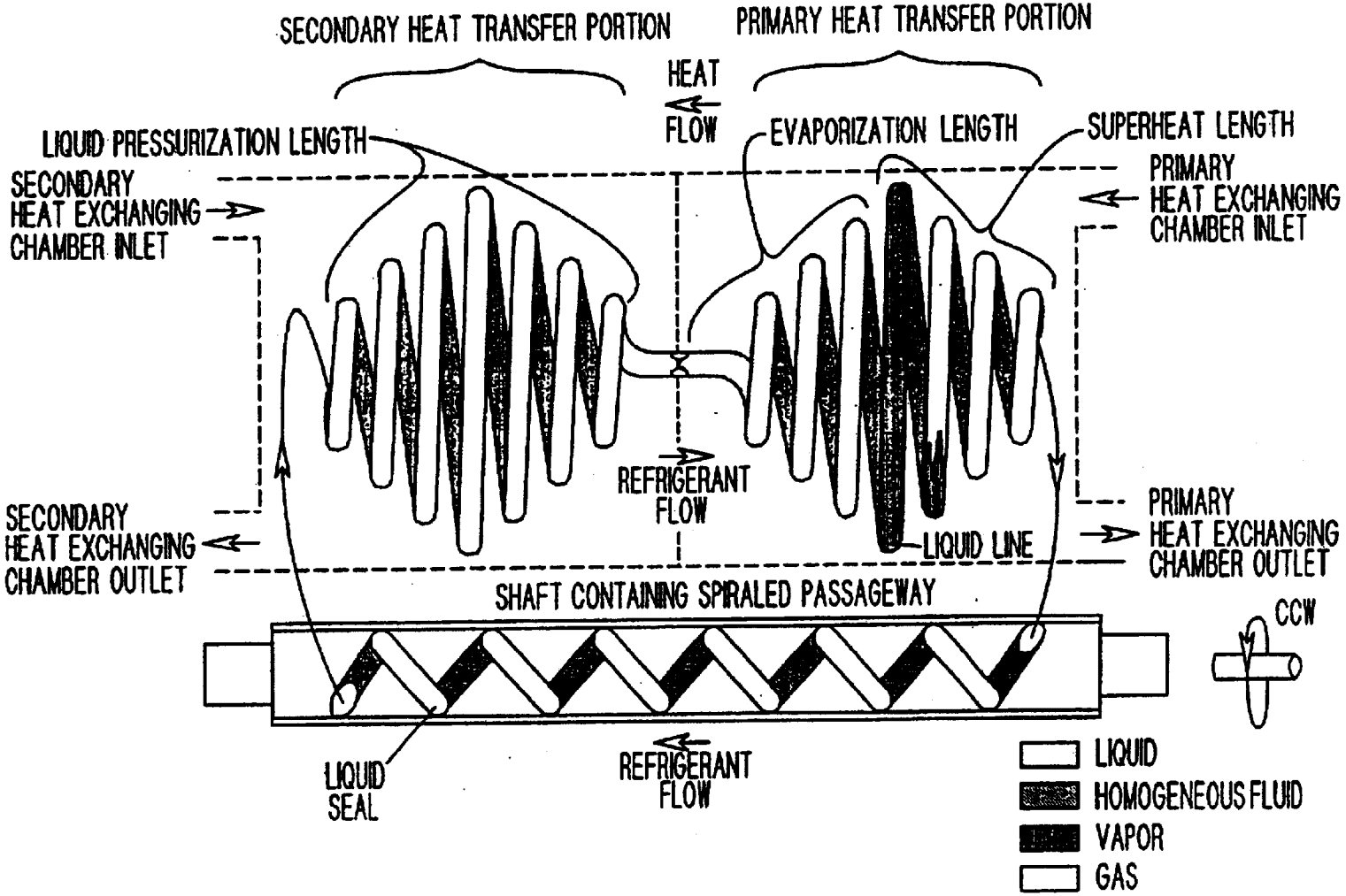
FIG. 11E is a schematic representation of the rotor structure of the heat transfer engine of FIG. 1, showing the physical location of the liquid, homogeneous fluid, vapor and gaseous phases of refrigerant within the rotor structure thereof during the fourth stage of start-up operation in its cooling mode.

As the rotor continues to increase to its steady state speed in the CCW direction, as shown in FIG. 11E, the quantity of refrigerant vapor within the primary heat transfer portion of the rotor continues to increase due to the increased production of flash gas from the throttling of liquid refrigerant. As shown, the Liquid Seal has moved towards the end of the rotor shaft and the secondary heat transfer portion inlet thereof. Also, during this stage of operation, the flow of heat (i.e. Superheat) from the primary heat transfer portion is still trapped behind the Liquid Seal in the spiraled passageway of the rotor shaft. Consequently, the Superheat Heat from the primary heat transfer portion is unable to pass onto the secondary heat transfer portions primary and secondary heat transfer surfaces, and thus optimal operation is not yet achieved at this stage of engine operation. During this stage of operation some heat (Superheat) may transfer into the rotor shaft from the refrigerant vapor if the shaft temperature is less that the temperature of the refrigerant vapor; and some heat may transfer into the refrigerant vapor if the refrigerant vapor temperature is less than that of the rotor shaft. The rotor shaft and its internal spiraled passageway is a systematic source of primary and secondary Superheat transfer surfaces where heat can be either introduced into the vapor or discharged from the vapor. Heat caused by rotor shaft bearing friction is absorbed by the refrigerant vapor along the length of the rotor shaft and can add to the amount of Superheat entering the secondary heat transfer portion. This additional Superheat further increases the temperature difference between the Superheated vapor and the secondary heat transfer surfaces of the secondary heat transfer portion which, in turn, increases the rate of heat flow from the Superheated vapor within. Consequently, this enhances necessary heat transfer locations needed to achieve steady state operation.

Figure 11F:
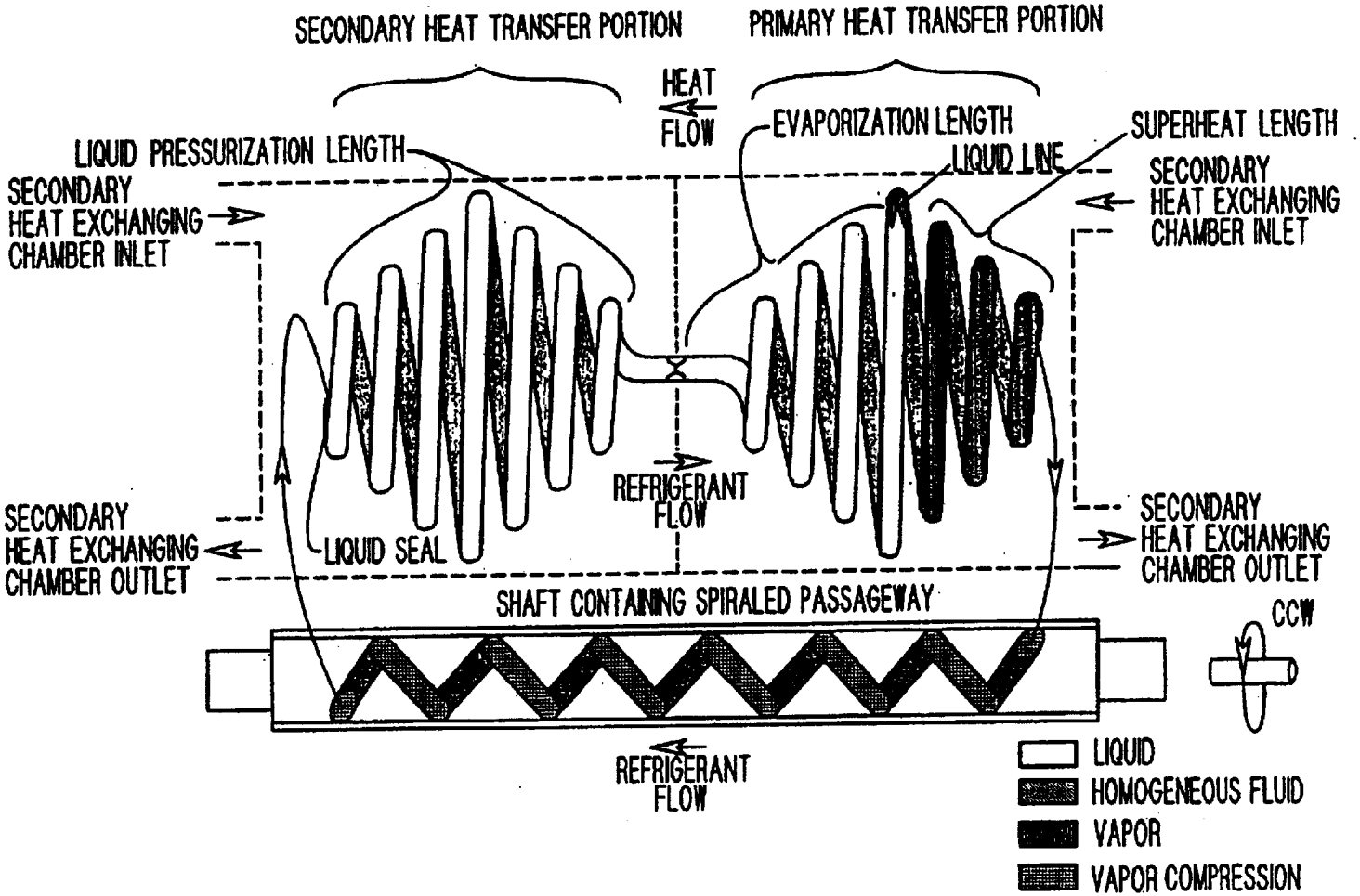
FIG. 11F is a schematic representation of the rotor structure of the heat transfer engine of FIG. 1, showing the physical location of the liquid, homogeneous fluid, vapor and gaseous phases of refrigerant within the of the rotor structure of the heat transfer engine of FIG. 1 rotor structure thereof as vapor compression occurs during the fifth stage of start-up operation in its cooling mode.

At the stage of operation shown in FIG. 11F, the rotor is approaching its steady-state angular velocity, and is shown operating in the CCW direction of operation at what shall be called "Threshold Velocity". As shown, the remaining liquid refrigerant in the rotor shaft is now completely displaced by refrigerant vapor produced as a result of the evaporation of the liquid refrigerant in a primary heat transfer portion of the rotor. Consequently, Superheat produced from the primary heat transfer portion is permitted to flow through the spiraled passageway of the rotor shaft and into the secondary heat transfer portion, where it can be liberated by way of condensation across the secondary heat transfer portion. As shown, Superheat Length of the refrigerant stream within the primary heat transfer portion of the rotor has decreased, while the evaporation length of the refrigerant stream has increased proportionally, indicating that the refrigeration effect within the primary heat transfer portion is increasing.

At the stage of operation shown in FIG. 11F, the Liquid Seal is no longer located along the rotor shaft, but within the secondary heat transfer portion of the rotor, near the end of the rotor shaft. Vapor compression begins to occur in the last part of the primary heat transfer portion and along the spiraled passageway of the rotor. At this stage of operation the pressure of the liquid refrigerant in the Liquid Pressurization Length has increased sufficiently enough to further increase the production of homogeneous fluid in the primary heat transfer portion. This also causes the quantity of liquid in the secondary heat transfer portion to decrease "Pulling" on the flash gas and vapor located in the spiraled passageway in the rotor shaft, and in the primary heat transfer portion downstream from the homogeneous fluid. The pulling affect enhances vapor compression taking place in the spiraled passageway in the rotor shaft. At this stage of operation the homogeneous fluid is evaporating absorbing heat within the primary heat transfer portion of the rotor for transference and systematic discharge from the secondary heat transfer portion. In other words, during this stage of operation, the vapor within the primary heat transfer portion can contain more Superheat by volume than the gas with which it is mixed. Thus, the increased volume in dense vapor in the primary heat transfer portion provides a means of storing Superheat (absorbed from the primary heat exchanging circuit) until the vapor stream flows into the secondary heat transfer portion of the rotor where it can be liberated to the secondary heat exchanging circuit by way of conduction.

Figure 11G:
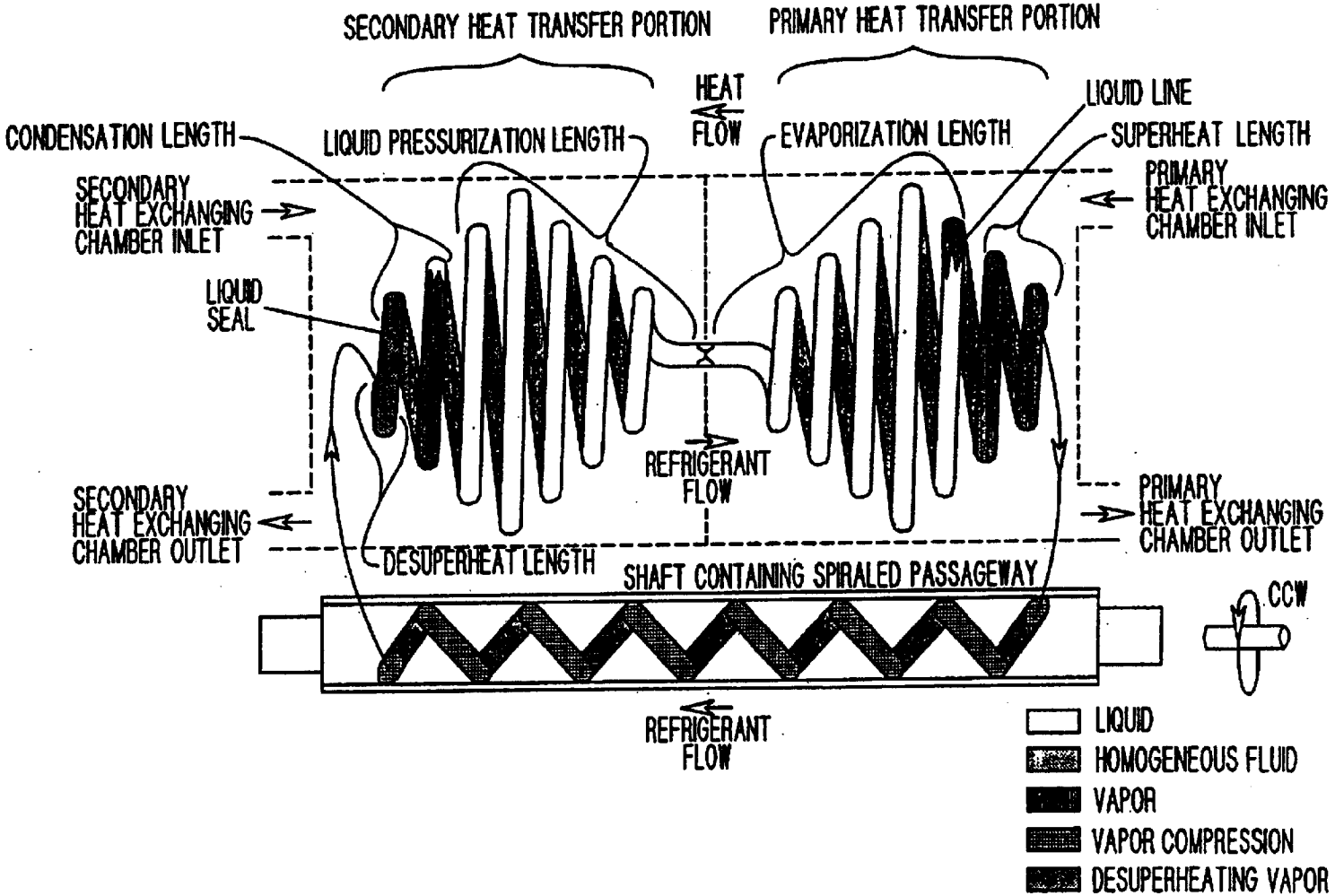
FIG. 11G is a schematic representation of the rotor structure of the heat transfer engine of FIG. 1, showing the physical location of the liquid, homogeneous fluid, vapor and gaseous phases of refrigerant within the rotor structure as superdeheating and condensation begin during the sixth stage of start-up operation in its cooling mode.

As shown in FIG. 11G, the heat transfer engine of the present invention is operated at what shall be called the "Balance Point Condition", the refrigeration cycle of which is illustrated in FIGS. 17A and 17B. At this stage of operation, the refrigerant within the rotor has attained the necessary phase distribution where simultaneously there is an equal amount of refrigerant being evaporated in the primary heat transfer portion as there is refrigerant vapor being condensed in the secondary heat transfer portion of the rotor.

As shown in FIG. 11G, the Superheat that has "accumulated" in the refrigerant vapor during the start up sequence shown in FIGS. 11A through 11F begins to dissipate from the DeSuperheat Length of the refrigerant stream along the secondary heat transfer portion of the rotor. The density of the refrigerant gas increases, and vapor compression occurs as the Superheat is carried by the refrigerant gas from the Superheat Length of the primary heat transfer portion to the DeSuperheat Length in the secondary heat transfer portion by the spiraled passageway in the rotor shaft. Thus, as the Superheat is dissipated in the secondary heat transfer portion and compressed vapor in the secondary heat transfer portion begins to condense into liquid refrigerant, a denser vapor remains. Consequently, the spiraled passageway of the rotor shaft has a greater compressive affect on the vapor therein at this stage of operation. In other words, the spiraled passageway of the shaft is pressurizing the Superheated gas and dense vapor against the Liquid Seal in the secondary heat transfer portion.

As shown in FIG. 11G, pressurization of liquid refrigerant in the secondary heat transfer portion of the rotor pushes the liquid refrigerant through the throttling device at a higher pressure, sufficiently enough, which causes a portion of the liquid refrigerant to "flash" into a gas, thereby, reducing the temperature of the remaining homogeneous fluid (i.e. liquid and dense vapor) entering the primary heat transfer portion thereof. The liquid refrigerant portion of the homogeneous fluid, in turn, evaporates, creating sufficient vapor pressure therein that it displaces vapor downstream within the primary heat transfer portion into the spiraled passageway of the rotor shaft. This vapor pressure, enhanced by vapor compression caused by the spiraled passageway in the rotor shaft, pushes the same into the secondary heat transfer portion of the rotor, where its Superheat is liberated over the DeSuperheat Length thereof.

At the Balance Point condition, a number of conditions exist throughout steady-state operation. Foremost, the Liquid Seal tends to remain near the same location in the secondary heat transfer portion, while the Liquid Line tends to remain near the same location in the primary heat transfer portion. Secondly, the temperature and pressure of the refrigerant in the secondary heat transfer portion of the rotor is higher than the refrigerant in the primary heat transfer portion thereof. Third, the rate of heat transfer from the primary heat exchanging chamber of the engine into the primary heat transfer portion thereof is substantially equal to the rate of heat transfer from the secondary heat transfer portion of the engine into the secondary heat exchanging chamber thereof. Thus, if the primary heat transfer portion of the rotor is absorbing heat at about 12,000 BTUH from the primary heat exchanging circuit, then the secondary heat transfer portion thereof is dissipating about 12,000 BTUH to the secondary heat exchanging circuit.

In order to appreciate the heat transfer process supported by the engine of the present invention, it will be helpful to focus on the refrigerant throttling process within the rotor in slightly greater detail.

The throttling process of the present invention can be described in terms of the three sub-processes which determine the condition of the refrigerant as it passes through the throttling device of the engine in either of its rotational directions. These sub-processes are defined as the Liquid Length, the Bubble Point, and the Two Phase Length. For purposes of clarity, the sub-processes of the throttling process will be described as they occur during start-up operations and steady-state operations.

The Liquid Length begins at the inlet of the throttling device and continues to the Bubble Point. The Bubble Point exists at point inside (or along) the throttling device, (i) at which the Liquid Length (liquid refrigerant) is separated or distinguishable from the Two Phase Length (foamy, liquid and vapor refrigerant) and (ii) where enough pressure drop along the restrictive passage of the throttling device has occurred to cause a portion of the liquid refrigerant to evaporate (a single bubble) and reduce the temperature of the surrounding liquid refrigerant (two phase, bubbles and liquid) for delivery into the evaporator section of the rotor. The Latent Heat given up by the liquid refrigerant during its change in state at the Bubble Point is contained within the bubbles produced at the Bubble Point. Heat absorbed by these bubbles in the evaporator section of the rotor is Superheat. The Bubble Point can exist anywhere along the throttling devices length depending on the amount of thermal load imposed on the heat transfer engine. The Liquid Length extends over that portion of the throttling device containing pure liquid refrigerant up to the Bubble Point. The Two-Phase Length extends from the Bubble Point into the evaporator inlet of the rotor and (foamy, liquid and vapor refrigerant).

During optimum load conditions in the cooling mode, the Condensation Length and Evaporation Length each contain an equal amount of liquid refrigerant. This is because the amount of heat entering the primary heat transfer portion of the rotor is equal to the amount of heat leaving the secondary heat transfer portion thereof. During higher than design load conditions (above optimum) in the cooling mode of operation, there is more liquid refrigerant in the secondary heat transfer portion of the rotor than in the primary heat transfer portion thereof. There are two reasons of explanation for this phenomenon. The first reason is that the primary heat transfer portion of the rotor has a higher rate of heat transfer by virtue of the higher-than-design temperature difference existing between the homogeneous fluid in the primary heat transfer portion of the rotor and the air or liquid passing over the primary heat transfer surfaces. The second reason is that the increase in the throttling process lowers the temperature and pressure of the homogeneous fluid entering the primary heat transfer portion of the rotor. The additional liquid refrigerant in the secondary heat transfer portion of the rotor reduces the available internal volume needed for adequate vapor-to-liquid condensation. Operating under these higher-than-design load conditions, the centrifugal heat transfer engine is "Over Loaded". In such cases, a larger rotor should be used for the application. An increase in the rotor RPM will cause a higher rate of homogeneous fluid to flow into the primary heat transfer portion. However, if the increase in RPM, and a consequent increase in centrifugal force upon the liquid refrigerant, causes the weight of the liquid refrigerant in the Liquid Pressurization Length (of the secondary heat transfer portion) to overcome the coriolis affect, then the refrigeration cycle will cease.

When the design operating temperature of the heat exchanging fluid circulating through the primary heat exchanging chamber is below freezing, a defrost cycle can occur by reducing the RPM of the rotatable structure, reducing the refrigeration affect.

During lower-than-design load conditions (below optimum) the centrifugal heat transfer engine has more liquid refrigerant in the primary heat transfer portion than is contained by the secondary heat transfer portion. The accumulation of liquid refrigerant in the primary heat transfer portion is due to the low rate of heat transfer in the primary heat transfer portion. The temperature and pressure of the refrigerant in the secondary heat transfer portion can be increased by reducing the rate of flow of the heat exchanging fluid circulating through the secondary heat exchanging chamber. Such a decrease in fluid flow causes an increase in temperature and pressure of the refrigerant in the primary heat transfer portion which, in turn, causes an increase in temperature and pressure of the refrigerant in the primary heat transfer portion. The increase in temperature and pressure of the refrigerant in the primary heat transfer portion increases the amount of heat (BTU) per pound that a hydrocarbon refrigerant is capable of absorbing, to an optimum saturation temperature and pressure. The industry design standard is 95 degrees Fahrenheit condensing temperature. Such a controlled decrease in fluid flow shall be referred to as "Secondary Pressure Stabilization". Such a controlled decrease in fluid flow can increase the engines coefficient of performance (COP, or BTU/WATT) of the heat transfer engine. A similar increase or decrease in the primary heat exchanging fluid flow shall be referred to as "Primary Pressure Stabilization". During the cooling mode of operation, and when the centrifugal heat transfer engine has satisfied the load requirements, reaching a Set Point or Balance Point, the RPM of the rotor can be reduced causing a reduction in the refrigeration affect to satisfy a lesser load demand. This type of operation, or mode, is called Load Reduction Control (or Unloading). Unlike Unloading, thermal Loading is where the rotor RPM is increased to satisfy a higher load demand.

The location of the Liquid Seal is affected by the amount of load being exerted on the evaporation process. Liquid pressurization begins at the Liquid Seal and occurs inside the spiraled condenser section along the Liquid Pressurization Length up to the inlet of the throttling (i.e. metering) device inlet. Starting at the Liquid Seal, as the rotor rotates, the liquid refrigerant is forced toward the central axis of rotation by the spiraled shape of the Liquid Pressurization Length in the condenser functioning section of the rotor. The centrifugal forces produced during rotor rotation causes the liquid pressure to gradually increase along the Liquid Pressurization Length, providing a continuous supply of higher pressure (condensed) liquid refrigerant to the inlet of the throttling device where the Liquid Length begins. In other words, during rotation centrifugal forces within the rotor increase the weight of the liquid refrigerant contained in the spiraled Liquid Pressurization Length and cause the liquid refrigerant therewith to pressurize against the flow restricting pressure drop produced by the fluid flow geometry of the throttling device, thereby completing the refrigeration cycle of the centrifugal heat transfer engine.

Figure 11H:
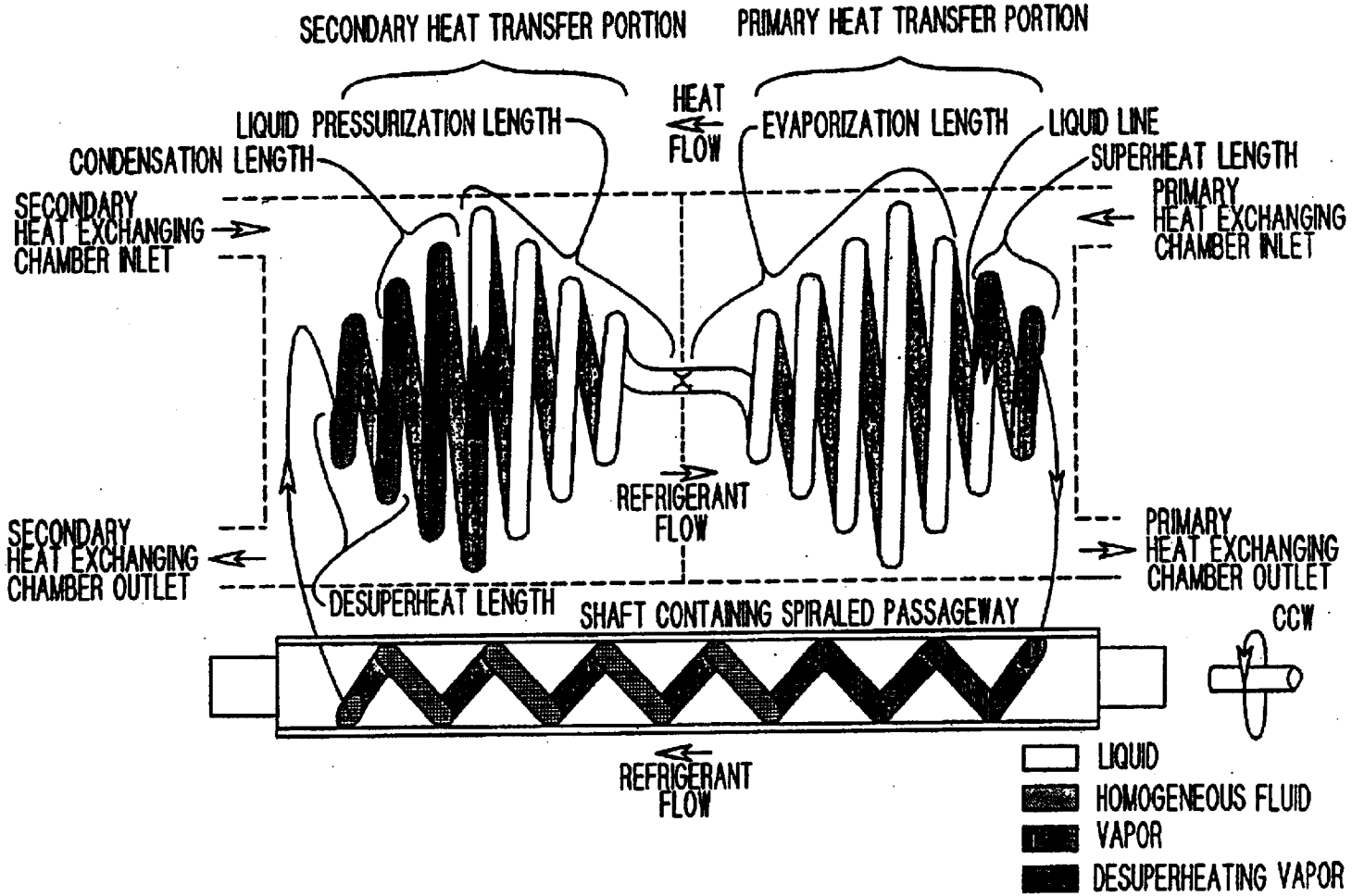
FIG. 11H is a schematic representation of the rotor structure of the heat transfer engine of FIG. 1, showing the physical location of the liquid, homogeneous fluid, vapor and gaseous phases of refrigerant within the rotor structure thereof during the seventh stage of start up operation in its cooling mode.
Figure 11I:
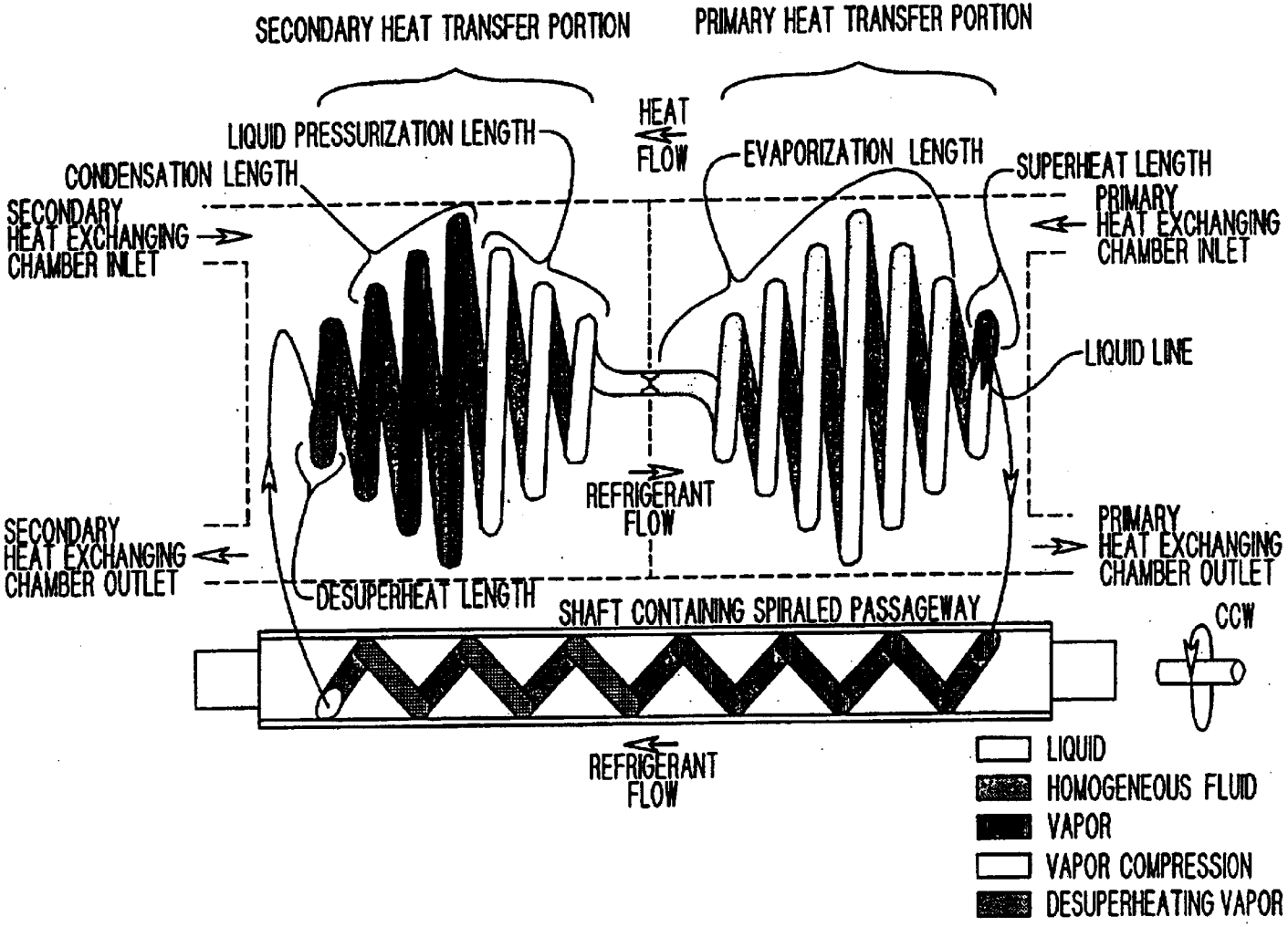
FIG. 11I is a schematic representation of the rotor structure of the heat transfer engine of FIG. 1, showing the physical location of the liquid, homogeneous fluid, vapor and gaseous phases of refrigerant within the rotor structure during the eight (i.e. steady-state) stage of operation in its cooling mode.

In FIG. 11H, the heat transfer engine of the present invention is shown operating just below its "optimum" (low load) operating condition, whereas in FIG. 11I, the heat transfer engine is shown operated excessively beyond its "optimum" operating condition. Notably, the term "optimum" operating condition used above is not to be equated with the term "Balance Point" operating condition. Rather "optimum" operating condition is a point of operation where the amount of liquid refrigerant in the primary heat transfer portion is slightly higher than the amount of liquid refrigerant in the secondary heat transfer portion. This operating point is considered optimum as the lower temperature refrigerant in the primary heat transfer portion is capable of containing more heat (i.e. BTU per pound) than the higher pressure and temperature liquid refrigerant contained in the secondary heat transfer portion of the rotor. Consequently, during engine operation, the flow rate of heat exchanging fluid within the secondary heat exchanging chamber of the engine is reduced at times by the system controller, as this increases the temperature of the secondary heat transfer portion (i.e. during the cooling mode), and thereby increasing the "rate" of heat flow from the secondary heat transfer portion of the rotor (particularly on large capacity engines) into the secondary heat exchanging fluid circulating through the secondary heat exchanging chamber. If the thermal load on the engine is further reduced beyond that shown in FIG. 11I, the spiraled passageway in the rotor shaft prevents a condition where the Liquid Pressurization Length is starved of liquid refrigerant. This safety measure is provided by the fact that at least sixty five percent of the total internal volume of the rotor is occupied by refrigerant, and that quantities of refrigerant exceeding the internal volume of the primary heat transfer portion and extending into the spiraled passageway in the rotor shaft are rapidly moved into the secondary heat transfer portion (by way of the rotating spiraled passageway along the rotor shaft), thereby rapidly replenishing the Liquid Pressurization Length thereof.

As shown in FIG. 11, the Liquid Seal has moved nearer to the throttling device, and even though the Liquid Seal is located in the secondary heat transfer portion, the Liquid Pressurization Length is still pressurizing the liquid refrigerant. In FIG. 11I, the heat transfer engine is shown operated at a point of operation where the "load" has diminished sufficiently to cause the liquid refrigerant within the rotor to "accumulate" in the primary heat transfer portion thereof. At this stage of operation, the system controller of the engine should be reacting to a reduction in temperature in the primary heat exchanging chamber, thereby reducing the RPM of the rotor. Also, the flow rate controller associated with the primary heat exchanging chamber should be starting to reduce the flow rate of heat exchanging fluid circulating within the secondary heat exchanging chamber. Notably, if the engine was operated in its "De-ice" or "Defrost" mode of operation, the rotor RPM would be further decreased in order to reduce the refrigeration affect. In turn, this would increase the "overall system pressure", causing the ambient temperature about the primary heat exchanging portion to increase, thereby preventing the formation of ice (or accumulation of process fluid) on the primary and secondary heat transfer surfaces thereof.

Heat Transfer Process of Present Invention: Heating Mode of Operation

Referring to FIGS. 12A to 12I, the refrigeration process of the present invention will now be described with the heat transfer engine of the present engine being operation in its heating mode of operation. Notably, each of these drawings schematically depicts, from a cross-sectional perspective, both the first and second heat exchanging portions of the rotor. This presentation of the internal structure of the closed fluid passageway throughout the rotor provides a clear illustration of both the location and the state of the refrigerant along the closed fluid passageway thereof.

Figure 12A:
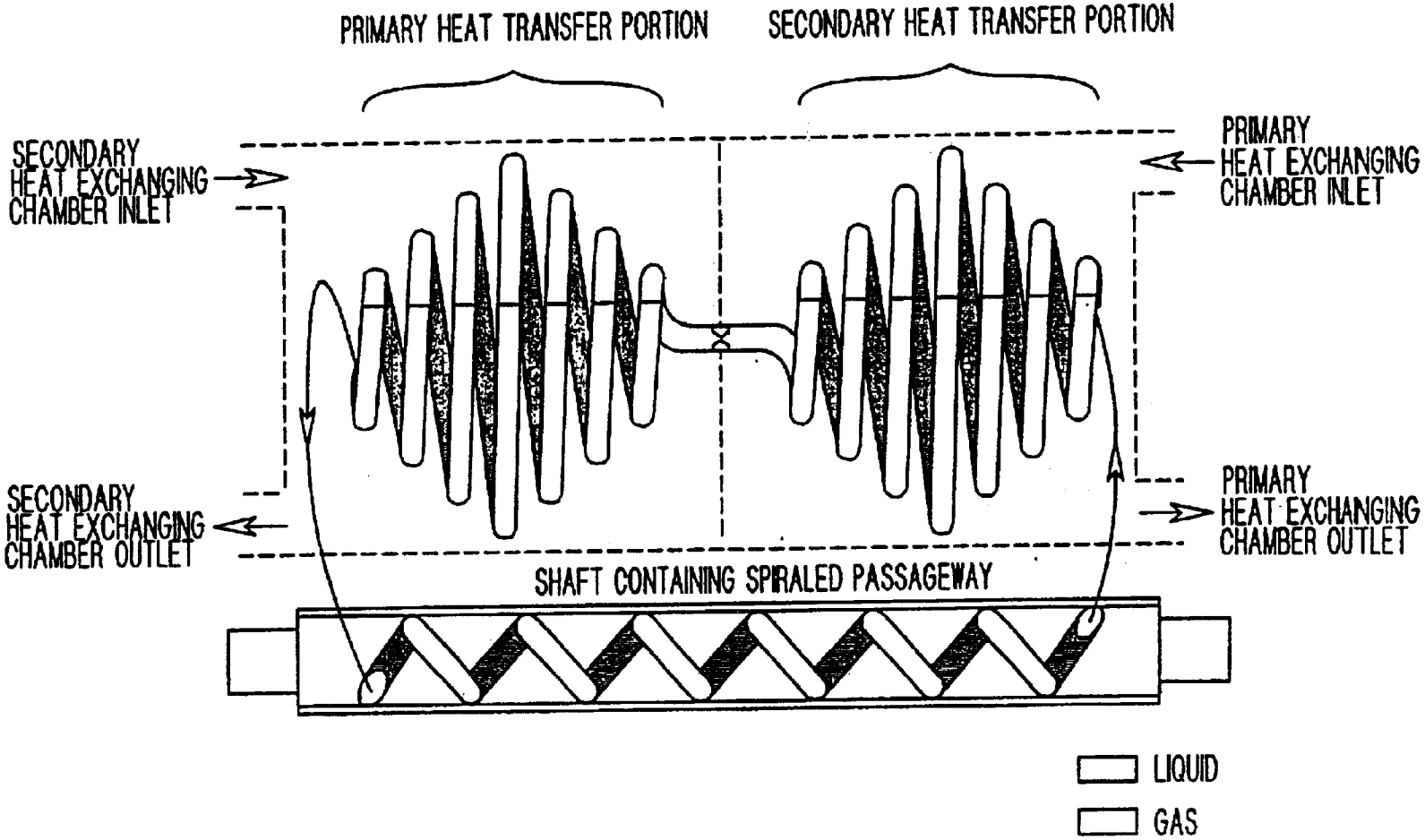
FIG. 12A is a schematic representation of the rotor structure of the heat transfer engine of FIG. 1, showing the physical location of the liquid and gaseous phases of refrigerant within the rotor structure thereof when the centrifugal heat transfer engine is at rest prior to entering its heating mode.

In FIG. 12A, the rotor is shown at its rest position, which is indicated by the absence of any rotational arrow about the rotor shaft. At this stage of operation, the internal volume of the closed fluid circuit is occupied by about 65% of refrigerant in its liquid state. Notably, the entire spiral return passageway along the rotor shaft is occupied with liquid refrigerant, while the heat exchanging portions of the rotor are occupied with liquid refrigerant at a level set by gravity in the normal course. The portion of the fluid passageway above the liquid level in the rotor is occupied by refrigerant in a gaseous state. The closed fluid flow passageway is thoroughly cleaned and dehydrated prior to the addition of the selected refrigerant to prevent any contamination thereof.

Figure 12B:
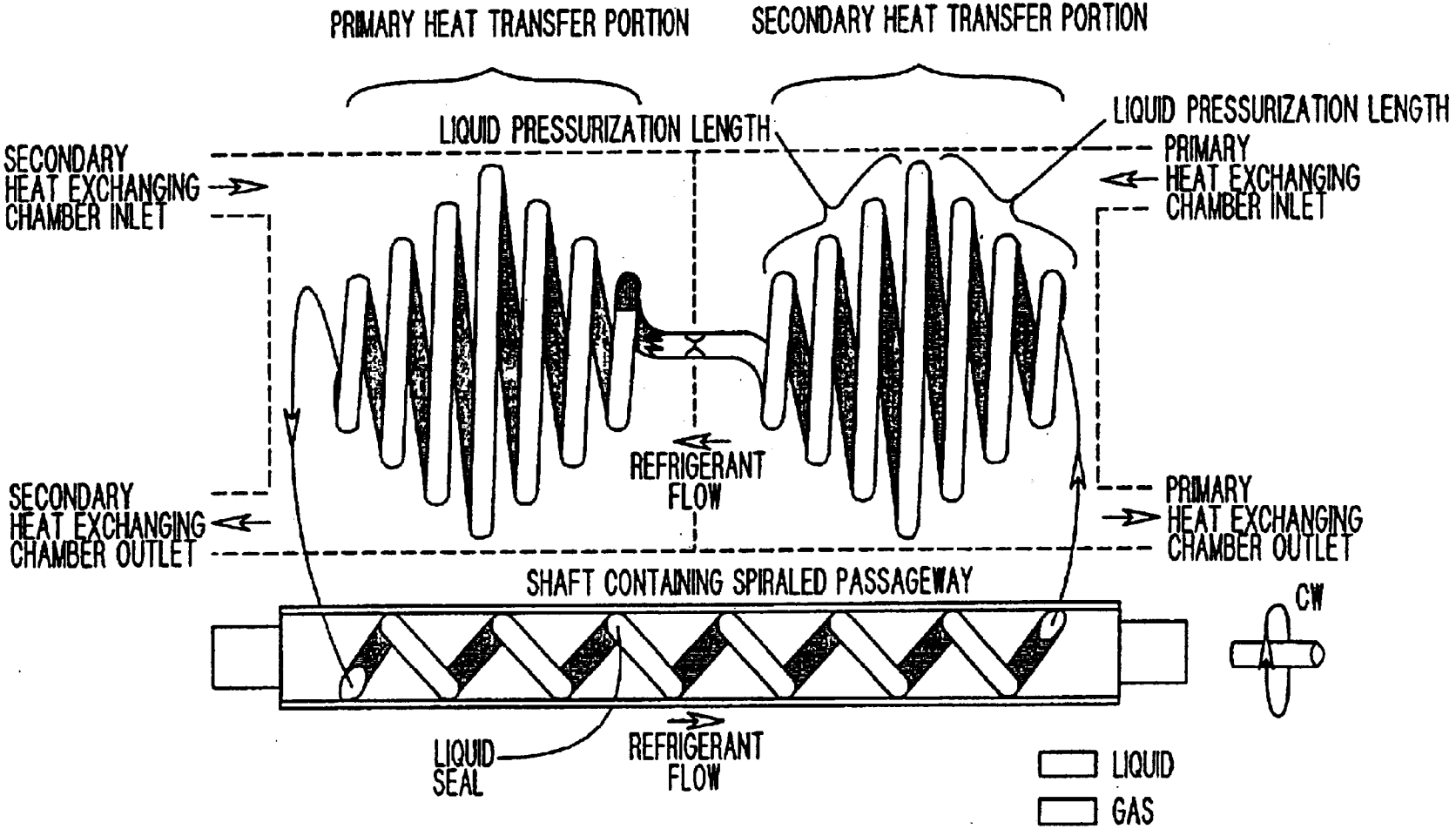
FIG. 12B is a schematic representation of the rotor structure of the heat transfer engine of FIG. 1, showing the physical location of the liquid, gaseous and vapor phases of refrigerant within the rotor structure thereof during the first few revolutions thereof during the first stages of start up operation in its heating mode.

As shown in FIG. 12B, the rotor is rotated in a clockwise (CW) direction within the stator housing of the heat transfer engine. During steady state operation in the cooling mode, illustrated in FIGS. 12G to 12I, the primary heat transfer portion will perform a liquid refrigerant evaporating function, while the secondary heat transfer portion performs a refrigerant vapor condensing function. However, at the stage of operation indicated in FIG. 12B, the liquid refrigerant within the spiraled passageway of the shaft begins to flow into the secondary heat transfer (i.e. exchanging) portion of the rotor and occupies the entire volume thereof. As shown, a very small portion (i.e. about one coil turn) of the primary heat transfer portion is occupied by refrigerant vapor as it passes through the throttling (i.e. metering device, while the remainder of the primary heat transfer portion of the rotor and a portion of the spiraled passageway of the shaft once occupied by liquid refrigerant is occupied with gas. During steady state operation the Liquid Seal resides at a point along the length of the secondary heat transfer portion where enough refrigerant vapor has condensed into a liquid thereby occupying the total internal face area of the passageway.

During the start up stage of engine operation shown in FIG. 12B, the Liquid Seal moves towards the secondary heat transfer portion, and refrigerant flow into the primary heat transfer portion is restricted by the throttling device and the refrigerant stacks up in the secondary heat transfer portion. Very little refrigerant flows into the primary heat transfer portion, and no refrigeration affect has yet taken place. The small amount of vapor in the primary heat transfer portion will gather some Superheat which will remain in the vapor and gaseous refrigerant within the primary heat transfer portion, as a result of the Liquid Seal.

Figure 12C:
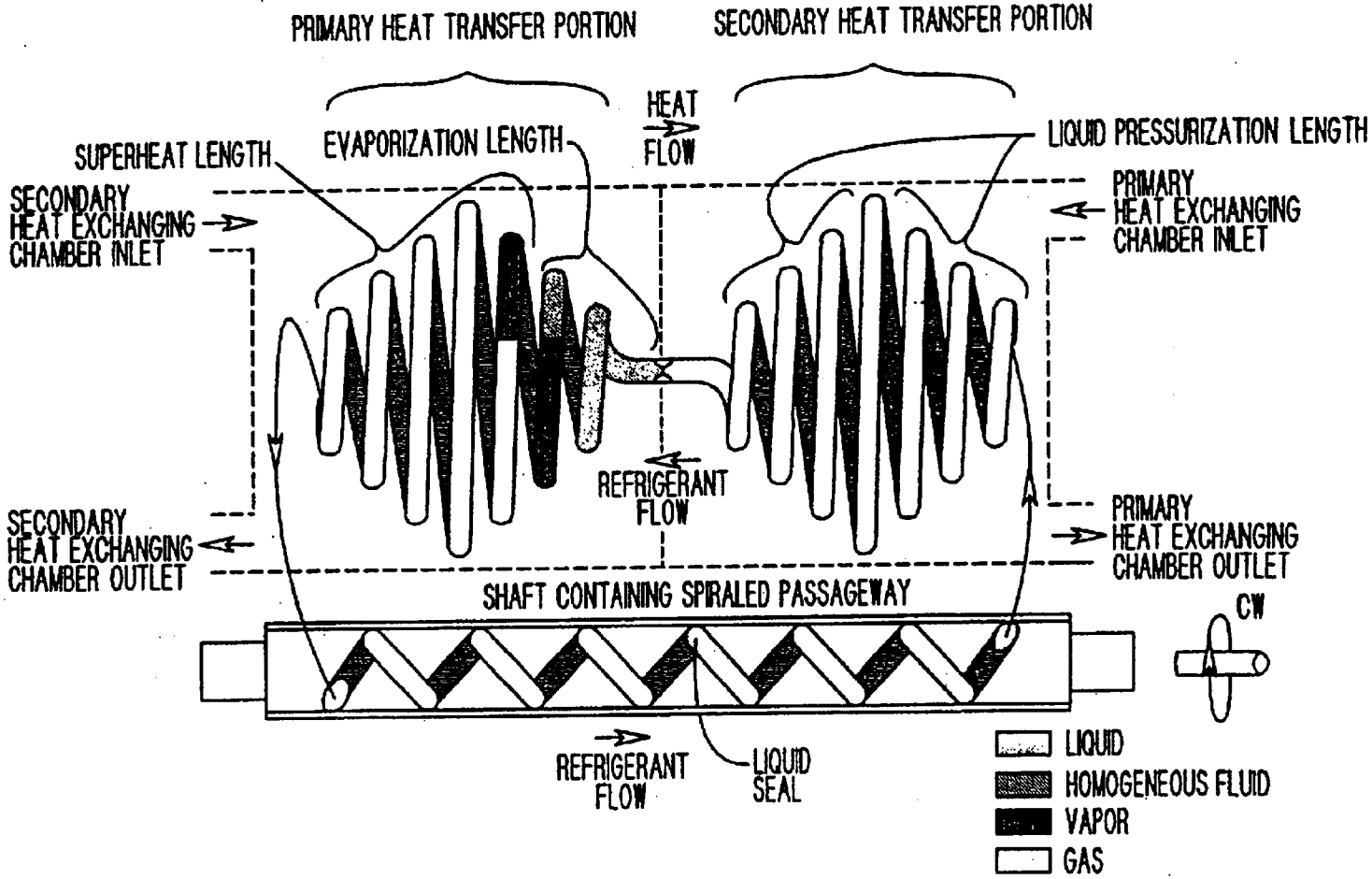
FIG. 12C is a schematic representation of the rotor structure of the heat transfer engine of FIG. 1, showing the physical location of the liquid, homogeneous fluid, vapor and gaseous phases of refrigerant within the rotor structure thereof during the second stage of start up operation in its heating mode.

As shown in FIG. 12C, the rotor continues to increase in speed in the CW direction. At this stage of operation, the Liquid Pressurization Length of the refrigerant begins to create enough pressure within the secondary heat transfer portion to overcome the pressure restriction caused by the throttling device and thus liquid begins to flow into the primary heat transfer portion of the rotor. As shown, the Liquid Seal has moved along the rotor shaft towards the secondary heat transfer portion. The homogeneous fluid entering the primary heat transfer portion "displaces" the gas therewithin, thereby pushing it downstream into the spiraled passageway of the rotor shaft. Some throttling of liquid refrigerant into vapor occurs causing enough temperature drop in the primary heat transfer portion of the rotor and thus causing transfer of Superheat into the gaseous refrigerant. A "cooler" vapor created by the process of throttling enters the primary heat transfer portion and begins to absorb more Superheat. Refrigerant gas and vapor are compressed between the homogeneous fluid in the primary heat transfer portion and the Liquid Seal in the spiraled passageway of the rotor shaft.

At the stage of operation shown in FIG. 12C, there is only enough pressure in the secondary heat transfer section to cause a minimal amount of liquid to flow into the primary heat transfer portion of the rotor, and therefore throttling (i.e. partially evaporating) occurs slightly. Consequently, the refrigeration affect has begun slightly and the only heat being absorbed by the refrigerant is Superheat in the Superheat Length of the refrigerant stream. There is some vapor beginning to form just downstream in the primary heat transfer portion, which is really "Flash" gas from the throttling process. The Liquid Line illustrated in FIGS. 12C can occupy a short length of the primary heat transfer portion as a mixture of homogeneous fluid and a very dense vapor which extends downstream to the Superheat length. The exact location of the Liquid Line along the primary heat transfer portion will vary depending on the quantity of homogeneous fluid, which is in proportion to the amount of heat being absorbed and the load being imposed on it.

Figure 12D:
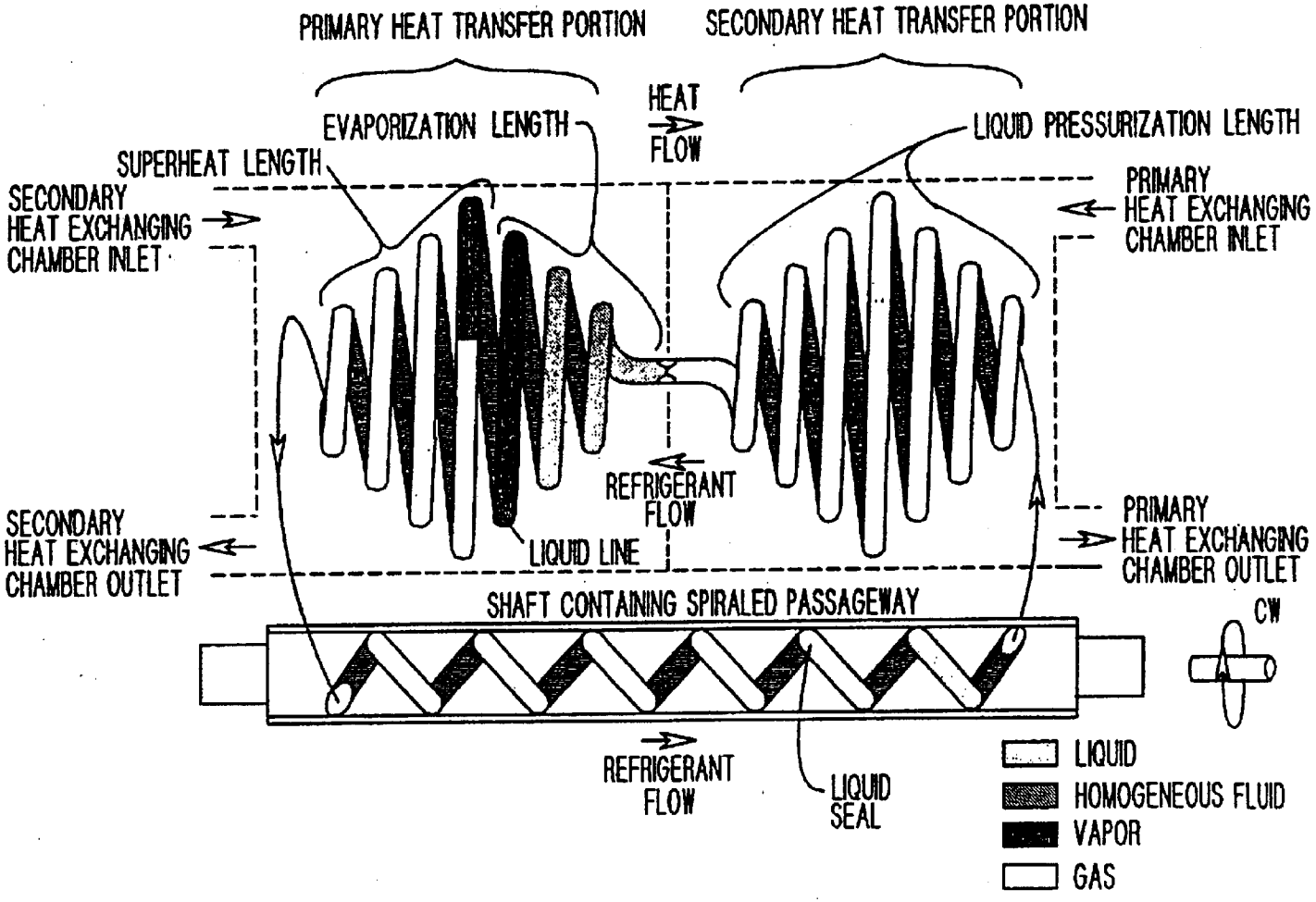
FIG. 12D is a schematic representation of the rotor structure of the heat transfer engine of FIG. 1, showing the physical location of the liquid, homogeneous fluid, vapor and gaseous phases of refrigerant within the rotor structure when vapor compression begins within the centrifugal heat transfer engine during the third stage of start up operation in the heating mode.

As the rotor continues to increase to its steady state speed in the CW direction, as shown in FIG. 12D, the amount of refrigerant vapor in the primary heat transfer portion increases due to increased throttling and increased "Flash" gas entering the same. The effect of this is an increase in the quantity of homogeneous fluid entering the primary heat transfer portion of the rotor. As shown in FIG. 12D, the Liquid Seal has moved even further along the rotor shaft towards the secondary heat transfer portion. Also, less liquid refrigerant occupies the spiraled passageway of the rotor shaft, while more homogeneous fluid occupies the primary heat transfer portion of the rotor. Also as indicated, the direction of heat flow is from the primary heat transfer portion to the secondary heat transfer portion (i.e. in the form of Superheat). However at this stage of operation, this heat flow is trapped behind the Liquid Seal in the spiraled passageway of the shaft.

Figure 12E:
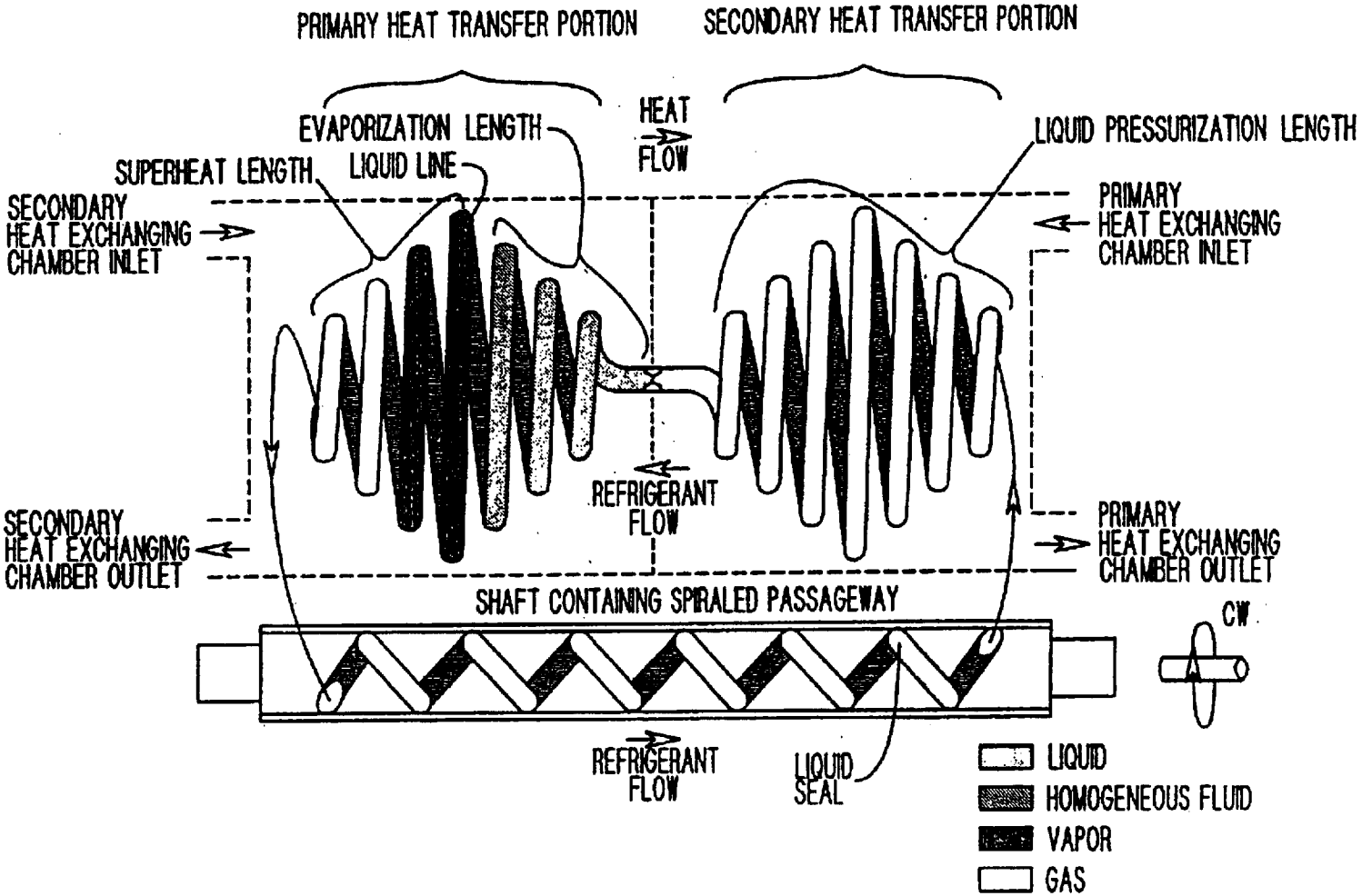
FIG. 12E is a schematic representation of the rotor structure of the heat transfer engine of FIG. 1, showing the physical location of the liquid, homogeneous fluid, vapor and gaseous phases of refrigerant within the rotor structure thereof during the fourth stage of start-up operation in its heating mode.

As the rotor continues to increase to its steady state speed in the CW direction, as shown in FIG. 12E, the quantity of refrigerant vapor within the primary heat transfer portion of the rotor continues to increase due to the increased production of flash gas from throttling of liquid refrigerant. As shown, the Liquid Seal has moved towards the end of the rotor shaft and the secondary heat transfer portion inlet thereof. Also, during this stage of operation, the flow of heat (i.e. Superheat) from the primary heat transfer portion is still trapped behind the Liquid Seal in the spiraled passageway of the rotor shaft. Consequently, the Superheat from the primary heat transfer portion is unable to pass onto the secondary heat transfer portions primary and secondary heat transfer surfaces, and thus optimal operation is not yet achieved at this stage of engine operation. During this stage of operation some heat (i.e. Superheat) may transfer into the rotor shaft from the refrigerant vapor if the shaft temperature is less that the temperature of the refrigerant vapor; and some heat may transfer into the refrigerant vapor if the refrigerant vapor temperature is less than that of the rotor shaft.

Figure 12F:
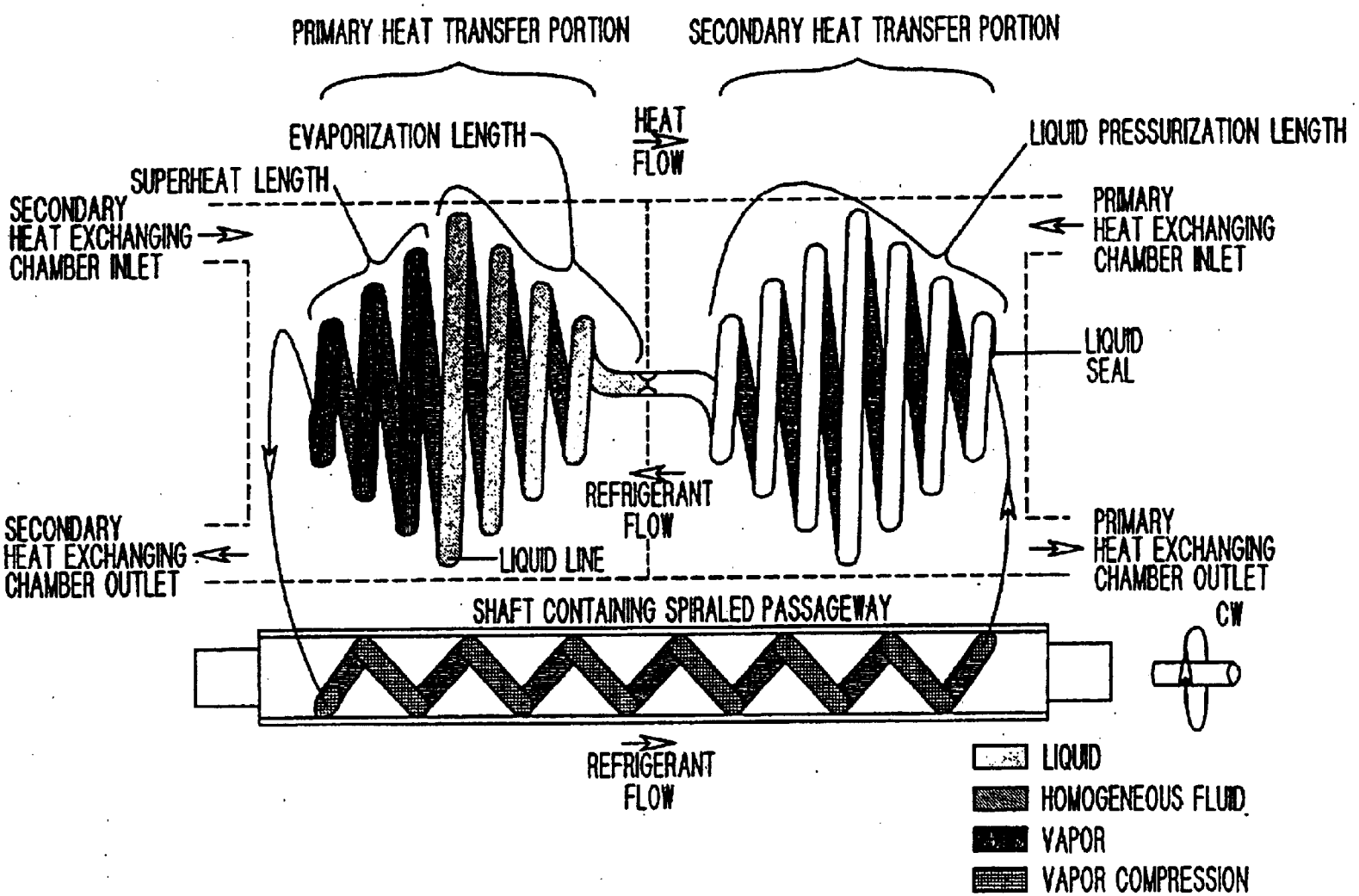
FIG. 12F is a schematic representation of the rotor structure of the heat transfer engine of FIG. 1, showing the physical location of the liquid, homogeneous fluid, vapor and gaseous phases of refrigerant within the rotor structure thereof as vapor compression occurs during the fifth stage of start-up operation in its heating mode.

At the stage of operation shown in FIG. 12F, the rotor is approaching its steady-state angular velocity, and is shown operating in the CW direction of operation at its "Threshold Velocity". As shown, the remaining liquid refrigerant in the rotor shaft is now completely displaced by refrigerant vapor produced as a result of the evaporation of the liquid refrigerant in primary heat transfer portion of the rotor. Consequently, Superheat produced from the primary heat transfer portion is permitted to flow through the spiraled passageway of the rotor shaft and into the secondary heat transfer portion, where it can be liberated by way of condensation across the secondary heat transfer portion. As shown, Superheat Length of the refrigerant stream within the primary heat transfer portion of the rotor has decreased, while the evaporation length of the refrigerant stream has increased proportionally, indicating that the refrigeration effect within the primary heat transfer portion is increasing.

At the stage of operation shown in FIG. 12F, the Liquid Seal is no longer located along the rotor shaft, but within the secondary heat transfer portion of the rotor, near the end of the rotor shaft. Vapor compression begins to occur in the last part of the primary heat transfer portion and along the spiraled passageway of the rotor. At this stage of operation the pressure of the liquid refrigerant in the Liquid Pressurization Length has increased sufficiently enough to further increase the production of homogeneous fluid in the primary heat transfer portion. This also causes the quantity of liquid in the secondary heat transfer portion to decrease "Pulling" on the flash gas and vapor located in the spiraled passageway in the rotor shaft, and in the primary heat transfer portion downstream from the homogeneous fluid. The pulling affect enhances vapor compression taking place in the spiraled passageway in the rotor shaft. At this stage of operation, the homogeneous fluid is evaporating absorbing heat within the primary heat transfer portion of the rotor for transference and systematic discharge from the secondary heat transfer portion into the heat exchanging fluid circulating through the primary heat exchanging chamber. In other words, during this stage of operation, the vapor within the primary heat transfer portion can contain more Superheat by volume than the gas with which it is mixed. Thus, the increased volume in dense vapor in the primary heat transfer portion provides a means of storing Superheat (absorbed from the primary heat exchanging circuit) until the vapor stream flows into the secondary heat transfer portion of the rotor where it can be liberated to the secondary heat exchanging circuit by way of conduction.

Figure 12G:
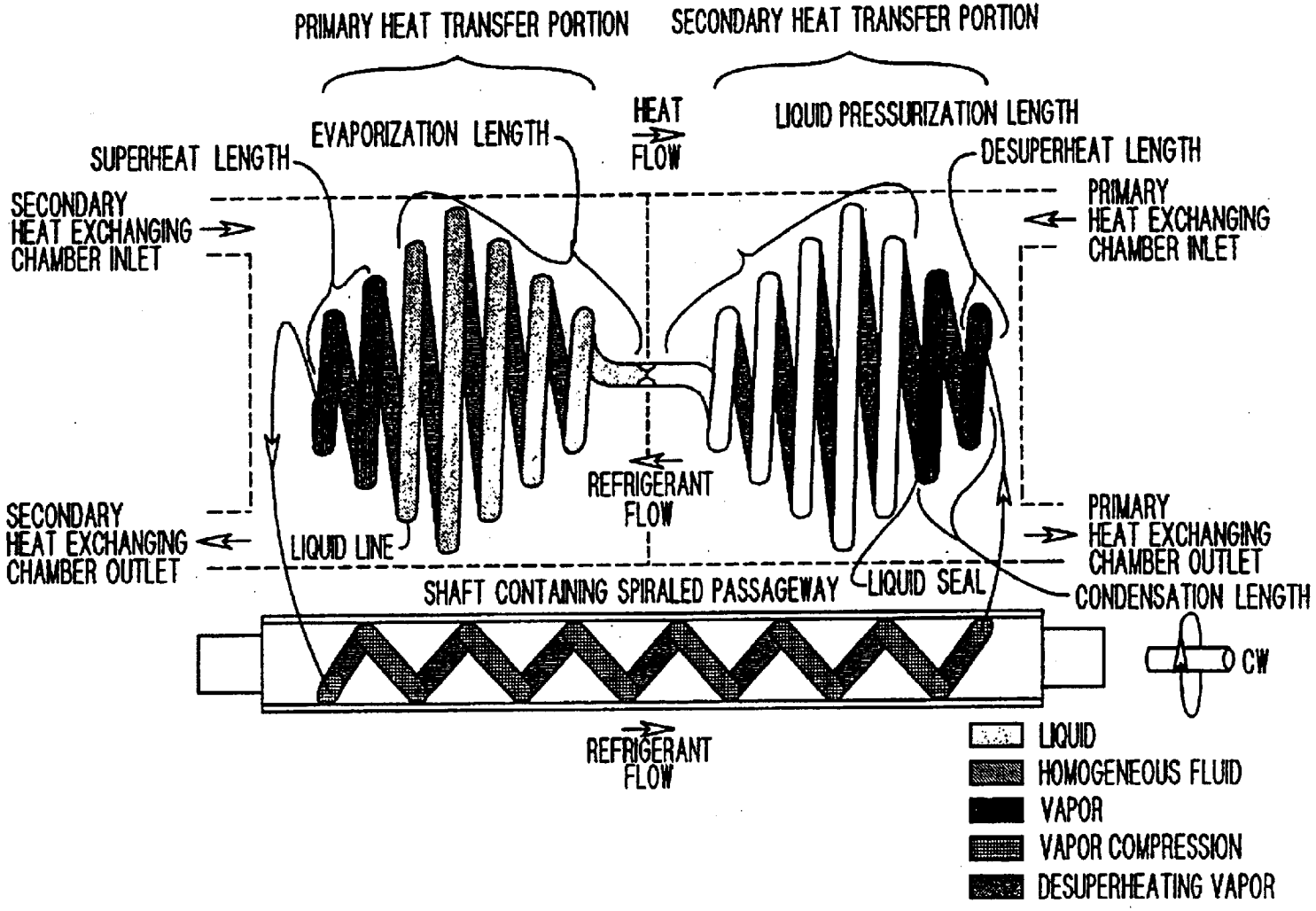
FIG. 12G is a schematic representation of the rotor structure of the heat transfer engine of FIG. 1, showing the physical location of the liquid, homogeneous fluid, vapor and gaseous phases of refrigerant within the rotor structure as superdeheating and condensation begin during the sixth stage of start-up operation in its heating mode.

As shown in FIG. 12G, the heat transfer engine of the present invention is operating at what shall be called the "Balance Point Condition". At this stage of operation, the refrigerant within the rotor has attained the necessary phase distribution where simultaneously there is an equal amount of refrigerant being evaporated in the primary heat transfer portion as there is refrigerant vapor being condensed in the secondary heat transfer portion of the rotor. The secondary heat transfer portion is adding heat to the primary heat transfer chamber. As shown in FIG. 12G, the Superheat that has "accumulated" in the refrigerant vapor during the start up sequence shown in FIGS. 12A through 12F begins to dissipate from the DeSuperheat Length of the refrigerant stream along the secondary heat transfer portion of the rotor. The density of the refrigerant gas increases, and vapor compression occurs as the Superheat is carried by the refrigerant gas from the Superheat Length of the primary heat transfer portion to the DeSuperheat Length in the secondary heat transfer portion by the spiraled passageway in the rotor shaft. Thus, as the Superheat is dissipated in the secondary heat transfer portion, and compressed vapor in the secondary heat transfer portion begins to condense into liquid refrigerant, a denser vapor remains. Consequently, at this stage of operation, the spiraled passageway of the rotor shaft has a greater compressive affect on the vapor therein. In other words, the spiraled passageway of the shaft is pressurizing the Superheated gas and dense vapor against the Liquid Seal in the secondary heat transfer portion.

As shown in FIG. 12G, pressurization of liquid refrigerant in the secondary heat transfer portion of the rotor pushes the liquid refrigerant through the throttling device at a sufficiently higher pressure, which causes a portion of the liquid refrigerant to "flash" into a gas, thereby, reducing the temperature of the remaining homogeneous fluid (liquid and dense vapor) entering the primary heat transfer portion thereof. The liquid refrigerant portion of the homogeneous fluid, in turn, evaporates which creates sufficient vapor pressure therein that it displaces vapor downstream within the primary heat transfer portion into the spiraled passageway of the rotor shaft. This vapor pressure, enhanced by vapor compression caused by the spiraled passageway in the rotor shaft, pushes the same into the secondary heat transfer portion of the rotor, where its Superheat is liberated over the DeSuperheat Length thereof.

At the Balance Point condition, a number of conditions exist throughout steady-state operation. Foremost, the Liquid Seal tends to remain near the same location in the secondary heat transfer portion, while the Liquid Line tends to remain near the same location in the primary heat transfer portion. Secondly, the temperature and pressure of the refrigerant in the secondary heat transfer portion of the rotor is higher than the refrigerant in the primary heat transfer portion thereof. Thirdly, the rate of heat transfer to the primary heat exchanging chamber of the engine from the secondary heat transfer portion thereof is substantially equal to the rate of heat transfer from the primary heat transfer portion of the engine into the secondary heat exchanging chamber thereof. Thus, if the primary heat transfer portion of the rotor is absorbing heat at about 12,000 BTUH from the primary heat exchanging circuit, then the secondary heat transfer portion thereof is dissipating about 12,000 BTUH from the secondary heat exchanging circuit.

Figure 12H:
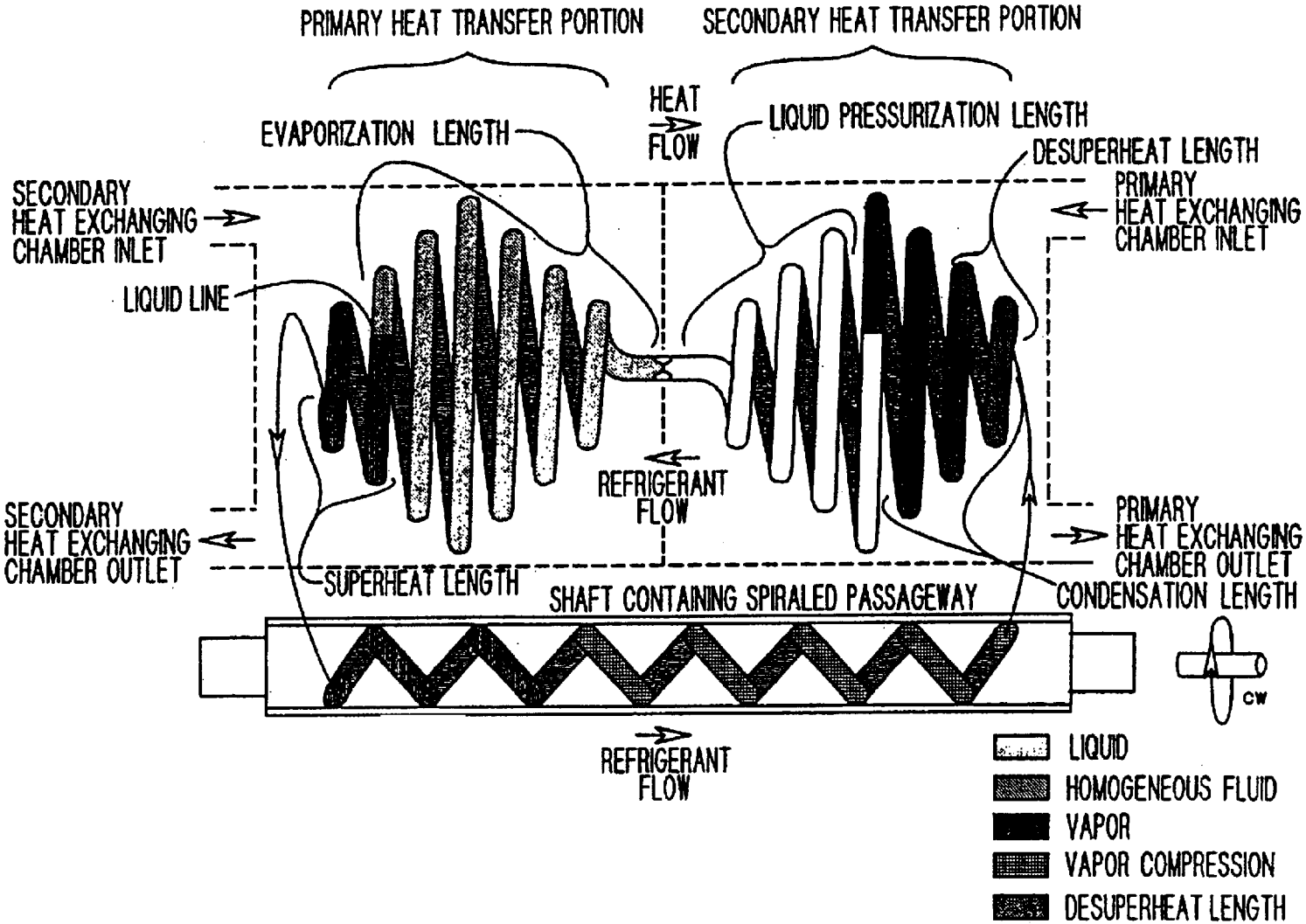
FIG. 12H is a schematic representation of the rotor structure of the heat transfer engine of FIG. 1, showing the physical location of the liquid, homogeneous fluid, vapor and gaseous phases of refrigerant within the rotor structure thereof during the seventh stage of start up operation in the heating mode.
Figure 12I:
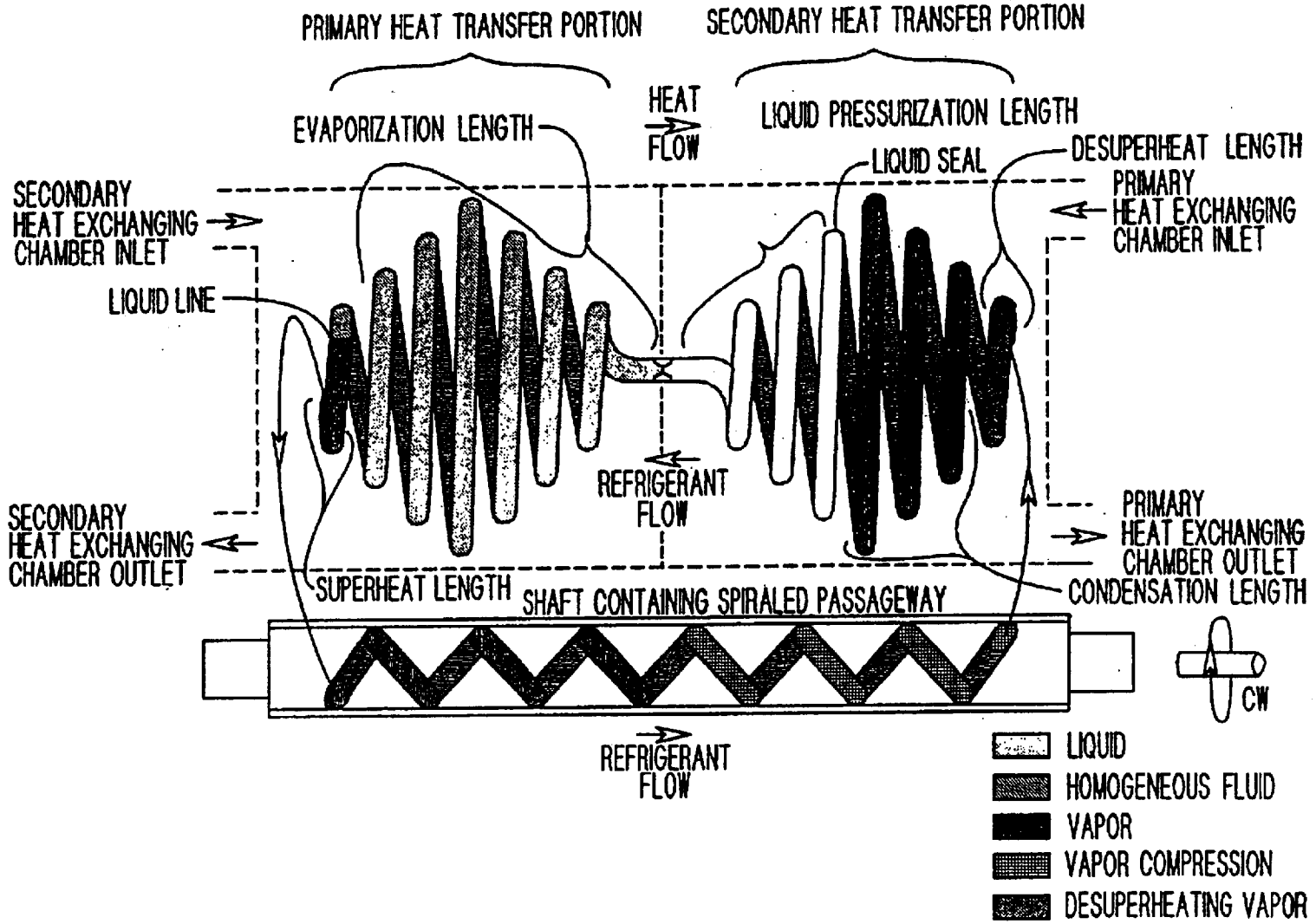
FIG. 12I is a schematic representation of the rotor structure of the heat transfer engine of FIG. 1, showing the physical location of the liquid, homogeneous fluid, vapor and gaseous phases of refrigerant within the rotor structure thereof during the eight (i.e. steady-state) stage of operation in the heating mode.

In FIG. 12H, the heat transfer engine of the present invention is shown operating just below its optimum (low load) operating condition. In FIG. 12I, the heat transfer engine is shown operated excessively beyond its "optimum" operating condition. In this state, the Liquid Seal is located in the secondary heat transfer portion, and even though the Liquid Seal has moved nearer toward the throttling device, the Liquid Pressurization Length is still pressurizing the liquid refrigerant. The demand for heat by the system controller during this state of operation has diminished sufficiently to cause the liquid refrigerant within the rotor to "accumulate" in the primary heat transfer portion thereof. At this stage of operation, the system controller of the engine should be reacting to an increase in temperature in the primary heat exchanging chamber, reducing the RPM of the rotor, and the flow rate controller associated with the primary heat transfer chamber should be starting to reduce the flow rate of the heat exchanging fluid circulating within the secondary heat exchanging chamber.

Applications of First Embodiment of Heat Transfer Engine Hereof

Figure 13:
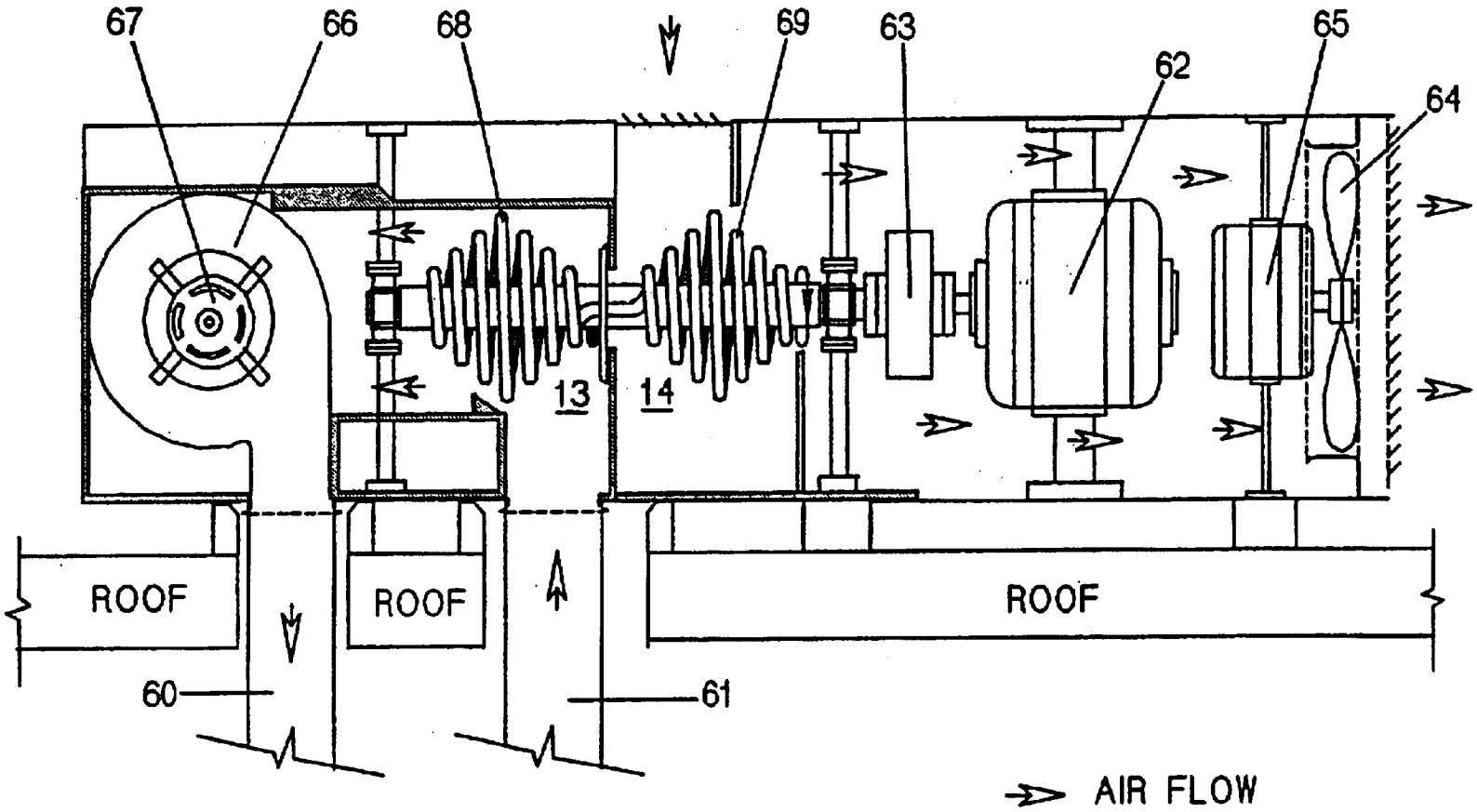
FIG. 13 is an elevated, partially cut-away view of a roof-mounted air-conditioning system, in which the centrifugal heat transfer engine of the first illustrative embodiment is integrated with conventional air return and supply ducts that extend into and out of structural components of a building.

In FIG. 13, the heat transfer engine of the first illustrative embodiment is shown installed on the roof of a building or similar structure, as part of an air handling system which is commonly known in the industry as a Roof-Top or Self-Contained air conditioning unit, or air handler. In this application, the heat transfer engine functions as a roof-top air conditioning unit which can be operated in its cooling mode or heating mode. The term "air conditioning" as used herein shall include the concept of cooling and/or heating of the air to be "temperature conditioned", in addition to the conditioning of air for human occupancy which includes its temperature, humidity, quantity, and cleanliness. As shown, the air handling unit comprises an air supply duct 60 and an air return duct 61, both penetrating structural components of a building. The rotor of the centrifugal heat transfer engine is rotated by a variable-speed electric motor 62. Preferably, the angular velocity of the rotor is controlled by a torque converter or magnetic clutch 63. The primary heat transfer portion of the rotor 68, functioning as the evaporator during the cooling mode, is insulated from the secondary heat transfer position functioning as the condenser. A fan 64, rotated by a variable speed motor 65, is provided for moving atmospheric air over the secondary heat transfer portion of the rotor. A blower wheel 66 inside a blower housing rotated by a variable speed motor 67, is provided for moving air over the primary heat transfer portion of the rotor creating air circulation in the primary heat exchange circuit.

As shown, the air temperature at the inlet of the secondary heat exchanging chamber 14 is sensed by a temperature sensor located in the air flow upstream of the secondary heat transfer portion 69, whereas the air temperature at the outlet thereof is sensed by a temperature sensor located in the air flow downstream from the secondary heat transfer portion 69. The air temperature at the inlet of the primary heat exchanging chamber 13 is sensed by a temperature sensor located in the air flow upstream of the primary heat transfer portion 68, wherein the air temperature at the outlet thereof is sensed by a temperature sensor located downstream from the primary heat transfer portion 68. A simple external on/off thermostat switch 9 can be used to measure temperature T1 and thus start motors 62, 65 and 67 during the heating or cooling mode of operation.

During the cooling mode of operation, the function of the air supply duct 60 is to convey refrigerated (i.e. cooled/conditioned) air from the primary heat transfer portion of the rotor, into the structure (e.g. space to be cooled), whereas the function of the air return duct 61 is to convey air from the structure back to the primary heat transfer portion for cooling. During the heating mode of operation, the direction of the rotor is reversed by torque generator 62, and the function of the air supply duct is to convey heated air from the primary heat transfer portion of the rotor, into the structure (e.g. space to be heated), whereas the function of the air return duct 61 is to convey air from the structure back to the primary heat transfer portion for heating.

Second Illustrative Embodiment of Heat Transfer Engine Hereof

With reference to FIGS. 14A through 15L, the second illustrative embodiment of the heat transfer engine of the present invention will be described in detail.

Figure 14A:
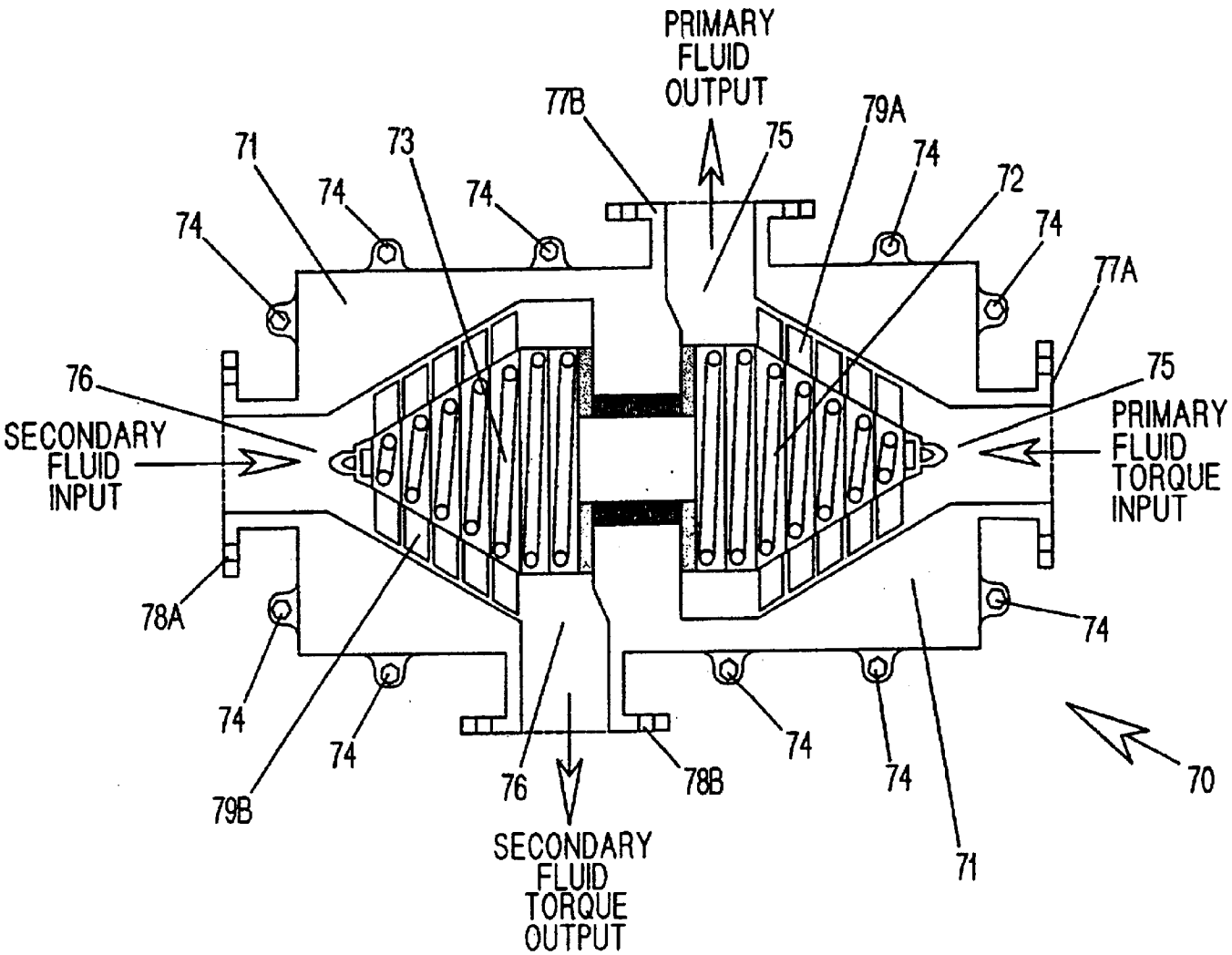
FIG. 14A is an elevated cross-sectional view of the centrifugal heat transfer engine of the second illustrative embodiment of the present invention, showing its fluid-carrying rotor structure rotatably supported in a precasted stator housing having primary and secondary fluid input and outport ports connectable to primary and secondary heat exchanging circuits, respectively, so that heat exchanging fluid cyclically flowing therethrough passes over a multiplicity of turbine blades affixed to the rotor structure and imparts torque thereto in order to maintain the angular velocity thereof in accordance with its temperature-responsive controller.

As shown in FIG. 14A, the heat transfer engine of the second illustrative embodiment 70 comprises a stator housing 71 within which a turbine-like rotor 72 is rotatably supported. As shown, the rotor is realized as a solid rotary structure having a turbine-like geometry. Within the rotor structure, a closed self-circulating fluid-carrying circuit 73 is embodied. As in the first illustrative embodiment, the closed fluid carrying circuit has spiraled primary and secondary tubular heat transfer passageways, and a metering device which will be described in greater detail. However, unlike the first illustrative embodiment, these passageways are molded and/or machined in substantially similar disks of different diameters that are stacked and fastened together to form a unity structure. As shown, heat transfer fins are added to each of the disks in order to (1) increase the secondary heat transfer surface areas thereof and (2) provide a means of systematic fluid circulation.

Figure 14B:
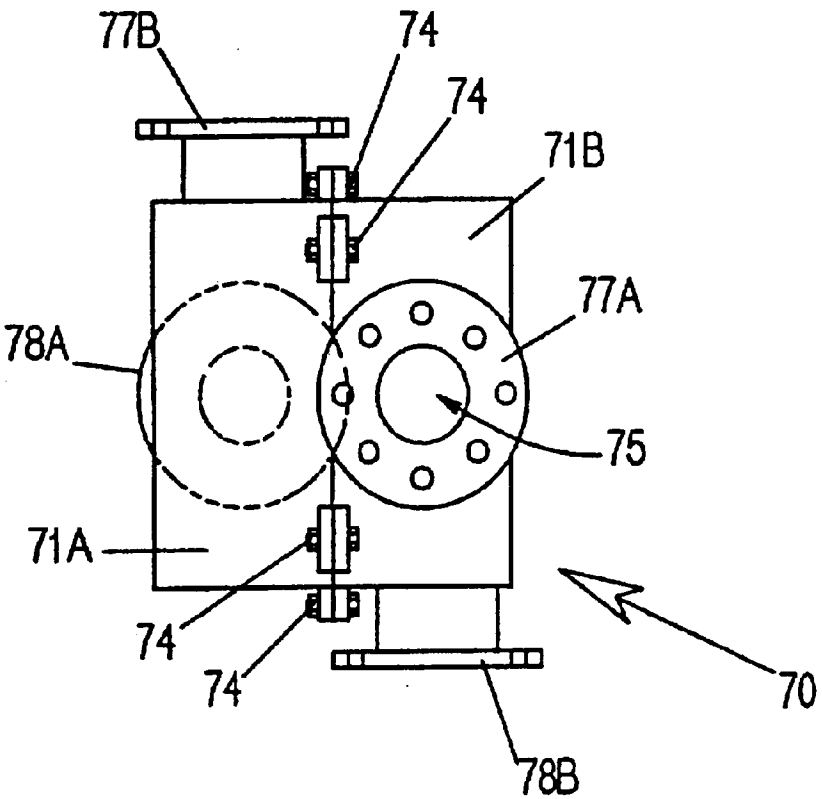
FIG. 14B is an elevated end view of the centrifugal heat transfer engine of FIG. 14A, showing flanged fluid conduit connections for connection to primary and secondary heat exchanging circuits.
Figure 20:
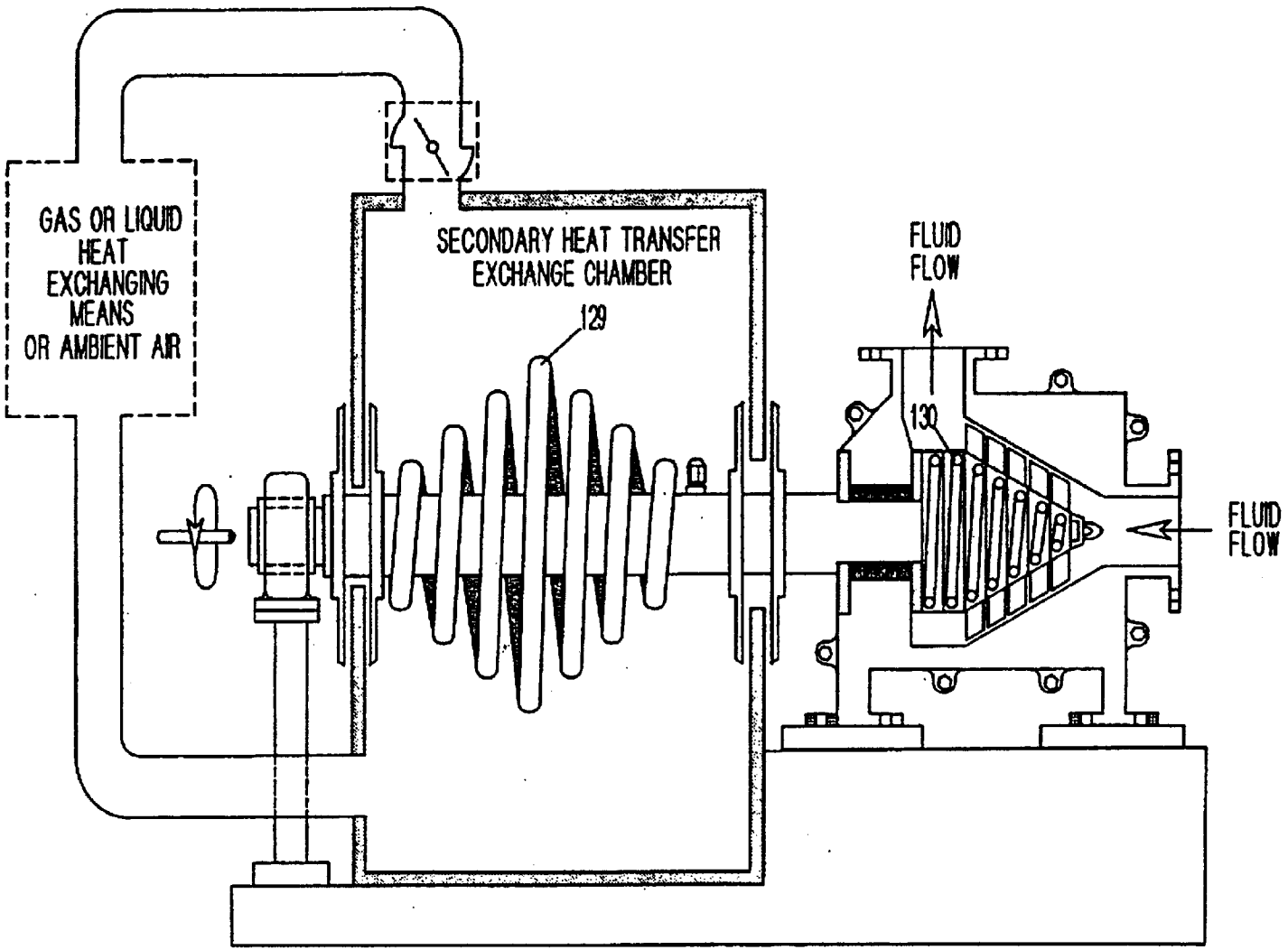
FIG. 20 is a schematic diagram of a hybrid heat transfer engine, in which the primary heat transfer portion of the rotor is realized as coiled structure mounted on a common shaft and contained within a primary heat transfer chamber of the coiled heat transfer engine of the first illustrative embodiment, whereas the secondary heat transfer portion of the rotor is realized as a turbine-like finned structure mounted on the common shaft and contained with a secondary heat transfer chamber of the turbine-like heat transfer engine of the second illustrative embodiment, shown operated in its cooling mode.

As shown in FIG. 14B, the stator assembly 70 comprises a pair of split-cast housing halves 71A and 71B which are machined to form the fluid flow circuit, and bolted together with bolts 74. As shown, the stator housing has primary and secondary heat exchanging chambers 75 and 76, within which the primary and secondary portions of the heating exchanging rotor are housed. In order that primary and secondary heat exchanging circuits can be appropriately (i.e. thermally) coupled to the primary and secondary heat exchanging chambers of the stator housing, respectively, flanged fluid piping couplings (i.e. port connections) 77A and 77B and 78A and 78B are provided to the input and output ports of the primary and secondary heat exchanging chambers of the stator housing, respectively, as shown in FIGS. 14A, 14B and 20. Conventional fluid carrying pipes with flanged fittings can be easily connected to these flanged port connections. As shown, when a pressurized heat exchanging fluid (flowing within primary heat exchanging circuit) is provided at the input port 77A of the primary heat exchanging chamber, it will flow over turbine fins 79A on the primary heat exchanging portion of the rotor, impart torque thereto, and thereafter flow out the output port 77B of the primary heat exchanging chamber. Similarly, when a pressurized heat exchanging fluid flowing within the secondary heat exchanging circuit is provided at the input port 78A of the secondary heat exchanging chamber, it will flow over turbine fins 79B on the secondary heat exchanging portion of the rotor, impart torque thereto, and thereafter flow out the output port 78B of the secondary heat exchanging chamber. Understandably, the flow of heat exchanging fluid into the input ports of the primary and secondary heat exchanging chambers of the stator housing will be such that each such fluid flow imparts torque to the rotor shaft in a cooperative manner, to perform positive work. As will be shown hereinafter, the angular velocity of the rotor can be controlled in a number of different ways depending on the application at hand.

Referring now to FIGS. 15A through 15L, the structure of the rotor of the second illustrative embodiment will be described in greater detail.

Figure 15A:
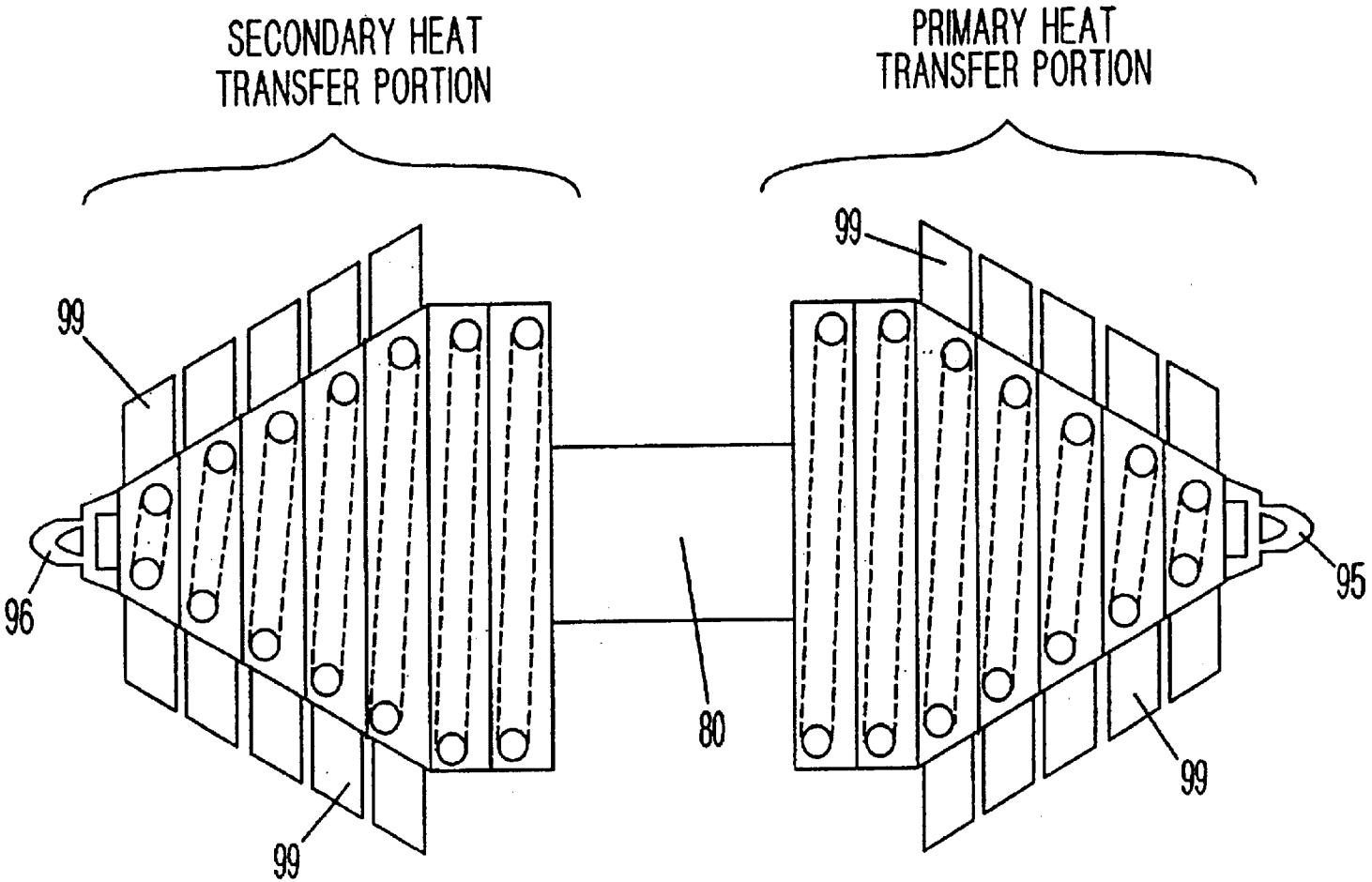
FIG. 15A is an elevated transparent side view of the rotor structure of the heat transfer engine shown in FIGS. 14A and 14B, removed from its stator housing, showing spiraled geometric similarities between the primary and secondary heat transfer portions of the heat transfer engine of first illustrative embodiment shown in FIG. 1 and the primary and secondary heat transfer portions of the heat transfer engine of the second illustrative embodiment shown in FIGS. 14A and 14B.
Figure 15C:
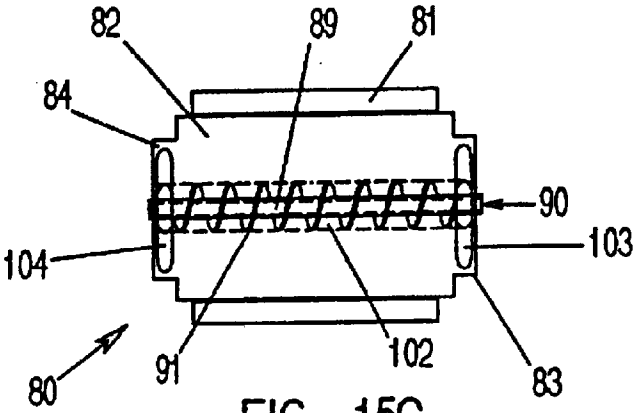
FIG. 15C is an elevated side view of the spiraled suction screw and throttling device orifice of the rotor structure of the heat transfer engine of the second illustrative embodiment.
Figure 15B:
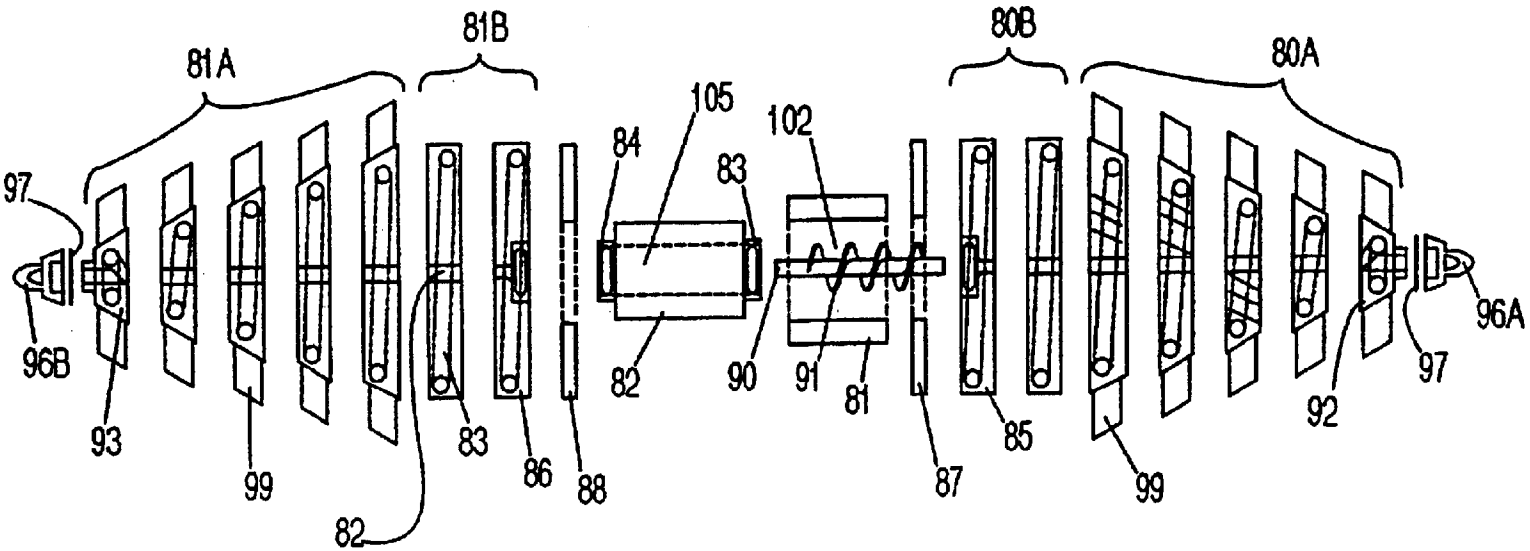
FIG. 15B is an elevated exploded view of the fluid-circulating rotor structure of the second illustrative embodiment shown in FIGS. 14A and 14B, removed from its stator housing, showing how the precasted rotor disc structures are joined together to provide an integral structure within which a self-circulating closed fluid circuit is formed and how the suction shaft screw and throttling device orifice are inserted into the rotor shaft assembly.

As shown in FIGS. 15A, 15B, and 15C the primary heat exchanging portion of the rotor comprises a first set of rotor disks 80A having radially varying outer diameters and a second set of rotor disks 80B having radially uniform outer diameters. Similarly, the secondary heat exchanging portion of the rotor comprises a first set of rotor disks 81A having radially varying outer diameters and a second set of rotor disks 81B having radially uniform outer diameters. As shown in FIG. 15B, each of these rotor disks has a central bore 82 of substantially the same diameter, and a small section of the fluid flow circuit (i.e. passageway) 83 machined, molded or otherwise formed therein. The exact geometry of each section of fluid flow passageway within each rotor disc will vary from rotor disk to rotor disk. However, these sections of fluid flow passageways combine over the length of the rotor to form the greater portion of the closed fluid flow circuit 83 embodied within the rotor structure of the second illustrative embodiment.

As shown in FIGS. 15A, 15B, and 15C the central bearing structure 80 of the rotor comprises an assembly of subcomponents, namely: an outer cylindrically-shaped bearing sleeve 81 for rotational support within a suitable support structure provided within the stator housing; an inner fluid flow cylinder 82 of substantially cylindrical geometry adapted to be received within bearing sleeve 81, having first and second disc-receiving collars 83 and 84 of reduced diameter adapted for receipt by inner rotor disc 85 and 86, respectively; a pair of thrust plates 87 and 88 having inner central bores with diameters slightly greater than the outer diameter of the inner fluid flow cylinder; and a inner fluid flow tube 89 having a inner bore 90 extending along its entire length, and a spirally-extending flange 91 formed on the exterior surface thereof, for directing return refrigerant. As will be described in greater detail hereinafter, the central portion of the rotor functions not only as a rotor bearing structure, but also as (i) the refrigerant metering (i.e. throttling) device of the rotor and (ii) a fluid flow return passageway. In order to understand how the subcomponents of the central portion of the rotor are interconnected and cooperate to carry out the functions of the rotor, it is necessary to first describe the finer details of this portion of the rotor structure.

Figure 15D:
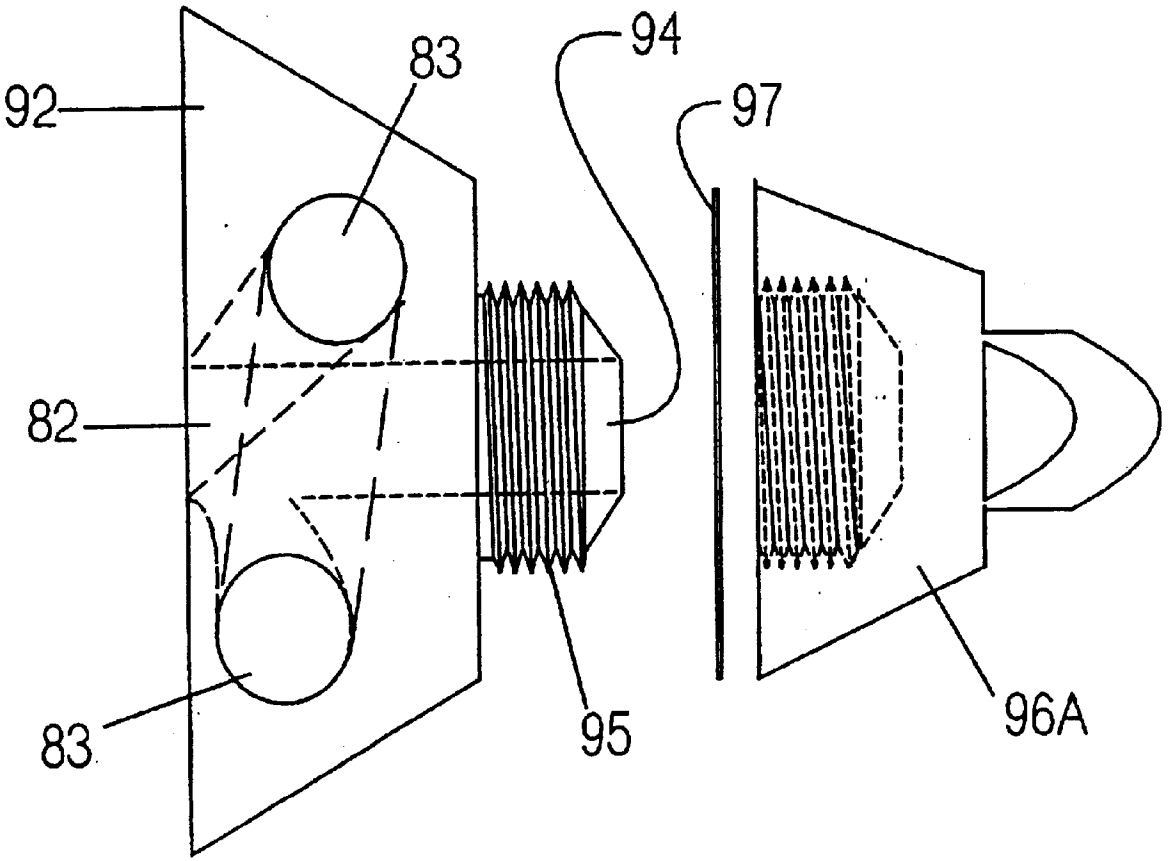
FIG. 15D is a side view of the threaded port cap and gasket being fitted on the charging end of the rotor structure of the heat transfer engine of the second illustrative embodiment of the present invention.

As shown in FIGS. 15B and 15D, the endmost turbine disks 92 and 93 have machined within their plate or body portion, a section of fluid flow passageway 82 which extends from a direction substantially perpendicular to the rotor axis of rotation, to a direction substantially co-parallel with the rotor axis. These sections of closed fluid flow circuit allow refrigerant to flow continuously from the linear portion thereof to the spiral portions thereof. Also, in order that refrigerant can be added or removed from the fluid flow circuit of the rotor, each end turbine disk is provided with a charging port 94 which is in fluid communication with its central bore 82. As shown, the end of turbine disc 92 and 93 have exterior threads 95 which are received by matched interior threads on charging port caps 96A and 96B which can be easily screwed onto and off the charging ports of these rotor discs. To prevent refrigerant leakage, a seal 97 is provided between each charging port cap and its end rotor disc, as shown.

As shown in FIGS. 15B, 15E, 15F, and 15G, each turbine disc set, 80A and 81A, carries a plurality of turbine-like fins 99 for the purpose of imparting torque to the rotor when heat exchanging fluid flows thereover while flowing through the heat exchanging chambers of the engine. In general, the shape of these fins will be determined by their function. For example, in particular embodiments where water flow is used to rotate the rotor within the stator housing, the fins will have 3-D surface characteristics which aid in imparting hydrodynamically generated torque to the rotor during engine operation. In order to mount these fins to the rotor discs, each fin has a base portion 100 which is designed to be received within a mated slot 101 formed in the outer end surface of each rotor disc. Various types of techniques may be employed to securely retain these turbine-like fins within their mounting slots.

Figure 15G:
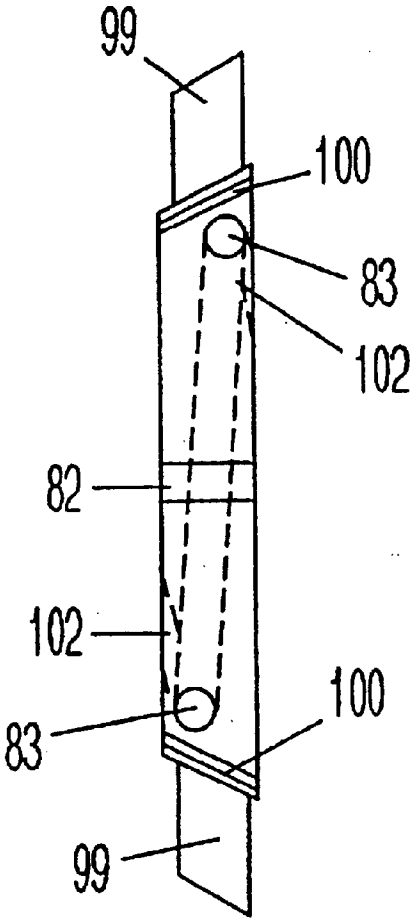
FIG. 15G is an elevated side view of a vaned rotor disc of the rotor of the heat transfer engine of FIGS. 14A and 14B, showing its turbine vanes, and a machined fluid passageway portion formed in the rotor structure thereof.
Figure 15F:
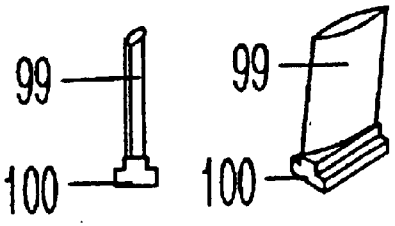
FIG. 15F is two elevated views of a turbine vane of the heat transfer engine of the second illustrative embodiment, showing the vane base and illustrating a possible blade surface configuration.
Figure 15E:
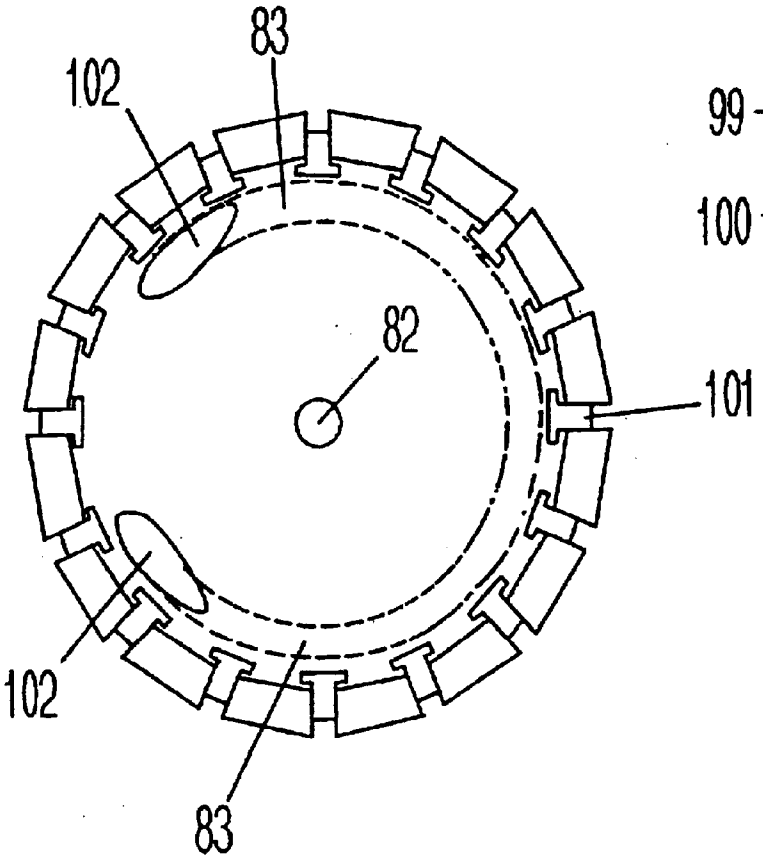
FIG. 15E is an elevated end view of a vaned rotor disk of the second illustrative embodiment, showing a spiraled portion of the fluid carrying circuit formed therein and the turbine vane slots machined in the surfaces thereof.
Figures 15H, 15I, 15J, 15K:
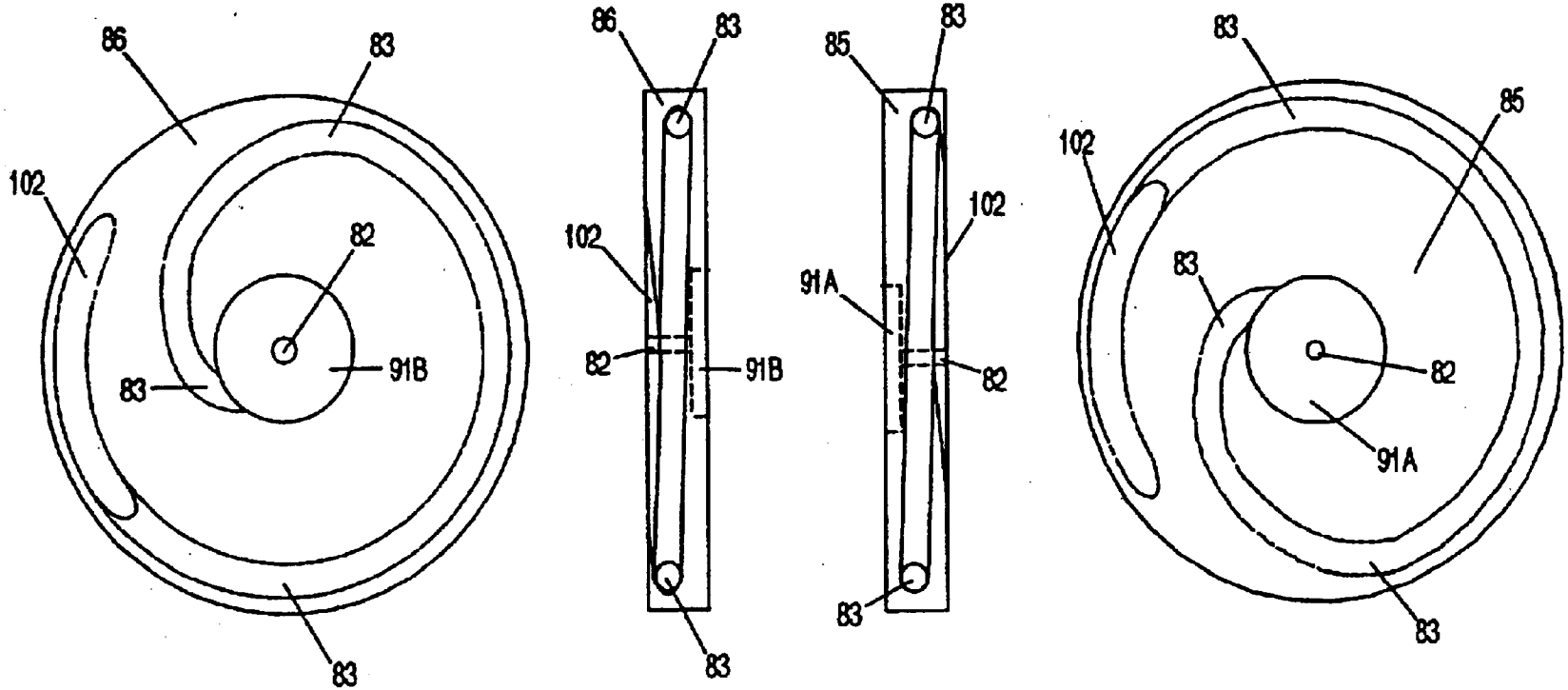
FIG. 15H is an elevated end view of the first end rotor disk of the secondary heat transfer portion of the rotor shown in FIG. 15B, showing its spiraled portion of the fluid carrying circuit formed therein.
FIG. 15I is an elevated, side view of the first rotor end disc of the secondary heat transfer portion of the rotor shown in FIG. 15B.
FIG. 15J is an elevated end view of the first rotor end disc of the primary heat transfer portion of the rotor of FIG. 15B, showing its spiraled portion of the fluid carrying circuit formed therein.
FIG. 15K is an elevated side view of the first rotor end disc of the primary heat transfer portion of the rotor of FIG. 15B, showing its spiraled portion of the fluid carrying circuit formed therein.
Figure 15L:
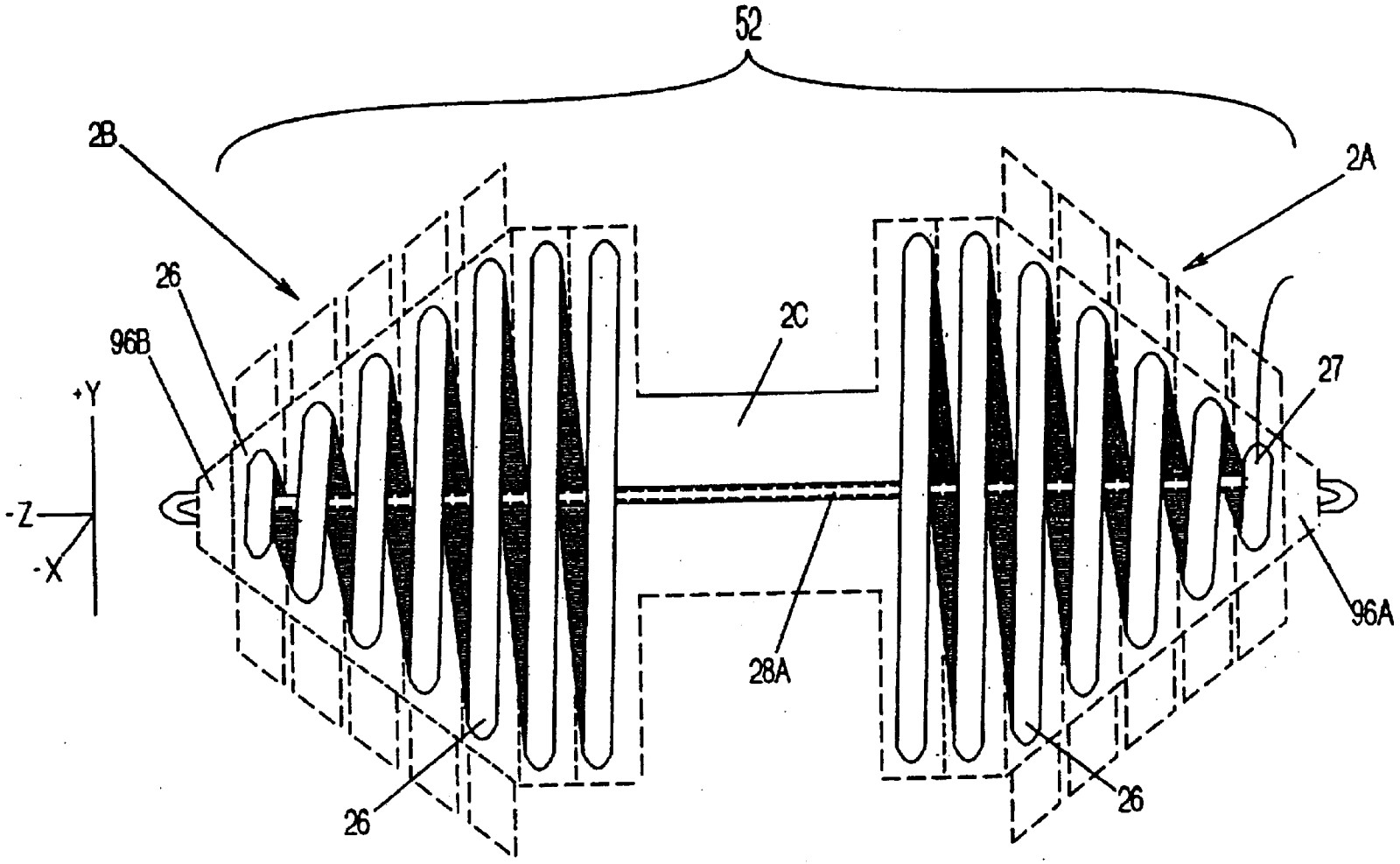
FIG. 15L is an elevated transparent side view of the fluid-carrying rotor structure of the second illustrative embodiment of the heat transfer engine hereof, shown removed from the stator portion thereof with the closed fluid carrying circuit embedded within a heat conductive, solid-body rotor structure.

As best shown in FIGS. 15E and 15G, the section of fluid flow passageway machined in the planar body portion of each rotor disk will vary in geometrical characteristics, depending on the location of the rotor disc along the rotor axis. As shown, the fluid flow passageway 83 in each rotor disk extends about the center of the rotor disc. Notably, rotor discs 85 and 86 are structurally different than the other discs comprising the heat exchanging portions of the rotor of the second illustrative embodiment. As shown in FIGS. 15H through 15K, inlet and outlet rotor discs 85 and 86 are machined so that during the cooling mode, refrigerant in vapor state is transported from the first heat exchanging portion of the rotor to the second heat exchanging portion thereof by way of the spiraled passageway 102, and during the heating mode, vapor refrigerant is transported in the reverse flow direction through the central portion of the rotor. In order to achieve such fluid flow functions, the section of fluid passageway in rotor disks 85 and 86 must extend radially inward towards enlarged central recesses 91A and 91B respectively, which are adapted to receive the end of cylindrical flanges 83 and 84 of fluid flow cylinder 80 shown in FIG. 15B. Like all other rotor disks, inlet and outlet rotor disks 85 and 86 have central bores 82 which are aligned with the central bore of the other rotor disks in the rotor structure.

As best shown in FIGS. 15B and 15C, the inner fluid flow cylinder 80 has an axial bore machined, or otherwise drilled and formed, along its longitudinal extent. Also, fluid flow openings 103 and 104 are formed in the cylindrical flange structures 83 and 84, respectively, extending from the end portions of the inner fluid cylinder. Preferably, the inner diameter of the axial bore 105 formed through outer fluid flow cylinder 82 is about 0.002 inches smaller than the outer diameter of the inner fluid flow tube 89 which carries the spirally extending flange 91. Thus when the inner fluid flow tube 89 is installed within the outer fluid flow cylinder 82, as shown in FIG. 15C, a thin, annular-shaped fluid flow channel 102 is formed therebetween along the entire length thereof. Thus, when subcomponents of the rotor central portion are completely assembled, the following relations are established. First, the fluid flow openings 103 and 104 in the flanges of outer fluid flow cylinder 82 are aligned with the terminal portions of the section of the fluid flow passageway in inlet and outlet rotor discs 85 and 86 (i.e. at the circumferential edge of circular recess 91A and 91B formed in these disc sections). Then the annular-shaped fluid flow channel 102 places the portion of the fluid flow circuit along the first heat exchanging portion of the rotor in fluid communication with the portion of the fluid flow circuit along the second heat exchanging portion of the rotor. Ultimately, fluid flow continuity is established between the end rotor discs 92 and 93 along the rotor axis by the linear flow passageway 82 that is realized by the piecewise assembly of the central bores formed in each rotor disc and the bore 90 formed through inner fluid flow tube 89 in the central portion of the rotor. The above-described structural features of the rotor of the second illustrative embodiment ensures continuity along the entire fluid flow passageway within the closed fluid flow circuit embodied within the rotor.

As will be described in greater detail hereinafter, the section of fluid flow passageway 90 passing through the inner fluid flow tube 89 functions as a bidirectional throttling (i.e. metering) device within the rotor, as it serves to effectively restrict the flow of refrigerant passing therethrough by virtue of its length and inner diameter characteristics. Based on the refrigerant used within the rotor and expected operating pressure and temperature conditions, the length and inner diameter dimensions of the linear flow passageway through the inner fluid flow tube (i.e. throttling channel) can be selected so that the required amount of throttling is provided within the closed fluid circuit during engine operation. For example, assuming it is desired to design one-quarter horsepower (¼ HP) heat transfer engine with a capacity of 11,310 BTUH, and the linear length of the throttling channel is about four (4) inches, then assuming a rotor operating temperature of about 50° F. and pressure of about 84 PSIG (pounds per square inch gauge) utilizing monochlorofluoromethane refrigerant (R22), the diameter of throttling channel will need to be about 0.028 inches. Depending on the total internal volume of the self-circulating fluid flow circuit within the rotor, the total refrigerant charge required can be as little as 1.5 pounds of liquid refrigerant for small capacity systems, to hundreds of pounds of liquid refrigerant for larger capacity systems. As the number of rotor disks is increased, the total internal volume of the closed fluid flow circuit will be increased, and so too the amount of refrigerant that must be charged into the system. In principle, the rotor structure described above can be made using virtually any number of rotor disks. It is understood, however, that the number of rotor disks used will depend, in large part, on the thermal load requirements (tonnage in BTUH) which must be satisfied in the application at hand.

FIG. 15A shows the assembled rotor structure of the second illustrative embodiment removed from within its stator. This figures shows the secondary heat transfer portion, primary heat transfer portion, the rotor shaft 80, the rotor fins 99, and charging ports 95 and 96 of the rotor. The assembly of the rotor structure of the second illustrative embodiment may be achieved in a variety of ways. For example, once assembled in their proper order and configuration, the rotor disks can be welded together and thus avoid the need for pressure/liquid-seals (e.g. gaskets), or bolted together and thus require the need for seals or gaskets. In alternative embodiments, portions of the rotor structure may be realized using casted parts which can be assembled together using welding and/or bolting techniques well known in the art.

Heat Transfer Process of the Second Embodiment

Referring to FIGS. 16A to 16HF, the refrigeration process of the present invention will now be described with the heat transfer engine of the second illustrative embodiment in its cooling mode of operation. Notably, each of these drawings schematically depicts, from a cross-sectional perspective, both the first and second heat exchanging portions of the rotor. This presentation of the internal structure of the closed fluid flow passageway throughout the rotor provides a clear illustration of both the location and the state of the refrigerant along the closed fluid flow passageway thereof. As will be apparent hereinafter, the heat transfer engine turbine of the second illustrative embodiment, like the heat transfer engine of the first embodiment, accomplishes a refrigeration affect through the sub-processes of throttling, evaporation, superheating, vapor compression, desuperheating, condensation, liquid seal formation and liquid pressurization in the same order except using the turbine-like rotor structure described above.

Figure 16A:
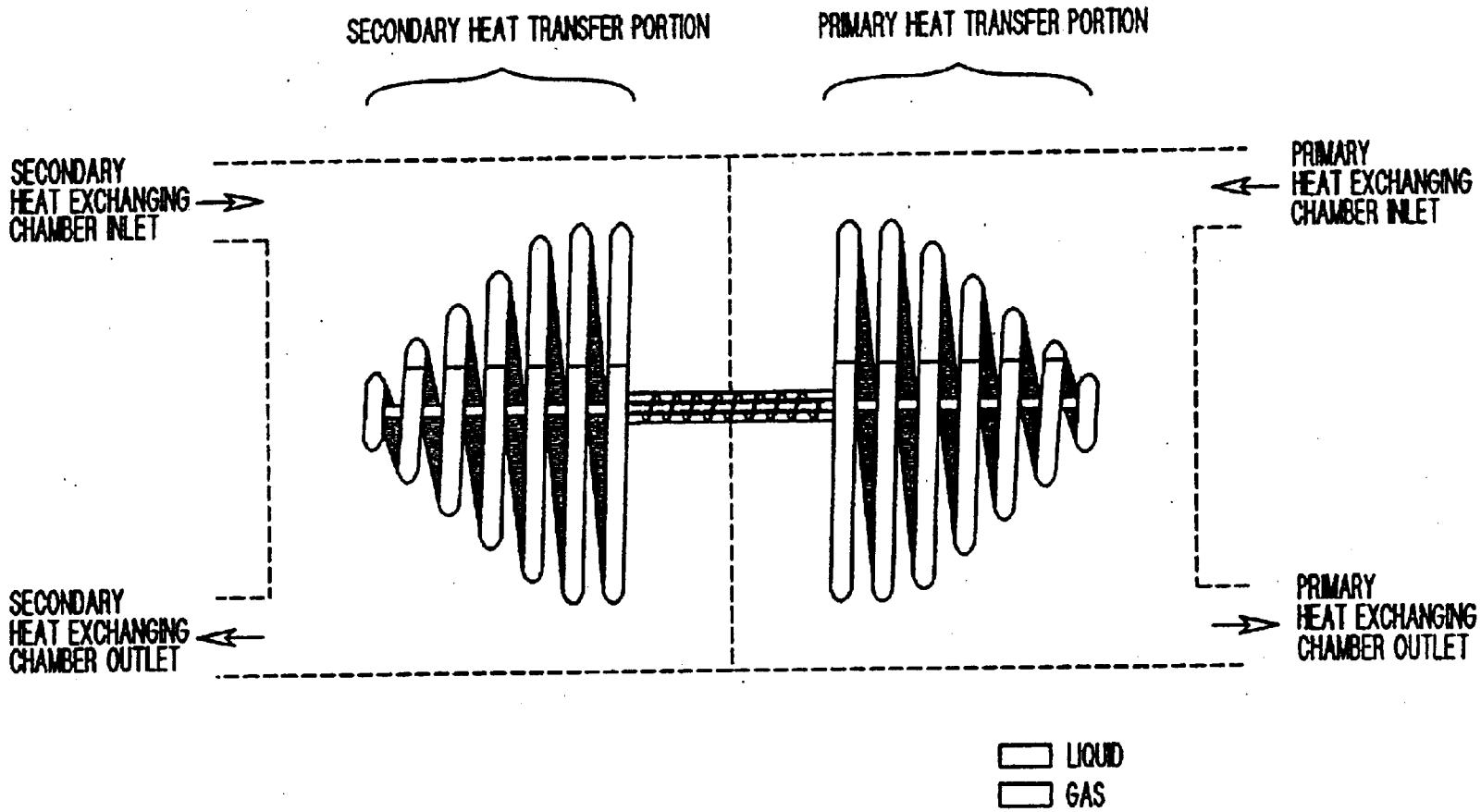
FIG. 16A is a schematic representation of the rotor structure of the heat transfer engine of FIGS. 14A and 14B, showing the physical location of the liquid and gaseous phases of refrigerant within the rotor structure thereof when the heat transfer engine hereof is at rest prior to entering its cooling mode.

In FIG. 16A, the rotor is shown at its rest position, which is indicated by the absence of any rotational arrow about the rotor shaft. At this stage of operation, the internal volume of the closed fluid circuit is occupied by about 65% of refrigerant in its liquid state. The entire spiral return passageway along the rotor shaft is occupied with liquid refrigerant, while the heat exchanging portions of the rotor are occupied with liquid refrigerant at a level set by gravity in the normal course. No throttling of liquid into refrigerant vapor occurs at this stage of operation. The portion of the fluid passageway above the liquid level in the rotor is occupied by refrigerant in a gaseous state. The closed fluid flow passageway is thoroughly cleaned and dehydrated prior to the addition of the selected refrigerant to prevent any contamination thereof.

Figure 16B:
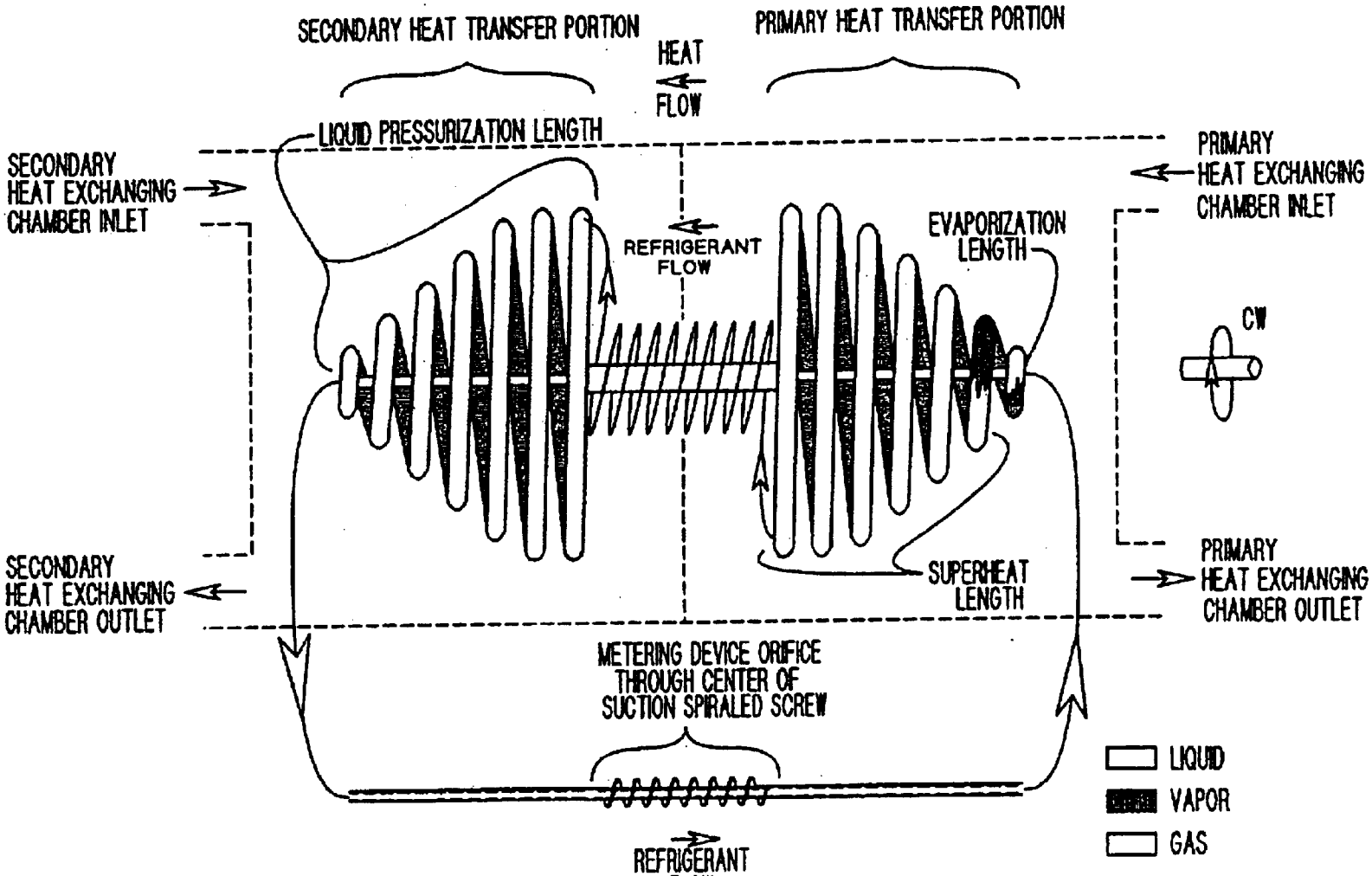
FIG. 16B is a schematic representation of the rotor structure of the heat transfer engine of FIGS. 14A and 14B, showing the physical location of the liquid, gaseous and vapor phases of refrigerant within the rotor structure during the first few revolutions thereof during the first stages of start up operation in the cooling mode.

As shown in FIG. 16B, the rotor is rotated in a clockwise (CW) direction within the stator housing of the heat transfer engine. At this stage of operation, the liquid refrigerant within the spiraled passageway of the shaft begins to flow into the secondary heat transfer (i.e. exchanging) portion of the rotor and occupies substantially the entire volume thereof. At this start-up stage of operation, throttling of liquid refrigerant into vapor refrigerant begins to occur across the throttling channel bore 90 inside the rotor. While the rotor continues to rotate in a clockwise (CW) direction with increasing angular velocity, the Liquid Seal moves towards the secondary heat transfer portion, while refrigerant flowing into the primary heat transfer portion of the rotor is restricted by the throttling channel and thus liquid refrigerant accumulates within the secondary heat transfer portion thereof. At this stage of operation, very little refrigerant flows into the primary heat transfer portion of the rotor, and thus no refrigeration affect has yet taken place. The small amount of refrigerant vapor present in the primary heat transfer portion of the rotor will acquire some Superheat which, as a result of the Liquid Seal, will be retained in the vapor and gaseous refrigerant in the primary heat transfer portion of the rotor.

Figure 16C:
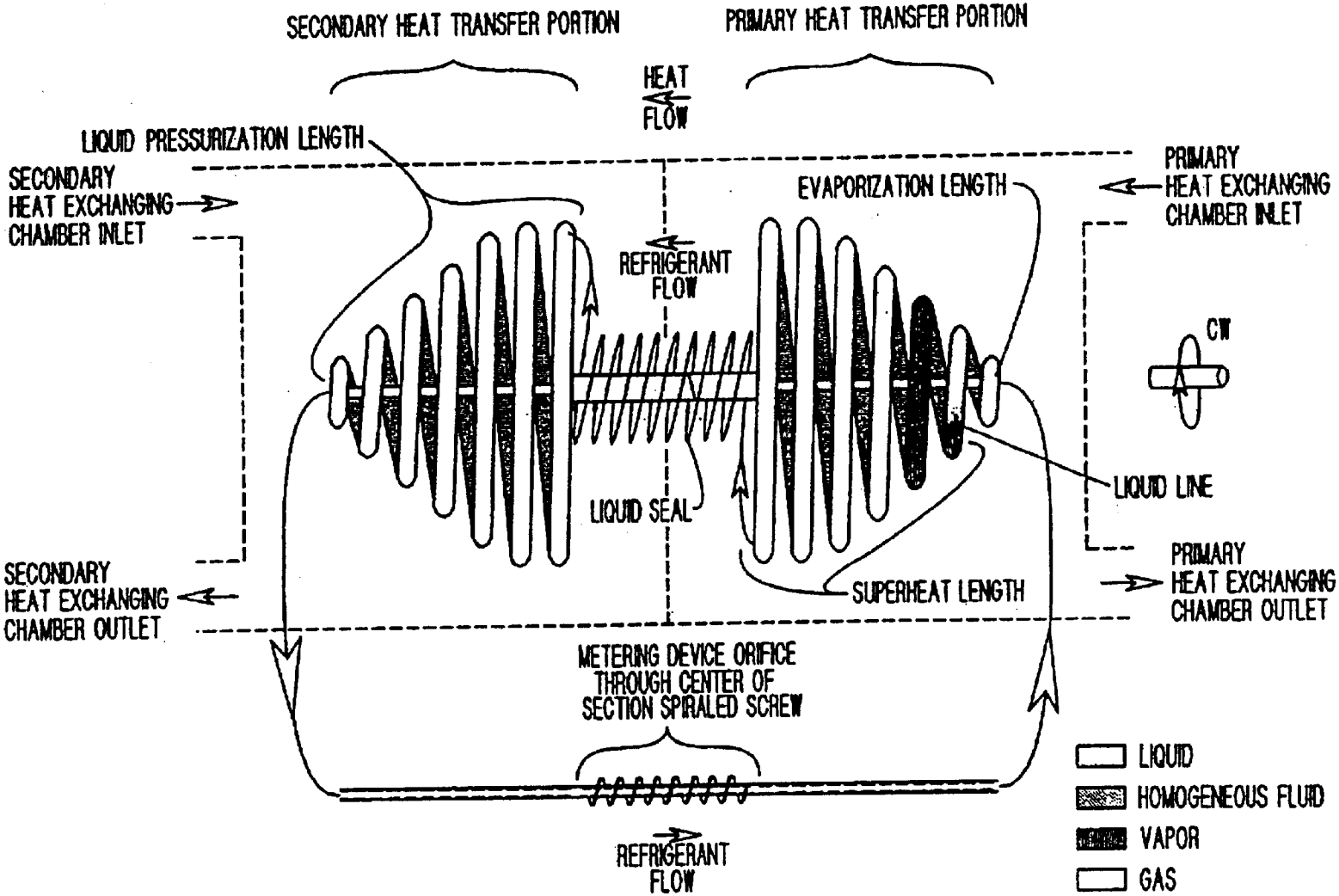
FIG. 16C is a schematic representation of the rotor structure of the heat transfer engine of FIGS. 14A and 14B, showing the physical location of the liquid, homogeneous fluid, vapor and gaseous phases of refrigerant within the rotor structure during the second stage of start up operation in the cooling mode.

As shown in FIG. 16C, the rotor continues to increase in angular velocity in the CW direction. At this stage of operation, the Liquid Pressurization Length of the refrigerant begins to create enough pressure within the secondary heat transfer portion of the rotor to overcome the pressure restriction presented by the throttling channel, and thus liquid refrigerant begins to flow into the primary heat transfer portion of the rotor. As shown in FIG. 16C, the Liquid Seal has moved along the rotor shaft towards the secondary heat transfer portion of the rotor thereof. At this stage of operation, refrigerant beyond the throttling channel and extending into about the first spiral of fluid flow passageway within the primary heat transfer portion, is in the form of a homogeneous fluid (i.e. a mixture of refrigerant in both its liquid and vapor state). The homogeneous fluid entering the primary heat transfer portion of the rotor "displaces" the gaseous refrigerant therewithin, thereby pushing it downstream into the spiraled passageway of the rotor shaft. Sufficient throttling of liquid refrigerant into vapor occurs causing a sufficient temperature drop in the primary heat transfer portion of the rotor and thus causing transfer of Superheat into the gaseous refrigerant. A "cooler" vapor created by the throttling process of enters the primary heat transfer portion of the rotor and begins to absorb more Superheat. Refrigerant gas and vapor are compressed between (i) the homogeneous fluid in the primary heat transfer portion and (ii) the Liquid Seal formed along the spiraled fluid flow passageway of the rotor shaft.

Figure 16D:
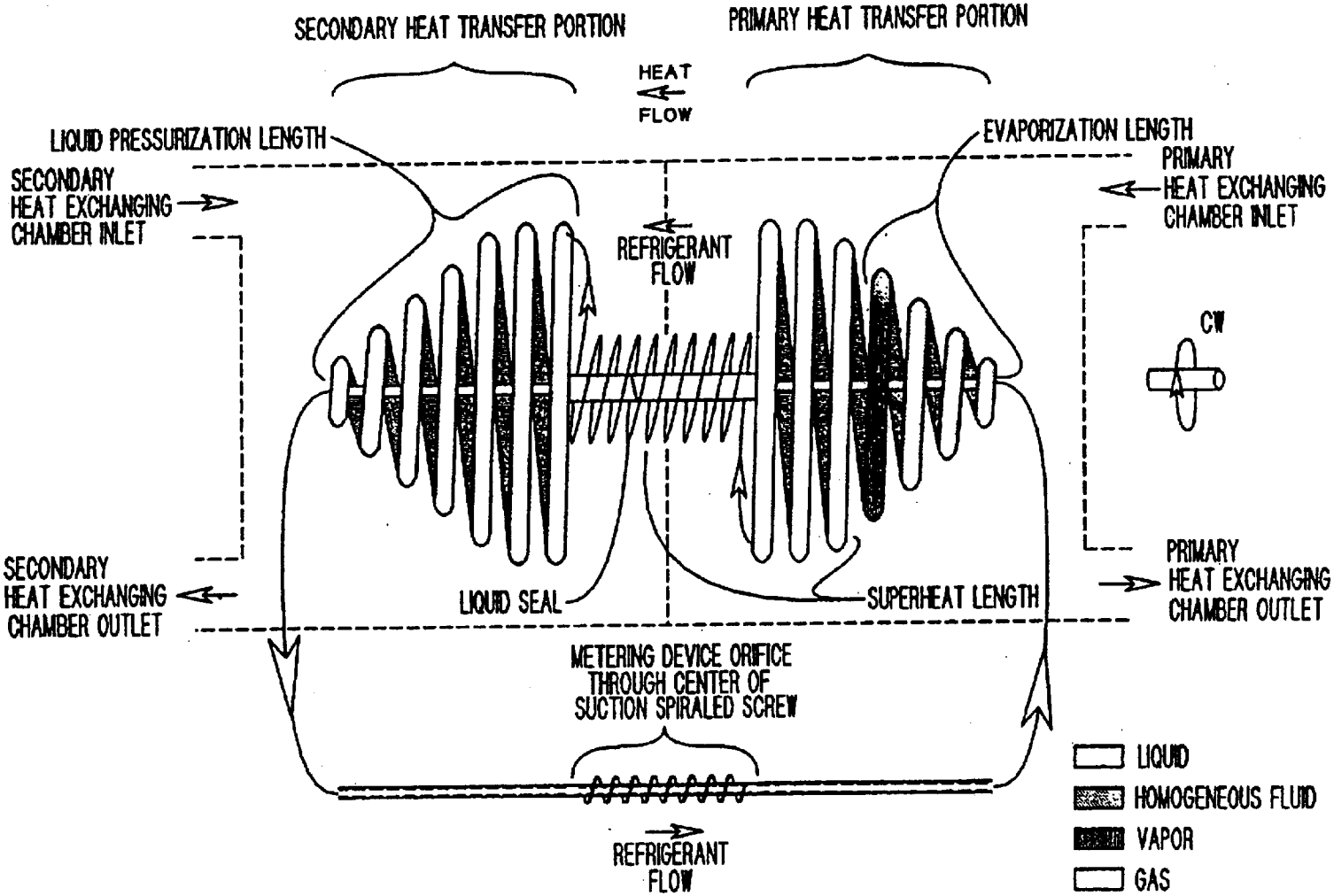
FIG. 16D is a schematic representation of the rotor structure of the heat transfer engine of FIGS. 14A and 14B, showing the physical location of the liquid, homogeneous fluid, vapor and gaseous phases of refrigerant within the rotor structure when vapor compression begins within the heat transfer engine during the third stage of start up operation in its cooling mode.
Figure 16E:
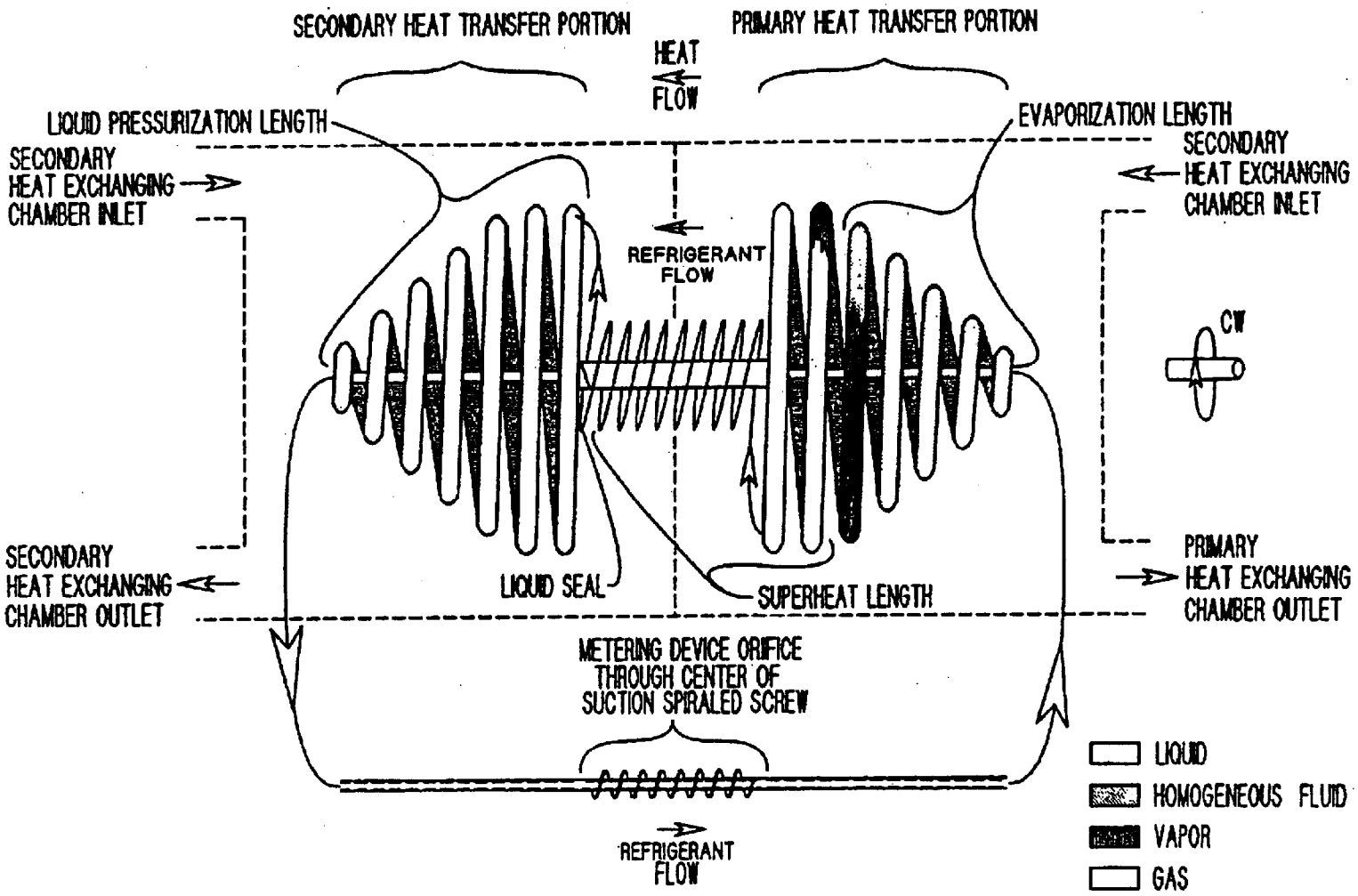
FIG. 16E is a schematic representation of the rotor structure of the heat transfer engine of FIGS. 14A and 14B, showing the physical location of the liquid, homogeneous fluid, vapor and gaseous phases of refrigerant within the rotor structure during the fourth stage of start-up operation in its cooling mode.

Notably, at the stage of operation shown in FIG. 16C, there is only enough pressure in the secondary heat transfer section of the rotor to cause a minimal amount of liquid refrigerant to flow into the primary heat transfer portion thereof, and thus only slight throttling (i.e. evaporation) of liquid refrigerant into vapor occurs. At this stage, some vapor is beginning to form downstream in the primary heat transfer portion of the rotor; however, this is really "flash" gas produced from the throttling process. Consequently, at this stage of operation, the only heat being absorbed by the refrigerant is Superheat in the Superheat Length of the refrigerant stream, and thus refrigeration has only begun to occur. At this stage of the heat transfer process, a Liquid Line is formed in where the homogeneous fluid ends and the vapor begins along the length of the primary heat transfer portion. As illustrated in FIGS. 16C through 16E, the Liquid Line can occupy (i.e. manifest itself along) a short length of the primary heat transfer portion as a mixture of homogeneous fluid and a very dense vapor which extends downstream to the Superheat Length. The exact location of the Liquid Line along the primary heat transfer portion of the rotor will vary depending on the quantity of homogeneous fluid therein, which will be proportional to the amount of heat being absorbed and the thermal load imposed on the primary heat transfer portion of the rotor.

As the rotor continues to increase its angular velocity in the clockwise (CW) direction towards steady state speed, as shown in FIG. 16D, the amount of refrigerant vapor in the primary heat transfer portion increases due to increased throttling and production of "Flash" gas as a result of the same. The effect of this vapor increase is an increase in the quantity of homogeneous fluid entering the primary heat transfer portion of the rotor. At this stage of the process the Liquid Seal has moved even further along the rotor shaft towards the secondary heat transfer portion. Also, less liquid refrigerant occupies the spiraled passageway of the rotor shaft, while more homogeneous fluid occupies the primary heat transfer portion of the rotor. As indicated, at this stage of operation, the direction of heat flow (i.e. in the form of Superheat) is from the primary heat transfer portion of the rotor to the secondary heat transfer portion thereof. However at this stage of operation, this heat flow is trapped behind the Liquid Seal formed along the spiraled passageway of the rotor shaft.

As the rotor continues to further increase angular velocity in the clockwise (CW) direction towards its steady state speed as shown in FIG. 16E, the quantity of refrigerant vapor within the primary heat transfer portion of the rotor continues to increase due to the increased production of flash gas from throttling of liquid refrigerant across the throttling channel. During this stage of operation, the Liquid Seal has moved towards the end of the rotor shaft and the secondary heat transfer portion inlet thereof. Also, the flow of heat (i.e. in the form of Superheat) from the primary heat transfer portion is still trapped behind the Liquid Seal in the spiraled passageway of the rotor shaft. Consequently, the Superheat from the primary heat transfer portion of the rotor is unable to pass onto the secondary heat transfer portion of the rotor. Consequently, optimal operation is not yet achieved at this stage of engine operation. During this stage of operation some heat (Superheat) may transfer into the rotor shaft from the refrigerant vapor if the shaft temperature is less that the temperature of the refrigerant vapor; and some heat may transfer into the refrigerant vapor if the refrigerant vapor temperature is less than that of the rotor shaft.

The rotor shaft and its internal spiraled passageway provide primary and secondary Superheat transfer surfaces where heat can be either absorbed into or discharged from the vapor stream circulating within the closed fluid flow circuit of the rotor. Heat produced by friction from the rotor shaft bearings is absorbed by the refrigerant vapor along the length of the rotor shaft and can add to the amount of Superheat entering the secondary heat transfer portion. This additional Superheat further increases the temperature difference between the Superheated vapor and the secondary heat transfer surfaces of the secondary heat transfer portion. In turn, this increases the rate of heat flow from the Superheated vapor within the rotor, and thus enhances the heat transfer locations required to achieve steady state operation.

Figure 16F:
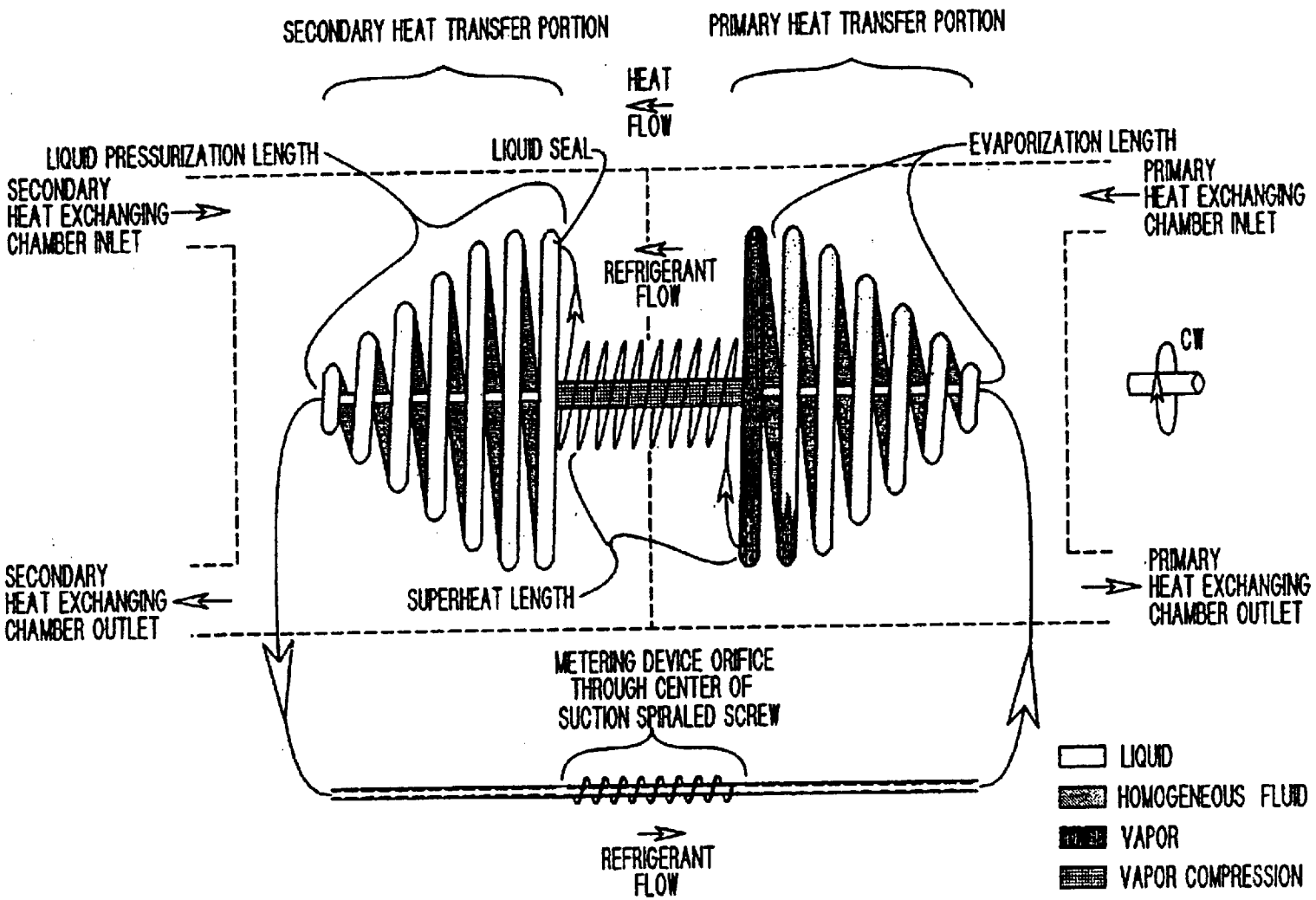
FIG. 16F is a schematic representation of the rotor structure of the heat transfer engine of FIGS. 14A and 14B, showing the physical location of the liquid, homogeneous fluid, vapor and gaseous phases of refrigerant within the rotor structure as superdeheating and condensation begin during the sixth stage of start-up operation in its cooling mode.

At the stage of operation shown in FIG. 16E, the rotor is approaching, but has not yet attained its steady-state angular velocity, which as shown in performance characteristics of FIG. 9, is referred to as "Minimal Velocity" or "Threshold Velocity". Consequently, the heat transfer engine is not yet operating along the linear portion of its operating characteristic. As shown in FIG. 16F, the remaining liquid refrigerant in the rotor shaft is now completely displaced by refrigerant vapor produced as a result of the evaporation of the liquid refrigerant in primary heat transfer portion of the rotor. Consequently, Superheat produced from the primary heat transfer portion of the rotor is permitted to flow through the spiraled passageway of the rotor shaft and into the secondary heat transfer portion, where it can be liberated by way of condensation across the secondary heat transfer portion. As shown, Superheat Length of the refrigerant stream within the primary heat transfer portion of the rotor has decreased in effective length, while the Evaporation Length of the refrigerant stream has increased proportionally, indicating that the refrigeration effect within the primary heat transfer portion is increasing towards the Balanced Point or steady state condition. At this stage of operation, the Liquid Seal is no longer located along the rotor shaft, but within the secondary heat transfer portion of the rotor, near the end of the rotor shaft. Vapor compression has begun to occur in the tail end of the primary heat transfer portion and along the spiraled passageway of the rotor. At this stage of operation, the pressure of the liquid refrigerant along the Liquid Pressurization Length has increased sufficiently enough to further increase the production of homogeneous fluid in the primary heat transfer portion of the rotor. This also causes the quantity of liquid in the secondary heat transfer portion to decrease the "Pulling Effect" on the flash gas and vapor located in the spiraled passageway in the rotor shaft, as well as in the primary heat transfer portion of the rotor downstream from the homogeneous fluid. The pulling affect on the flash gas enhances vapor compression taking place along the spiraled passageway of the rotor shaft. At this stage of operation the homogeneous fluid is evaporating absorbing heat within the primary heat transfer portion of the rotor for transference and systematic discharge from the secondary heat transfer portion. In other words, during this stage of operation, the vapor within the primary heat transfer portion of the rotor can contain more Superheat by volume than the gas with which it is mixed. Thus, the increased volume in dense vapor in the primary heat transfer portion provides a means of storing Superheat (absorbed from the primary heat exchanging circuit) until the vapor stream flows into the secondary heat transfer portion of the rotor where it can be liberated to the secondary heat exchanging circuit by way of conduction.

As shown in FIG. 16F, the heat transfer engine of the present invention is shown operating at what shall be called the "Balance Point Condition" (i.e. steady-state condition). At this stage of operation, the refrigerant within the rotor has attained the necessary phase distribution where simultaneously there is an equal amount of refrigerant being evaporated in the primary heat transfer portion as there is refrigerant vapor being condensed in the secondary heat transfer portion of the rotor. At this stage of operation, the heat transfer engine is operating along the linear portion of its operating characteristic, shown in FIG. 9. At this stage, there exists a range or band of angular velocities within which the rotor can rotate and a range of loading conditions within which the rotor can transfer heat while maintaining a substantially linear relationship between (i) the rate of heat transfer between the primary and secondary heat exchanging portions of the rotor and the (ii) angular velocity thereof. Outside of this range of operation, these parameters no longer follow a linear relationship. This has two major consequences. The first consequence is that the control structure (i.e. system controller) of the engine performs less than ideally. The second consequence is that maximal refrigeration cannot be achieved.

Figure 16G:
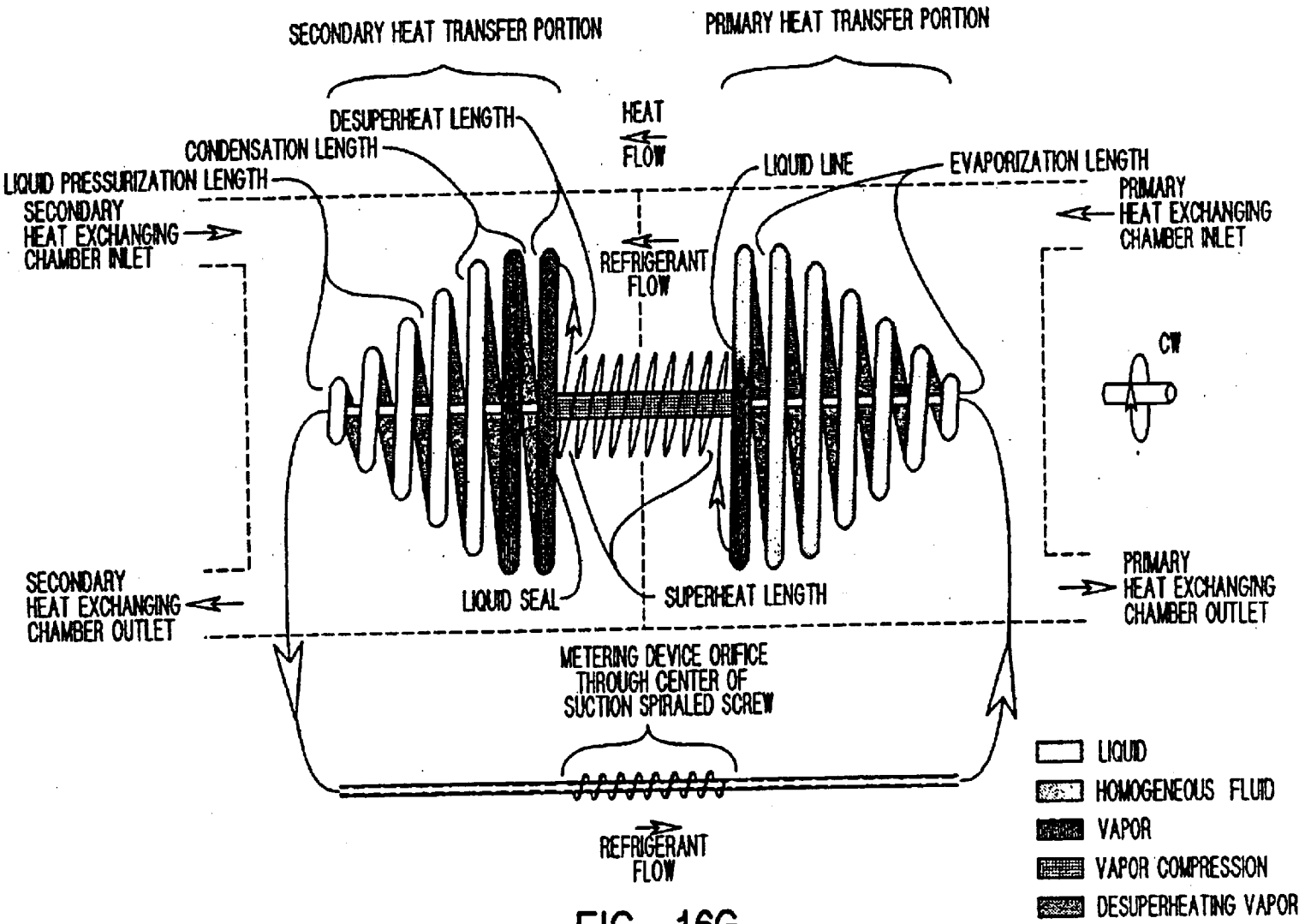
FIG. 16G is a schematic representation of the rotor structure of the heat transfer engine of FIGS. 14A and 14B, showing the physical location of the liquid, homogeneous fluid, vapor and gaseous phases of refrigerant within the rotor structure during the seventh and steady-state state of start up operation in its cooling mode.
Figure 16H:
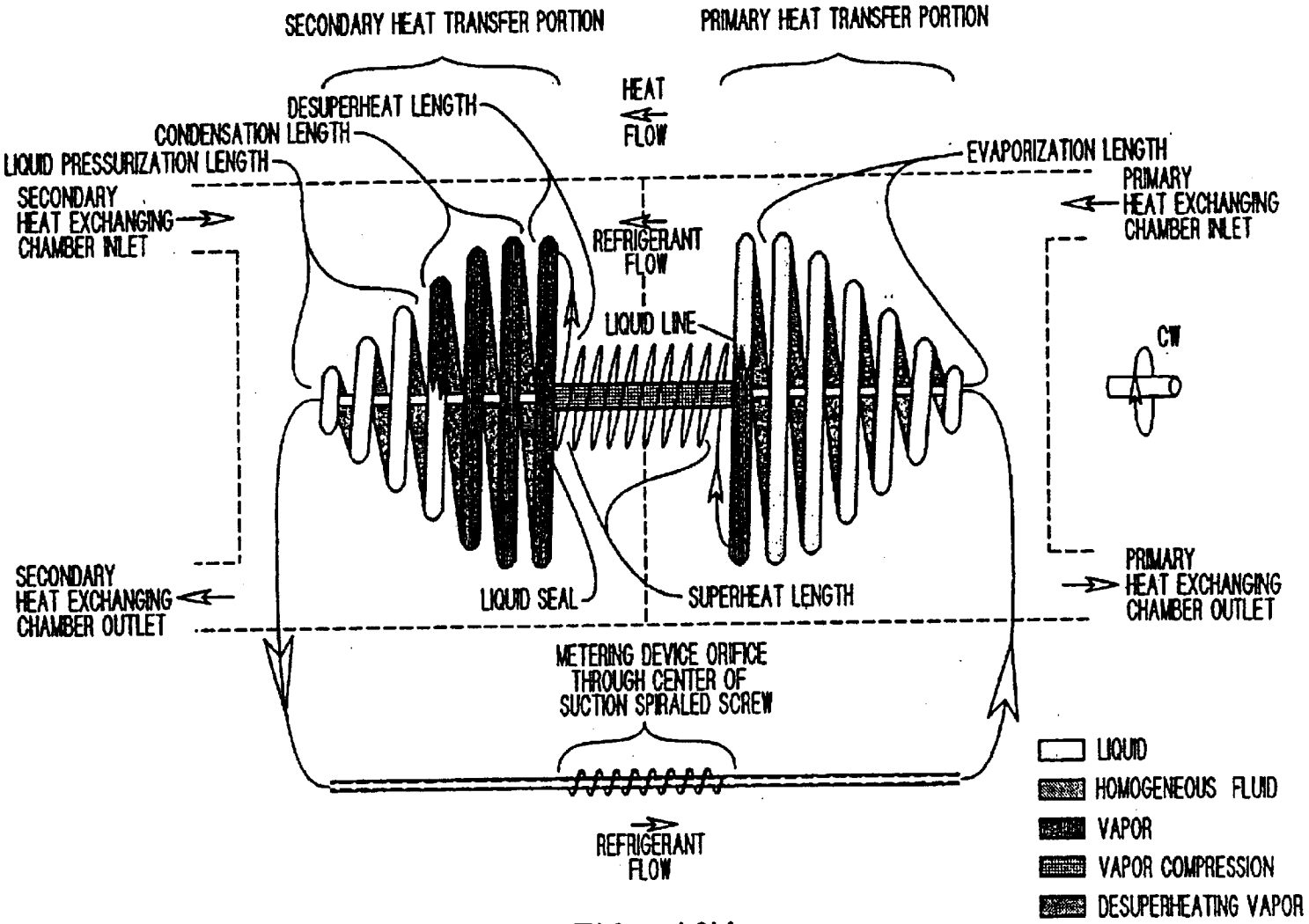
FIG. 16H is a schematic representation of the rotor structure of the heat transfer engine of FIGS. 14A and 14B, showing the physical location of the liquid, homogeneous fluid, vapor and gaseous phases of refrigerant within the rotor structure during the eighth state stage of operation, at an angular velocity exceeding steady-state, in its cooling mode.
Figure 16I:
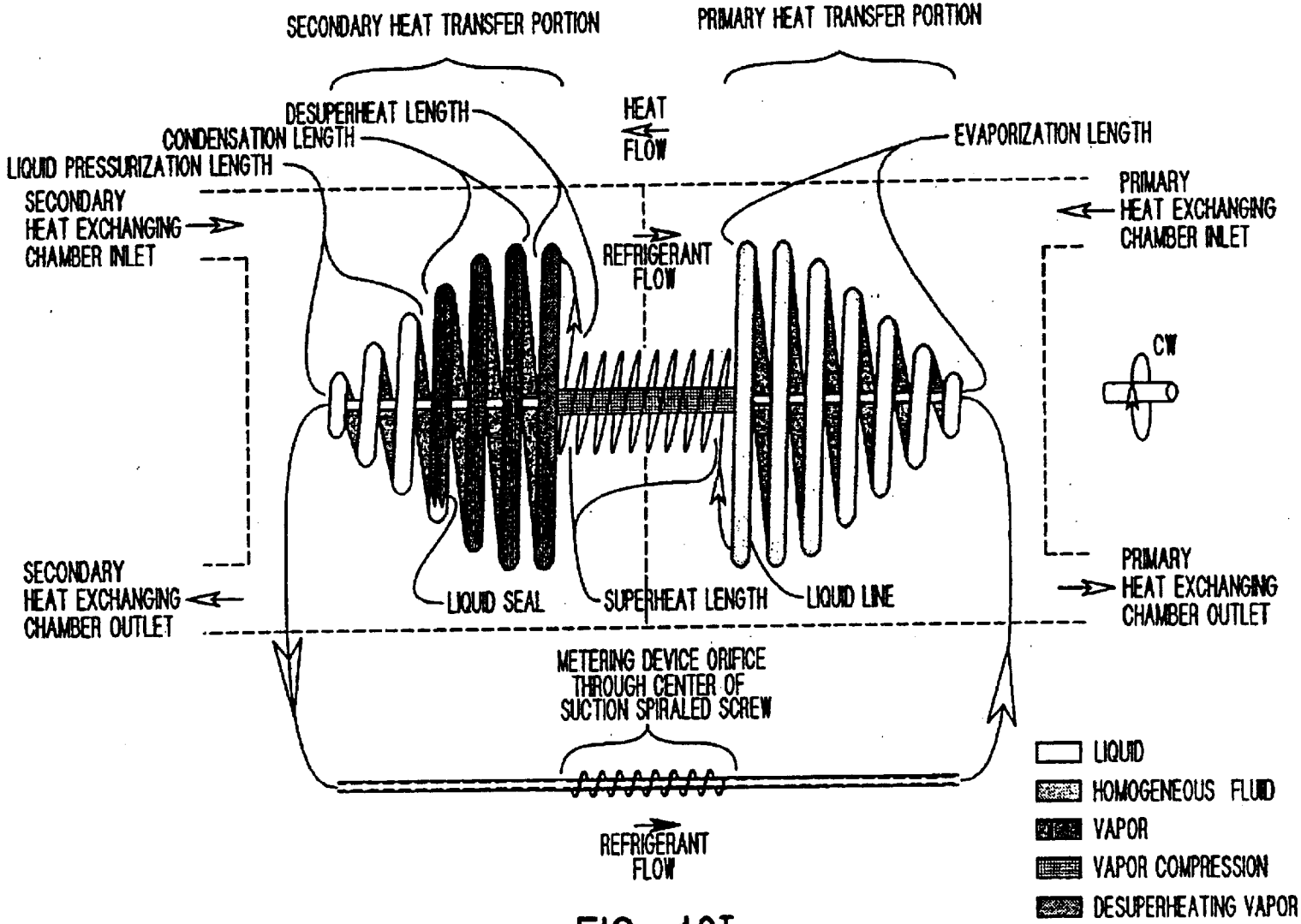
FIG. 16I is a schematic representation of the rotor structure of the heat transfer engine of FIGS. 14A and 14B, showing the physical location of the liquid, homegeneous fluid, vapor and gaseous phases of refrigerant within the rotor structure thereof during the eight stage of operation exceeding steady-state angular velocity in the cooling mode.

As shown in FIG. 16G, the Superheat that has "accumulated" in the refrigerant vapor during the start up sequence shown in FIGS. 16A through 16F begins to dissipate from the DeSuperheat Length of the refrigerant stream along the secondary heat transfer portion of the rotor. At this stage of operation, the density of the refrigerant gas increases while vapor compression occurs as a result of Superheat being carried by the refrigerant gas from the Superheat Length along the primary heat transfer portion to the DeSuperheat Length along the secondary heat transfer portion via the spiraled passageway of the rotor shaft. Thus, as the Superheat is dissipated in the secondary heat transfer portion of the rotor and compressed vapor in the secondary heat transfer portion thereof begins to condense into liquid refrigerant, a denser vapor remains. Consequently, the spiraled passageway of the rotor shaft has a greater compressive affect on the vapor therein at this stage of operation. In other words, the spiraled passageway of the shaft pressurizes the superheated gas and dense vapor against the Liquid Seal formed in the secondary heat transfer portion of the rotor.

As shown in FIG. 16G, pressurization of liquid refrigerant in the secondary heat transfer portion of the rotor pushes the liquid refrigerant through the throttling device at a sufficiently higher pressure, which causes a portion of the liquid refrigerant to "flash" into a gas. This reduces the temperature of the remaining homogeneous fluid (liquid and dense vapor) entering the primary heat transfer portion thereof. The liquid refrigerant portion of the homogeneous fluid, in turn, evaporates creating sufficient vapor pressure therein which displaces vapor downstream within the primary heat transfer portion, into the spiraled passageway of the rotor shaft. This vapor pressure, enhanced by vapor compression caused by the spiraled passageway in the rotor shaft, pushes the produced vapor into the secondary heat transfer portion of the rotor, where its Superheat is liberated over the DeSuperheat Length of the refrigerant stream.

At the Balance Point condition, a number of conditions remain throughout steady-state operation. Foremost, the Liquid Seal tends to remain near the same location in the secondary heat transfer portion of the rotor, while the Liquid Line tends to remain near the same location in the primary heat transfer portion thereof. Secondly, the temperature and pressure of the refrigerant in the secondary heat transfer portion of the rotor is higher than the refrigerant in the primary heat transfer portion thereof. Thirdly, the rate of heat transfer from the primary heat exchanging chamber of the engine into the primary heat transfer portion thereof is substantially equal to the rate of heat transfer from the secondary heat transfer portion of the engine into the secondary heat exchanging chamber thereof. Thus, if the primary heat transfer portion of the rotor is absorbing heat at about 12,000 BTUH, then the secondary heat transfer portion thereof is dissipating about 12,000 BTUH.

Applications of Second Embodiment of Heat Transfer Engine Hereof

Figure 17:
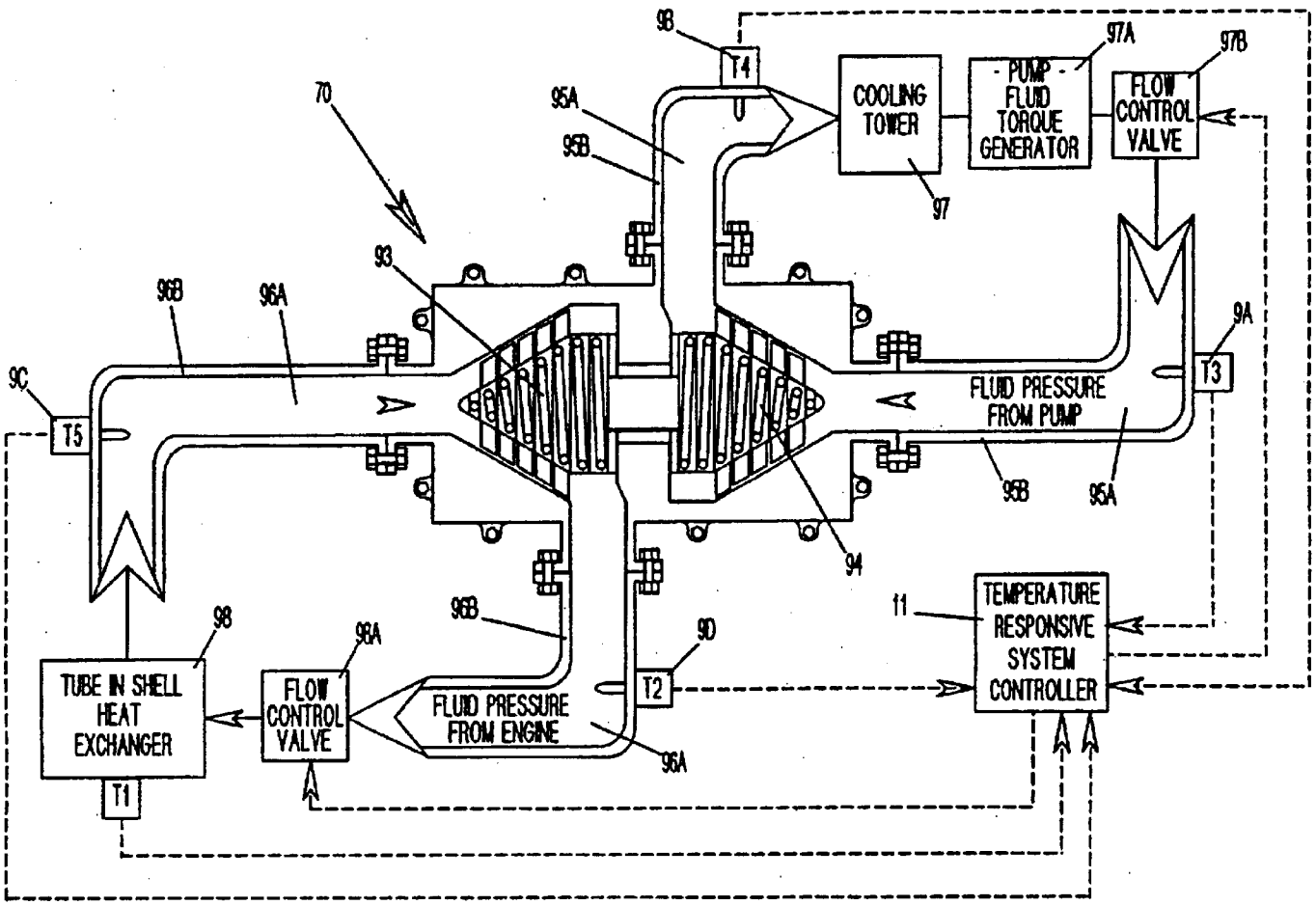
FIG. 17 is a schematic diagram of a heat transfer system, in which the heat transfer engine of the second illustrative embodiment is arranged so that the rotor structure thereof is rotated by fluid (water) flowing through the secondary heat exchanging fluid circuit, while the angular velocity thereof is controlled using a pump and flow control valve controlled by the temperature-responsive system controller.

In FIG. 17, a heat transfer system according to the present invention is shown, wherein the rotor of the heat transfer engine thereof 70 is driven (i.e. torqued) by fluid flow streams 95A flowing through the secondary heat exchanging circuit 95B of the system. In this heat transfer system, heat liberated from the secondary heat exchanging portion 94 of the rotor is absorbed by a fluid 95A from pump 97A and a typical condenser cooling tower 97. As shown, cooling tower 97 is part of systematic fluid flow circuit in a cooling tower piping system where heat is exchanged with the cooling tower and consequently with the ambient atmosphere. As shown in FIG. 17, the heat transfer engine 70 is "pumping" a fluid 96A, such as water, through a typical closed-loop tube and shell heat exchanger 98 and its associated piping 96B and flow control valve 98A. This heat transfer system is ideal for use in chilled-water air conditioning systems as well as process-water cooling systems.

As shown in FIG. 17, the fluid flow rate controller in primary heat exchanging circuit 96B is realized as a flow control valve 98A which receives primary heat exchanging fluid 96A by way of the primary heat exchanging portion 93 of the heat exchanging engine 70. The system controller 11 generates suitable signals to control the operation of the flow control valves (i.e. by adjusting the valve flow aperture diameter during engine operation). Preferably, in the secondary heat exchanging circuit 95B, the secondary fluid flow rate controller is realized as a flow rate control valve 97B designed for controlled operation under the control of system controller 11.

In FIG. 18, a modified embodiment of heat transfer system of FIG. 17 is shown. The primary difference between these systems is that the fluid inlet and outlet ports 77A and 77B of the system shown in FIG. 18 are arranged on the same side of the engine, and the rotor shaft 77 thereof is extended beyond the stator housing to permit an external motor 98 to drive the same in either direction of rotation using a torque converter 99.

In FIG. 19, another embodiment of a heat transfer system according to the present invention is shown, wherein two (or more) turbine-like heat transfer engines 125 and 127 are connected in a cascaded manner. As shown, the primary heat transfer portion of heat transfer engine 125 is in thermal communication with the secondary heat transfer portion of heat transfer portion 127, while the primary heat transfer portion of the rotor of engine 127 is in thermal communication with a closed chilled water loop flowing through the primary heat exchanging chamber thereof, and the secondary heat transfer portion of the rotor of engine 125 is in thermal communication with a closed process-water loop flowing through the secondary heat exchanging chamber thereof. As shown, the rotor of heat transfer engine 125 is driven by electric motor 126 coupled there by way of a first torque converter, while the rotor of heat transfer engine 127 is driven by electric motor 128 coupled therebetween by way of a second torque converter.

In FIG. 20, an alternative embodiment of a heat transfer system of the present invention is shown, wherein a hybrid-type heat transfer engine is employed. As shown, the hybrid-type heat transfer engine has a secondary heat transfer portion 129 adapted from the heat transfer engine of the first embodiment and a secondary heat transfer portion 130 adapted from the heat transfer engine of the second embodiment. The function of the primary heat transfer portion is to serve as an air cooled condenser, whereas the function of the secondary heat transfer portion is to serve as an evaporator in a closed-loop fluid chiller. As shown in FIG. 20, rotational torque is imparted to the rotor of the hybrid engine by allowing fluid to flow over the primary heat transfer vanes of the primary heat transfer portion 130 thereof.

Figure 21:
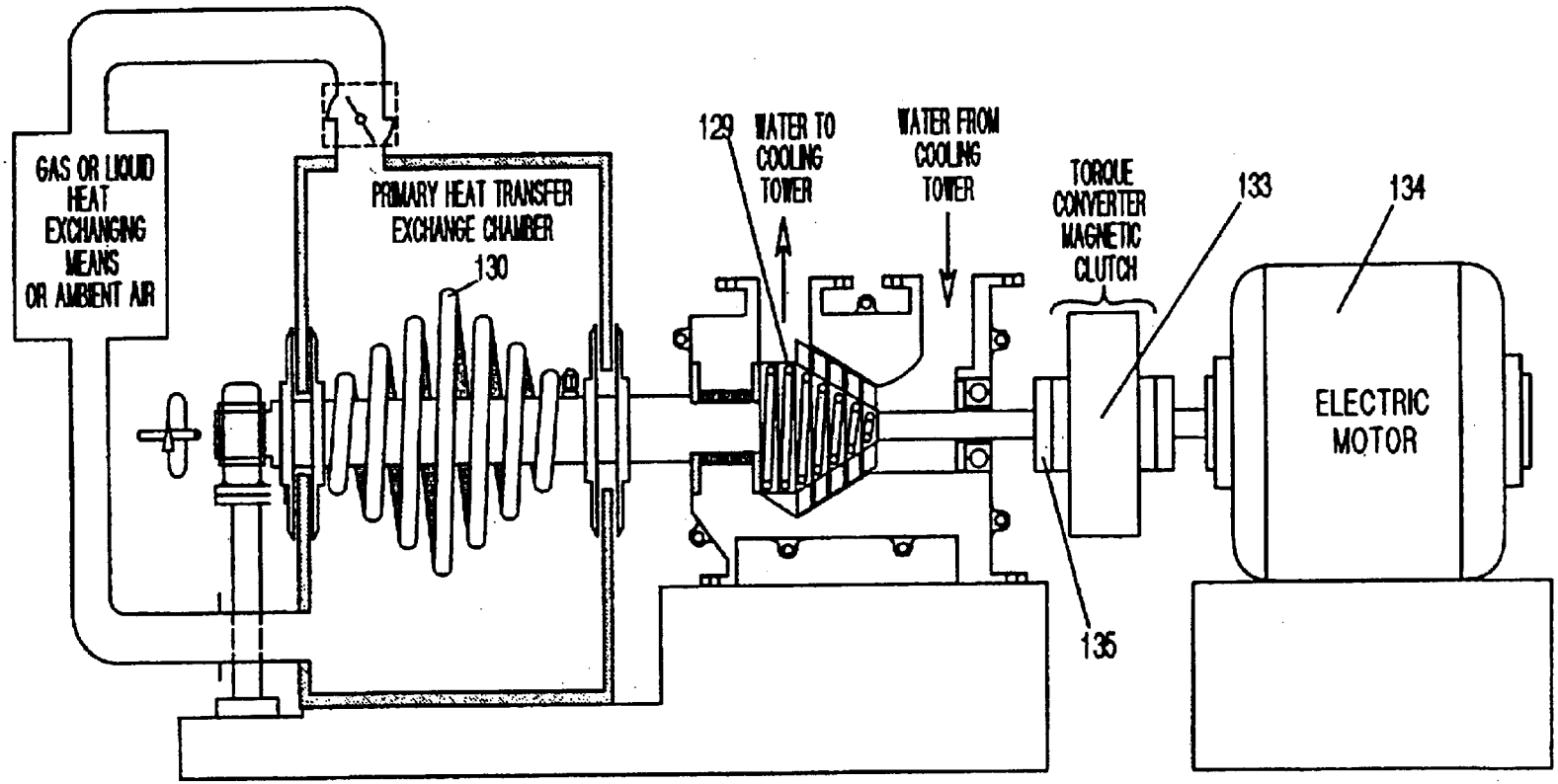
FIG. 21 is a schematic diagram of the hybrid heat transfer engine of FIG. 20, wherein the primary heat transfer portion thereof functions as an air or gas conditioning evaporator while the secondary heat transfer portion functions as a condenser in an open loop fluid cooled condenser, driven by an electric motor connected directly to the rotor shaft by way of a magnetic torque converter.

In FIG. 21, another embodiment of a heat transfer system of the present invention is shown, wherein another hybrid-type heat transfer engine is employed. As shown, the hybrid-type heat transfer engine has a secondary heat transfer portion 129 adapted from the heat transfer engine of the first embodiment and a secondary heat transfer portion 130 adapted from the heat transfer engine of the second embodiment. The function of the primary heat transfer portion is to serve as an air conditioning evaporator, whereas the function of the secondary heat transfer portion is to serve as a condenser in an open loop fluid cooled condenser. As shown in FIG. 21, rotational torque is imparted to the rotor of the hybrid engine by an electric motor 134 connector to the rotor shaft 135 by a magnetic torque converter 133, whereas allowing fluid to flow over the primary heat transfer vanes of the primary heat transfer portion 130 thereof.

Applications of Either Embodiment of the Heat Transfer Engine Hereof

Figure 22:
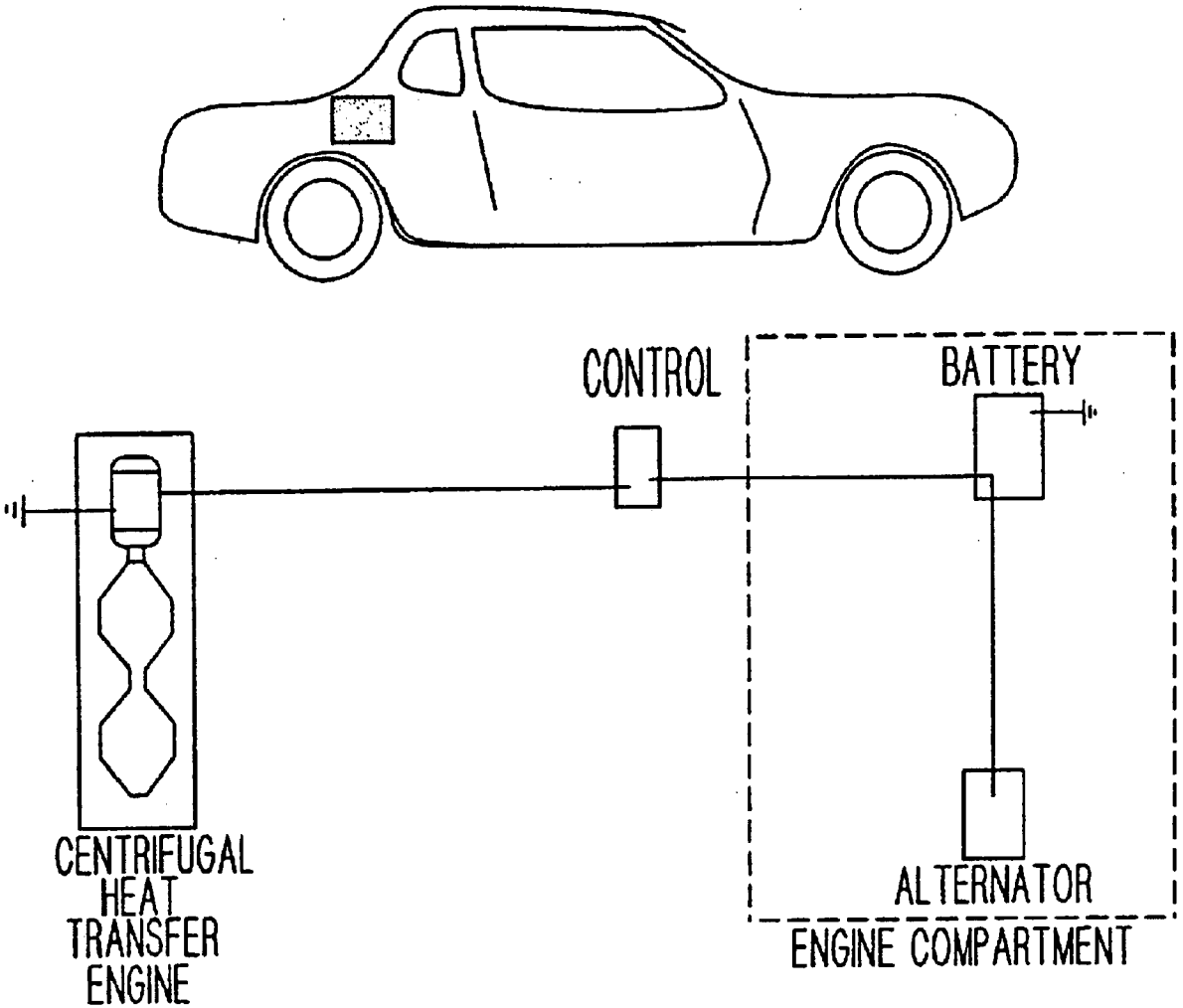
FIG. 22 is a schematic diagram of a heat transfer system of the present invention embodied within an automobile, wherein the rotor of the heat transfer engine is rotated by an electric motor driven by electrical power supplied through a power control circuit, and produced by the automobile battery recharged by an alternator within the engine compartment.

In FIG. 22, a heat transfer engine of the present invention is embodied within an automobile. In this application, the rotor of the heat transfer engine is rotated by an electric motor driven by electrical power which is supplied through a power control circuit, and produced by the automobile battery that is recharged by an alternator within the engine compartment of the automobile.

Figure 23:
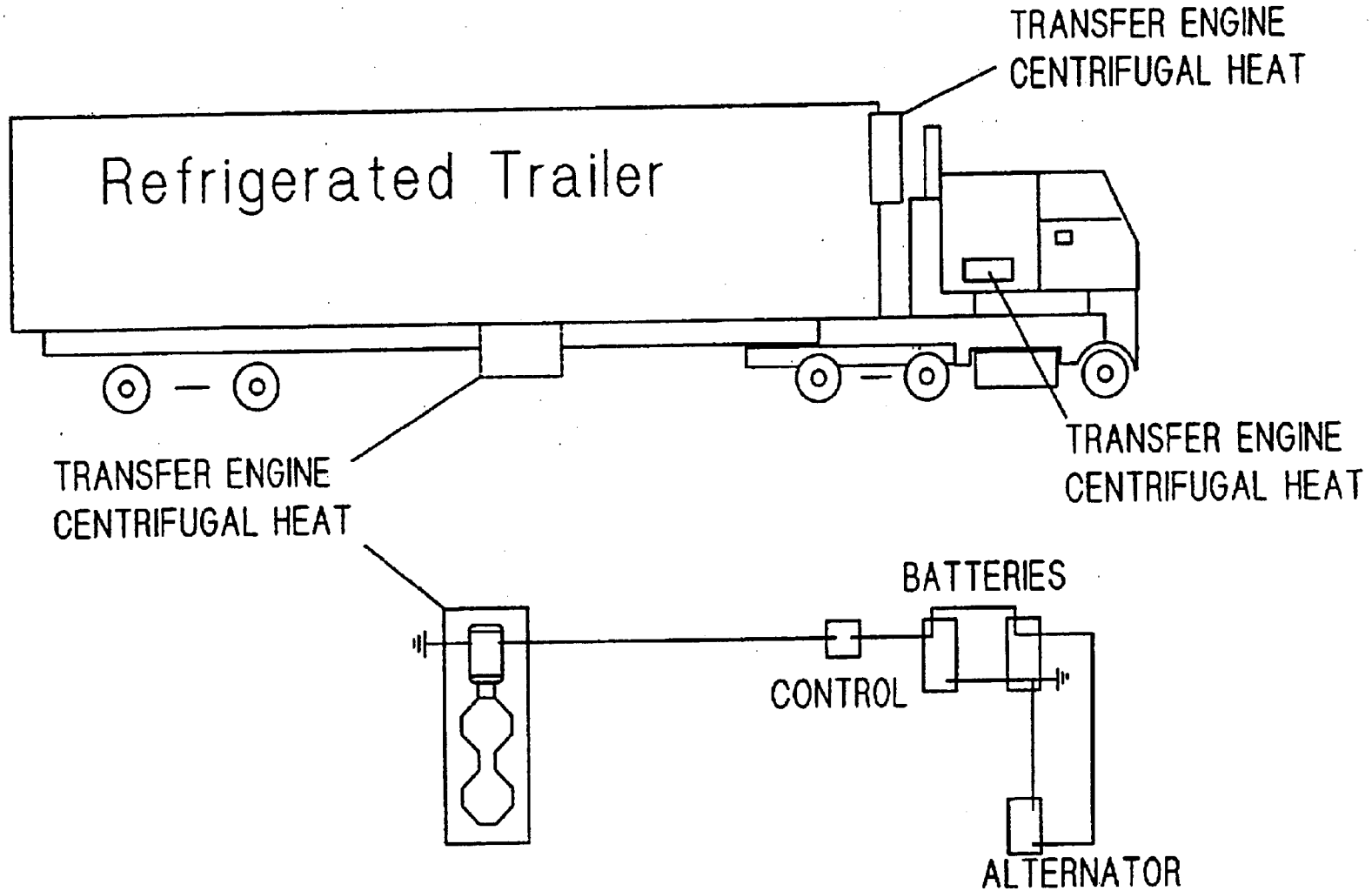
FIG. 23 is a schematic diagram of a heat transfer system of the present invention embodied within an refrigerated tractor trailer truck, wherein the rotor of the heat transfer engine is rotated by an electric motor driven by electrical power supplied through a power control circuit and produced by a bank of batteries recharged by an alternator within the engine compartment.

In FIG. 23, a heat transfer engine of the present invention is embodied within a refrigerated tractor trailer truck. In this application, the rotor of the heat transfer engine is rotated by an electric motor driven by electrical power which is supplied through a power control circuit and produced by a bank of batteries recharged by an alternator within the engine compartment of the truck.

Figure 24:
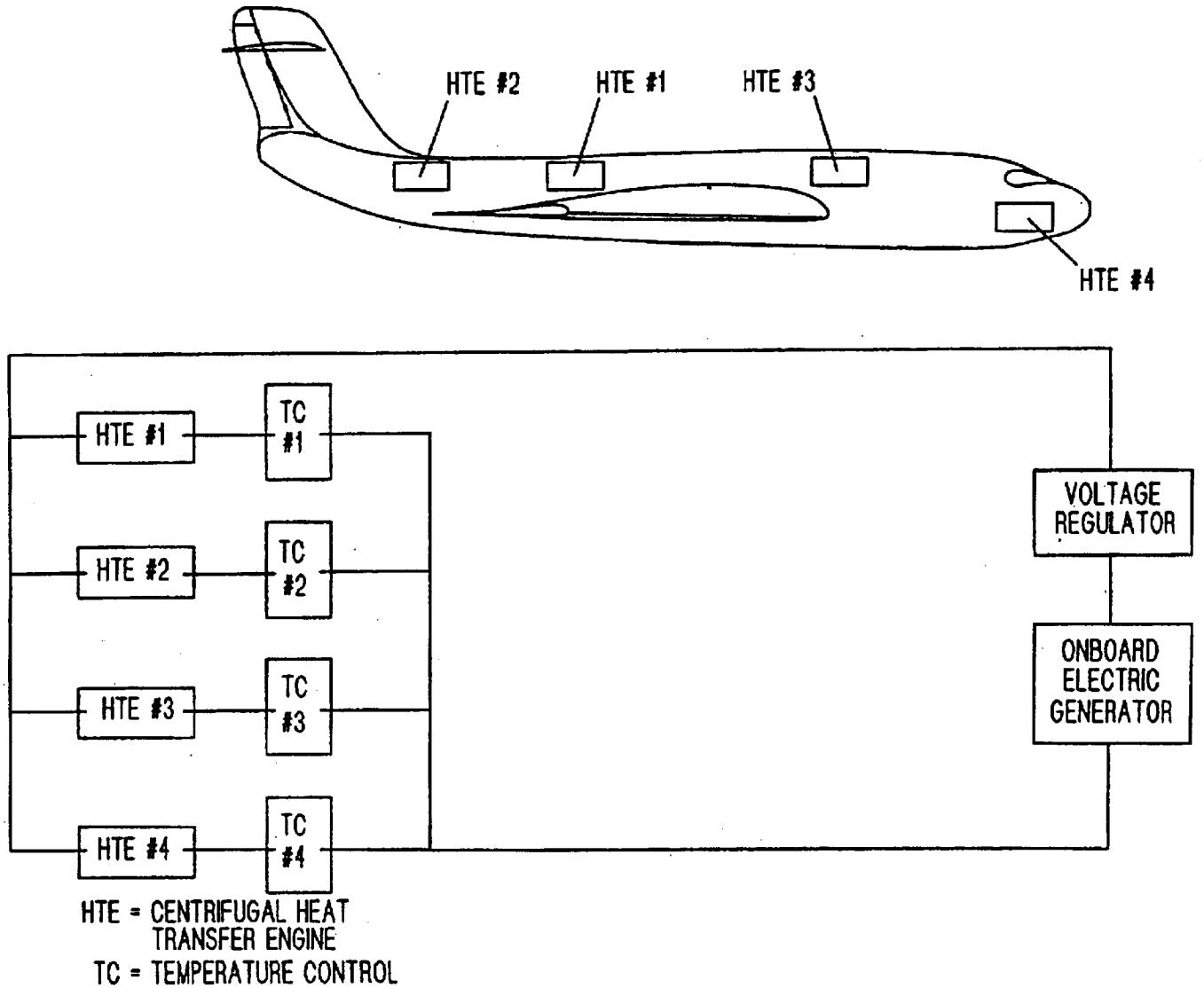
FIG. 24 is a schematic diagram of a heat transfer system of the present invention embodied within an aircraft equipped with a plurality of heat transfer engines of the present invention, wherein the rotor of each heat transfer engine is rotated by an electric motor driven by electrical power supplied through voltage regulator and temperature control circuit, and produced by an onboard electric generator.

In FIG. 24, a plurality of heat transfer engines of the present invention are embodied within an aircraft. In this application, the rotor of each heat transfer engine is rotated by an electric motor. The electric motor is driven by electrical power which is produced by an onboard electric generator and supplied to the electric motors through voltage regulator and temperature control circuit.

Figure 25:
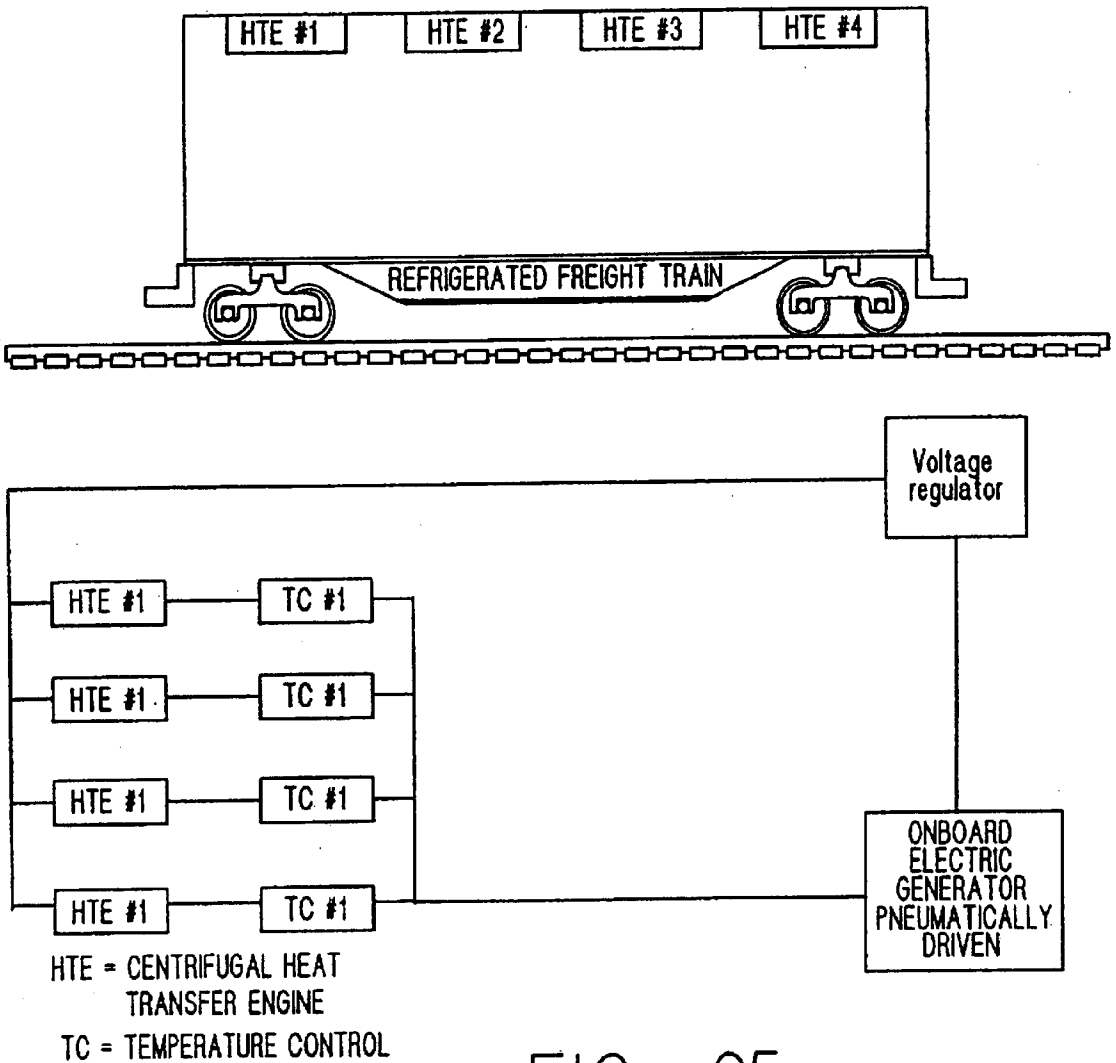
FIG. 25 is a schematic diagram of a heat transfer system of the present invention embodied within a refrigerated freight train equipped with a plurality of heat transfer engines of the present invention, wherein the rotor of each heat transfer engine is rotated by an electric motor driven by electrical power supplied through voltage regulator and temperature control circuit, and produced by an onboard pneumatically driven electric generator.

In FIG. 25, a plurality of heat transfer engines of the present invention are embodied within a refrigerated freight train. In this application, the rotor of each heat transfer engine is rotated by an electric motor driven by electrical power. The electric power is produced by an onboard pneumatically driven electric generator, and is supplied to the electric motors through a voltage regulator and temperature control circuit.

Figure 26:
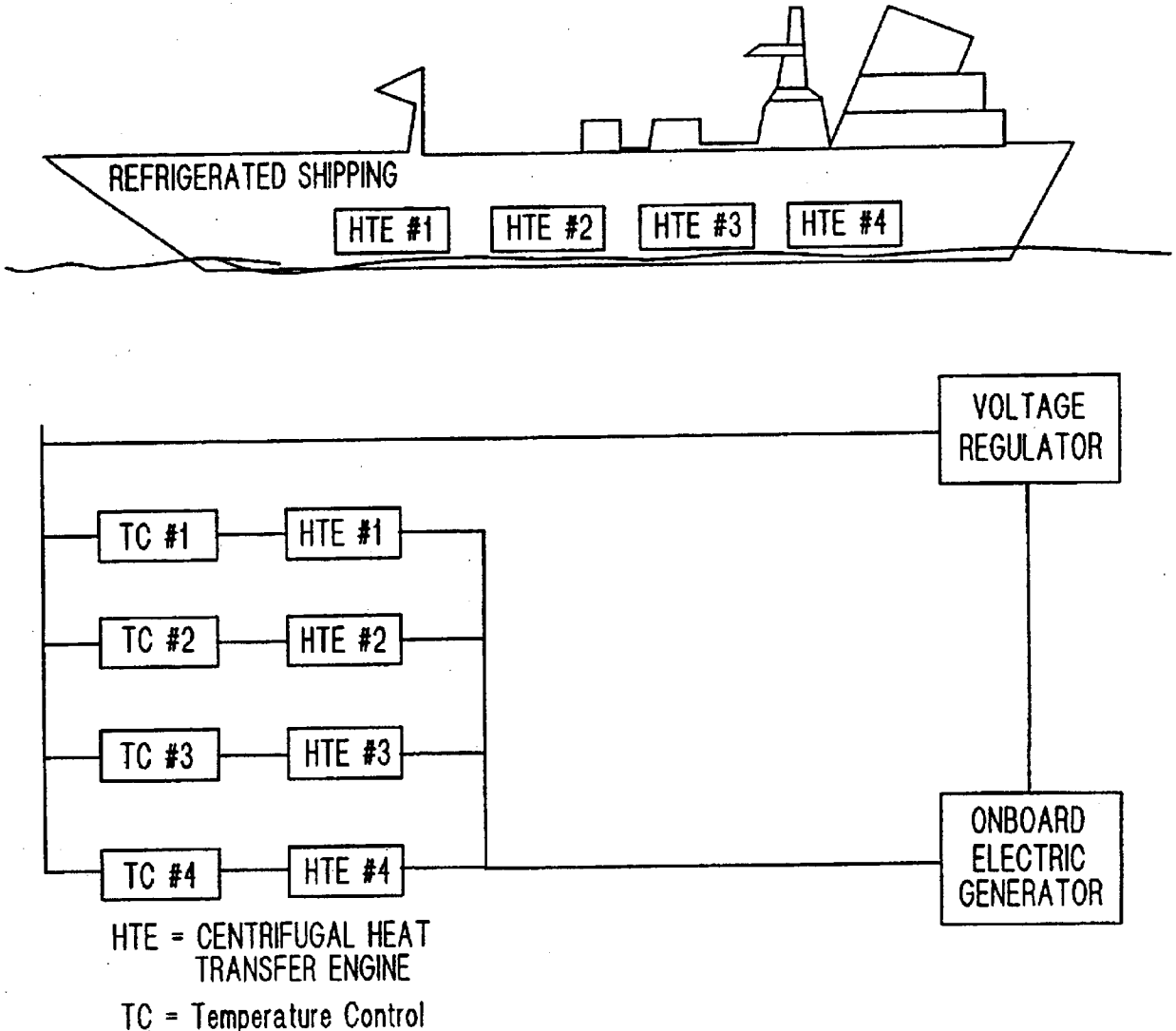
FIG. 26 is a schematic diagram of a heat transfer system of the present invention embodied within a refrigerated shipping vessel equipped with a plurality of heat transfer engines of the present invention, wherein the rotor of each heat transfer engine is rotated by an electric motor driven by electrical power supplied-through voltage regulator and temperature control circuit, and produced by an onboard pneumatically driven electric generator.
Figure 27A:
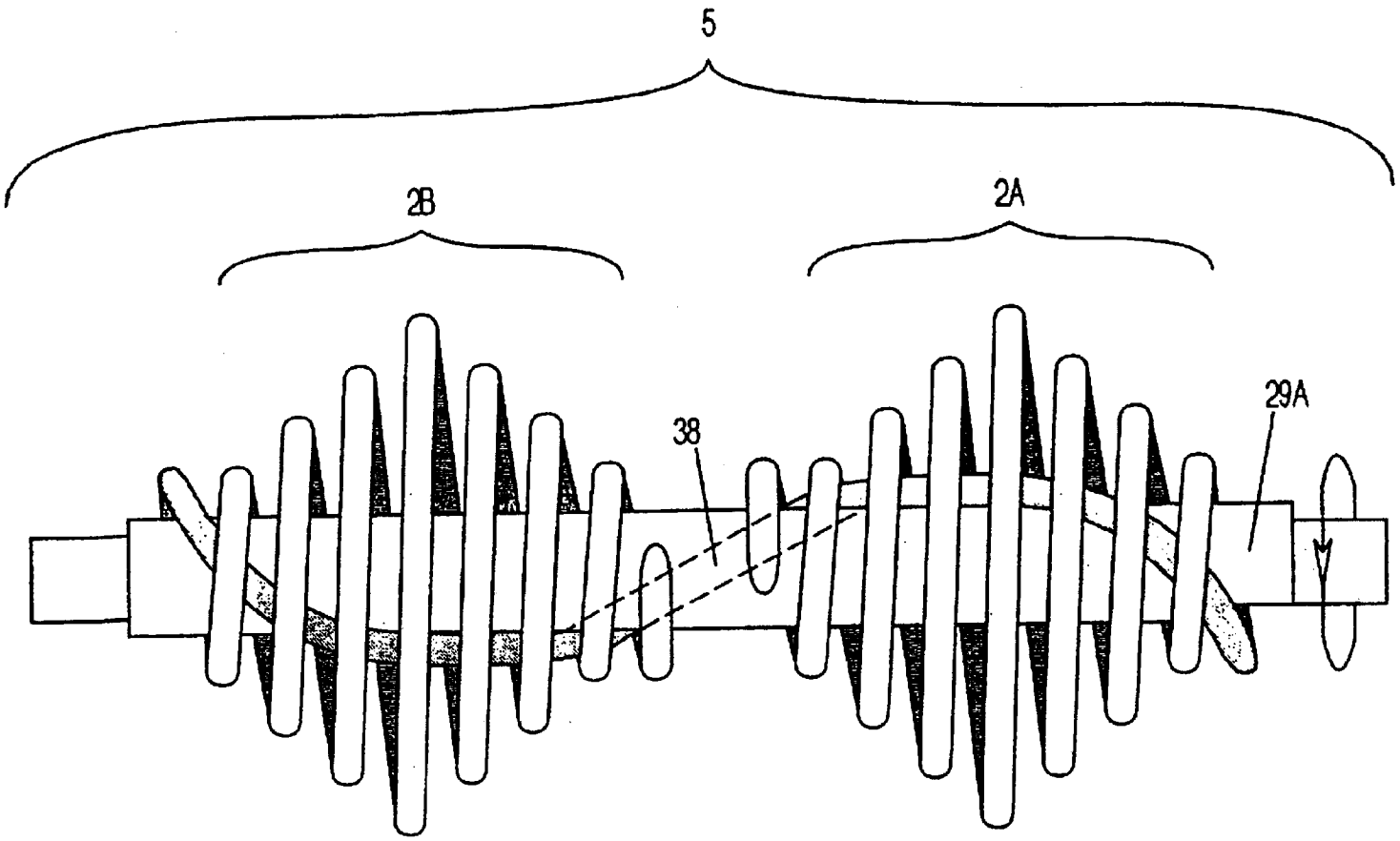
FIG. 27A is an elevated side view of the fluid-carrying rotor structure of an alternative illustrative embodiment, shown removed from the stator portion thereof, and having a helical return fluid flow passageway that extends about the rotor axis, but outside the solid rotor shaft.
Figure 27B:
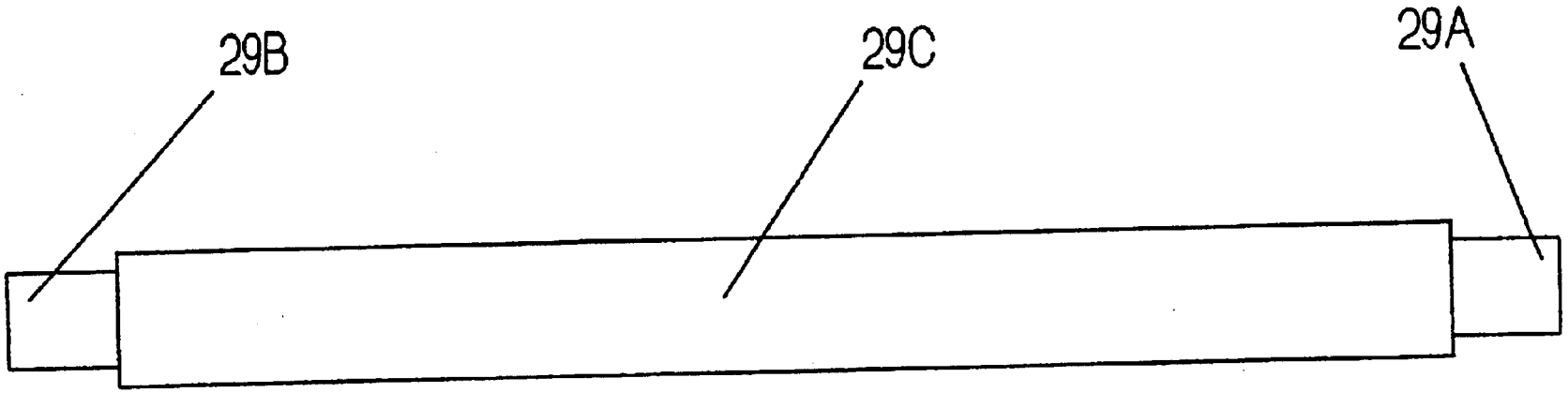
FIG. 27B is an elevated side view of the solid rotor shaft used in fluid-carrying rotor structure of FIG. 27A.

In FIG. 26, a plurality of heat transfer engines of the present invention are embodied within a refrigerated shipping vessel. In this application, the rotor of each heat transfer engine is rotated by an electric motor driven by electrical power. The electric power is produced by an onboard pneumatically driven electric generator, and is supplied to the electric motors through a voltage regulator and temperature control circuit.

Having described various illustrative embodiments of the present invention, various modifications readily come to mind.

Various embodiments of the heat transfer engine technology of the present invention have been described above in great detail above. Preferably, each embodiment is designed using 3-D computer workstation having 3-D geometrical modeling capabilities, as well as mathematical modeling tools to develop mathematical models of each engine hereof using equation of energy, equations of motion and the like, well known in the fluid dynamics and thermodynamics art. Using such computational-based models, simulation of proposed system designs can be carried out on the computer workstation, performance criteria established, and design parameters modified to achieve optimal heat transfer engine designs based on the principles of the present invention disclosed herein.

The illustrative embodiments described in detail herein have generally focused on cooling or heating fluid (e.g. air) flow streams passing through the primary heat exchanging circuit to which the heat transfer engines hereof are operably connected. However, in some applications, such as dehumidification, it is necessary to both cool and heat air using one or more heat transfer engines of the present invention. In such applications, the air flow (being conditioned) can be easily directed over the primary heat exchanging portion of the rotor in order to condense moisture in the air stream, and thereafter directed over the secondary heat exchange portion of the rotor in order to re-heat the air for redistribution (reentry) into the conditioned space associated with the primary heat exchanging fluid circuit. Using such techniques, the heat transfer engines described hereinabove can be readily modified to provide engines capable of performing both cooling and heating functions.

In general, both the coiled heat transfer engine and the embedded-coil (i.e. turbine line) heat transfer engine turbine of the present invention can be cascaded in various ways, utilizing various refrigerants and fluids, for various capacity and operating temperature requirements. Digital or analog type temperature and pressure sensors may be used to realize the system controllers of such embodiments. Also, electrical, pneumatic, and/or hydraulic control structures (or any combination thereof) can also be used to realize such embodiments of the present invention.

Although preferred embodiments of the invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention is intended to encompass such rearrangements, modifications, and substitutions of parts and elements as fall within the scope and spirit of the accompanying claims to Invention.

What is claimed is:

1. A rotatable heat transfer structure for use in a heat transfer engine capable of transferring heat between first and second heat exchanging circuits through which first and second heat exchanging mediums flow, respectively, said rotatable heat transfer engine including a stationary housing having first and second heat transfer chambers, and a thermal isolation barrier disposed therebetween, and said first and second heat transfer chambers each having first and second ports and a continuous passageway therebetween, and said rotatable heat transfer structure rotatably supported within said stationary housing about an axis of rotation and comprising:

a substantially symmetrical moment of inertia about said axis of rotation;

a first end portion disposed within said first heat transfer chamber;

a second end portion disposed within said second heat transfer chamber; and an intermediate portion disposed between said first and second end portions, said rotatable heat transfer structure further embodying a closed fluid circuit arranged about said axis of rotation, and having a return portion extending along the direction of said axis of rotation and at least a subportion of said return portion having a helical geometry; and an interior volume for containing a predetermined amount of a heat carrying medium contained within said closed fluid circuit which automatically circulates within said closed fluid circuit as said rotatable heat transfer structure is rotated about said axis of rotation in order to transfer heat between said first and second portions of said rotatable heat transfer structure, said first end portion of said rotatable heat transfer structure being disposed in thermal communication with said first heat exchanging circuit, said second end portion of said rotatable heat transfer structure being disposed in thermal communication with said second heat exchanging circuit, and said intermediate portion being physically adjacent to said thermal isolation barrier so that said thermal isolation barrier presents a substantially high thermal resistance to heat transfer between said first and second heat transfer chambers during operation of said heat transfer engine.

2. The rotatable heat transfer structure of claim 1, wherein said heat transfer engine further comprises:

a torque generation device for imparting torque to said rotatable heat transfer structure and causing said rotatable heat transfer structure to rotate about said axis of rotation; and a torque control device for controlling said torque generation device in response to the temperature of said first and second heat exchanging mediums sensed at said first and second ports in said first and second heat transfer chambers.

3. The rotatable heat transfer structure of claim 2, wherein said torque generation device comprises:

a motor having a drive shaft operably connected to said rotatable heat transfer structure, wherein the angular velocity of said drive shaft is maintained within a predetermined range of angular velocity by said torque control device.

4. The rotatable heat transfer structure of claim 2, wherein said torque generation device comprises turbine blades disposed on at least one of said first and second end portions of said rotatable heat transfer structure, such that said turbine blades are imparted torque by said first heat exchanging medium flowing through said first heat transfer chamber or said second heat exchanging medium flowing through said second heat transfer chamber during the operation of said heat transfer engine.

5. The rotatable heat transfer structure of claim 2, wherein said torque generation device comprises:

a steam turbine having a drive shaft operably connected to said rotatable heat transfer structure, for imparting torque to said rotatable heat transfer structure, and wherein said torque control device comprises a device for controlling the angular velocity of the drive shaft of said steam turbine.

6. The rotatable heat transfer structure of claim 2, wherein said torque generation device comprises:

turbine blades disposed on at least one of said first and second end portions of said rotatable heat transfer structure, such that said turbine blades are imparted torque by a first heat exchanging medium flowing through said first heat transfer chamber or a second heat exchanging medium flowing through said second heat transfer chamber during the operation of said heat transfer engine.

7. The rotatable heat transfer structure of claim 2, wherein said torque generation device comprises:

a steam turbine having a drive shaft operably connected to said rotatable heat transfer structure, for imparting torque to said rotatable heat transfer structure, and wherein said torque control device comprises device for controlling the angular velocity of the drive shaft of said steam turbine.

8. The rotatable heat transfer structure of claim 1, wherein said rotatable heat transfer structure comprises a rotor portion having a substantially symmetrical moment of inertia about said axis of rotation, and said closed fluid circuit is realized as a three-dimensional flow passageway of closed loop design formed in said rotor portion, said three-dimensional flow passageway comprising a first, second, third and fourth spiral flow passageway portions connected in a series configuration about said axis of rotation, in the named order.

9. The rotatable heat transfer structure of claim 8, wherein said rotor portion comprises a plurality of rotor discs assembled together to form a unitary structure, wherein each said rotor disc has formed therein a section of grooving which relates to a portion of said three-dimensional flow passageway formed in said rotor portion.

10. The rotatable heat transfer structure of claim 1, wherein said rotatable heat transfer structure comprises a rotor shaft along which said return portion of said closed fluid circuit extends, and wherein said closed fluid circuit is realized as three-dimensional tubing configuration supported about said rotor shaft having first, second, third and fourth spiral tubing sections continuously connected in a series configuration about said axis of rotation, in the named order.

11. The rotatable heat transfer structure of claim 10, wherein said return portion extends substantially along the entire extent of said rotor shaft.

12. The rotatable heat transfer structure of claim 1, wherein said heat transfer engine further comprises:

a first connection device for interconnecting the first heat exchanging circuit to said first and second ports of said first heat transfer chamber, so as to permit said first heat exchanging medium to flow through said first heat exchanging circuit and said first heat transfer chamber during the operation of said heat transfer engine; and a second connection device for interconnecting the second heat exchanging circuit to said first and second ports of said second heat transfer chamber, so as to permit said second heat exchanging medium to flow through said second heat exchanging circuit and said second heat transfer chamber during the operation of said heat transfer engine, while said first and second heat exchanging circuits are in substantial thermal isolation of each other.

13. The rotatable heat transfer structure of claim 12, wherein said heat transfer engine further comprises a temperature sensing device for measuring the temperature of said heat exchanging medium flowing through said first and second ports of said first and second heat transfer chambers.

14. The rotatable heat transfer structure of claim 12, wherein said first heat exchanging medium flowing through said first heat exchanging circuit is air, and said second heat exchanging medium flowing through said second heat exchanging circuit is air.

15. The rotatable heat transfer structure of claim 12, wherein said first heat exchanging medium flowing through said first heat exchanging circuit is water, and said second heat exchanging medium flowing through said second heat exchanging circuit is air.

16. The rotatable heat transfer structure of claim 12, wherein said first heat exchanging medium flowing through said first heat exchanging circuit is water, and said second heat exchanging medium flowing through said second heat exchanging circuit is water.

17. The rotatable heat transfer structure of claim 12, wherein said first heat exchanging medium flowing through said first heat exchanging circuit is air, and said second heat exchanging medium flowing through said second heat exchanging circuit is water.

18. The rotatable heat transfer structure of claim 2, in said torque generation device comprises:

a motor having a drive shaft operably connected to said rotatable heat transfer structure, wherein the angular velocity of said drive shaft is maintained within said predetermined range of angular velocity by said torque control device.

19. A rotatable heat transfer structure for use in a heat transfer engine capable of transferring heat between first and second heat exchanging circuits through which first and second heat exchanging mediums flow, respectively, said rotatable heat transfer engine including a stationary housing having first and second heat transfer chambers, and a thermal isolation barrier disposed therebetween, and said first and second heat transfer chambers each having first and second ports and a continuous passageway therebetween, and said rotatable heat transfer structure rotatably supported within said stationary housing about an axis of rotation and comprising:

a substantially symmetrical moment of inertia about said axis of rotation;

a first end portion disposed within said first heat transfer chamber;

a second end portion disposed within said second heat transfer chamber; and an intermediate portion disposed between said first and second end portions, said rotatable heat transfer structure further embodying a closed fluid circuit arranged about said axis of rotation, and having a return portion extending along the direction of said axis of rotation and at least a subportion of said return portion having a helical geometry; and an interior volume for containing a predetermined amount of a heat carrying medium contained within said closed fluid circuit which automatically circulates within said closed fluid circuit as said rotatable heat transfer structure is rotated about said axis of rotation in order to transfer heat between said first and second portions of said rotatable heat transfer structure, said first end portion of said rotatable heat transfer structure being disposed in thermal communication with said first heat exchanging circuit, said second end portion of said rotatable heat transfer structure being disposed in thermal communication with said second heat exchanging circuit, and said intermediate portion being physically adjacent to said thermal isolation barrier so that said thermal isolation barrier presents a substantially high thermal resistance to heat transfer between said first and second heat transfer chambers during operation of said heat transfer engine; and wherein the first end portion of said rotatable heat transfer structure functions as an evaporator and the second end portion of said rotatable heat transfer structure functions as a condenser when said rotatable heat transfer structure is rotated in a clockwise direction.

20. A rotatable heat transfer structure for use in a heat transfer engine capable of transferring heat between first and second heat exchanging circuits through which first and second heat exchanging mediums flow, respectively, said heat transfer engine including a stationary housing having first and second heat transfer chambers, and a thermal isolation barrier disposed therebetween, and said first and second heat transfer chambers each having first and second ports and a continuous passageway therebetween, and said rotatable heat transfer structure rotatably supported within said stationary housing about an axis of rotation and comprising:

a substantially symmetrical moment of inertia about said axis of rotation;

a first end portion disposed within said first heat transfer chamber;

a second end portion disposed within said second heat transfer chamber; and an intermediate portion disposed between said first and second end portions, said rotatable heat transfer structure further embodying a closed fluid circuit arranged about said axis of rotation, and having a return portion extending along the direction of said axis of rotation and at least a subportion of said return portion having a helical geometry; and an interior volume for containing a predetermined amount of a heat carrying medium contained within said closed fluid circuit which automatically circulates within said closed fluid circuit as said rotatable heat transfer structure is rotated about said axis of rotation in order to transfer heat between said first and second portions of said rotatable heat transfer structure, said first end portion of said rotatable heat transfer structure being disposed in thermal communication with said first heat exchanging circuit, said second end portion of said rotatable heat transfer structure being disposed in thermal communication with said second heat exchanging circuit, and said intermediate portion being physically adjacent to said thermal isolation barrier so that said thermal isolation barrier presents a substantially high thermal resistance to heat transfer between said first and second heat transfer chambers during operation of said heat transfer engine; and wherein the first end portion of said rotatable heat transfer structure functions as a condenser and the second end portion of said rotatable heat transfer structure functions as an evaporator when said rotatable heat transfer structure rotates when said rotatable heat transfer structure is rotated in a counter-clockwise direction.

* * * * *

UNITED STATES PATENT AND TRADEMARK OFFICE

CERTIFICATE OF CORRECTION

PATENT NO. : 6,948,328 B2
DATED : September 27, 2005
INVENTOR(S) : John Kidwell

It is certified that error appears in the above-identified patent and that said Letters Patent is hereby corrected as shown below:

Title page,
Item [73], Assignee, should read:
-- Kelix Heat Transfer System, LLC (Tulsa, OK) --.

Signed and Sealed this

Fourteenth Day of March, 2006

JON W. DUDAS
*Director of the United States Patent and Trademark Office*